US012392342B2

(12) United States Patent
Du et al.

(10) Patent No.: US 12,392,342 B2
(45) Date of Patent: Aug. 19, 2025

(54) FLUID MACHINERY, HEAT EXCHANGE APPARATUS AND OPERATION METHOD FOR FLUID MACHINERY

(71) Applicant: GREE ELECTRIC APPLIANCES, INC. OF ZHUHAI, Zhuhai (CN)

(72) Inventors: Zhongcheng Du, Zhuhai (CN); Zhi Li, Zhuhai (CN); Peilin Zhang, Zhuhai (CN); Xuewei Song, Zhuhai (CN); Ruibo Yu, Zhuhai (CN); Hui Sun, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 0 days.

(21) Appl. No.: 18/733,486

(22) Filed: Jun. 4, 2024

(65) Prior Publication Data

US 2024/0318651 A1 Sep. 26, 2024

Related U.S. Application Data

(63) Continuation-in-part of application No. PCT/CN2022/135779, filed on Dec. 1, 2022, and a (Continued)

(30) Foreign Application Priority Data

Dec. 7, 2021 (CN) ..... 202111487159.7
Dec. 7, 2021 (CN) ..... 202111487183.0

(51) Int. Cl.
*F04C 29/00* (2006.01)
*F01C 1/344* (2006.01)
(Continued)

(52) U.S. Cl.
CPC ..... *F04C 29/0057* (2013.01); *F01C 1/344* (2013.01); *F01C 17/06* (2013.01); *F04C 18/344* (2013.01); *F04C 2240/60* (2013.01)

(58) Field of Classification Search
CPC ..... F04C 29/0057; F04C 18/344; F04C 2240/60; F01C 1/344; F01C 17/06
See application file for complete search history.

(56) References Cited

U.S. PATENT DOCUMENTS 753,390 A * 3/1904 Hamann ..... F01B 13/02 417/462
1,910,876 A * 5/1933 Appel ..... F04B 1/1136 417/462
(Continued)

FOREIGN PATENT DOCUMENTS

CN 101644325 A 2/2010
CN 102444583 A 5/2012
(Continued)

OTHER PUBLICATIONS

Extended European Search Report issued in counterpart European Patent Application No. 22903285.9, dated Feb. 17, 2025.
(Continued)

*Primary Examiner* — Mary A Davis
(74) *Attorney, Agent, or Firm* — Westbridge IP LLC

(57) ABSTRACT

A fluid machinery includes: a crankshaft, a cylinder sleeve, a crossed groove structure and sliding blocks, and there is a first included angle A between two eccentric parts of the crankshaft. The crankshaft and the cylinder sleeve are eccentrically arranged and have a fixed eccentric distance therebetween. The crossed groove structure has two limiting channels sequentially arranged along an axial direction of the crankshaft, and there is a second included angle B between the extension directions of the two limiting channels. The first included angle A is twice of the second
(Continued)

included angle B. The two eccentric parts are correspondingly extended into two through holes of the two sliding blocks, and the two sliding blocks are correspondingly arranged in the two limiting channels in a sliding manner, to form a volume-variable cavity.

19 Claims, 37 Drawing Sheets

Related U.S. Application Data continuation-in-part of application No. PCT/CN2022/135951, filed on Dec. 1, 2022.

(51) Int. Cl.
*F01C 17/06* (2006.01)
*F04C 18/344* (2006.01)

(56) References Cited

U.S. PATENT DOCUMENTS 4,723,895 A * 2/1988 Hayase ..... F04C 28/10 417/462
7,753,664 B2 * 7/2010 Go ..... F04C 2/10 417/462

FOREIGN PATENT DOCUMENTS

| | | | |
|---|---|---|---|
| CN | 204877938 | U | 12/2015 |
| CN | 106438356 | A | 2/2017 |
| CN | 208816337 | U | 5/2019 |
| CN | 112032051 | A | 12/2020 |
| CN | 113202761 | A | 8/2021 |
| GB | 1446286 | A | 8/1976 |
| JP | S59145379 | A | 8/1984 |
| JP | S6062601 | A | 4/1985 |
| JP | H09195956 | A | 7/1997 |
| JP | 2005139976 | A | 6/2005 |
| JP | 2005337210 | A | 12/2005 |
| JP | 2011085128 | A | 4/2011 |

OTHER PUBLICATIONS

Extended European Search Report issued in counterpart European Patent Application No. 22903296.6, dated Feb. 10, 2025.
International Search Report and Written Opinion issued in corresponding PCT Application No. PCT/CN2022/135779, dated Jan. 28, 2023.
International Search Report and Written Opinion issued in corresponding PCT Application No. PCT/CN2022/135951, dated Feb. 13, 2023.

* cited by examiner

FLUID MACHINERY, HEAT EXCHANGE APPARATUS AND OPERATION METHOD FOR FLUID MACHINERY

CROSS-REFERENCE TO RELATED APPLICATIONS

The present application is a continuation-in-part of International Application No. PCT/CN2022/135779, filed on Dec. 1, 2022, and a continuation-in-part of International Application No. PCT/CN2022/135951, filed on Dec. 1, 2022. The International Application No. PCT/CN2022/135779 claims priority to Chinese Patent Application No. 202111487159.7, filed on Dec. 7, 2021, and the International Application No. PCT/CN2022/135951 claims priority to Chinese Patent Application No. 202111487183.0, filed on Dec. 7, 2021. All of the aforementioned applications are hereby incorporated by reference in their entireties.

TECHNICAL FIELD

The present disclosure relates to the technical field of heat exchange system, and in particular, to fluid machinery, a heat exchange apparatus and an operation method for fluid machinery.

BACKGROUND

In some related technologies, fluid machinery includes a compressor and an expansion machine, and so on. Taking the compressor as an example, according to an energy saving and environment protection policy and a comfort requirement of a customer for an air conditioner, air conditioner industry is always pursuing high efficiency and low noise. As a core of the air conditioner, the compressor directly affects a level of power efficiency and noise of the air conditioner. A rolling rotor type compressor, as a mainstream compressor of a household air conditioner, development of its technology has been relatively mature at present. Limited by a structural principle, its optimization space is limited. If a major breakthrough is to be obtained, innovation needs to be performed from the structural principle.

Therefore, it is necessary to provide fluid machinery, such as a compressor or an expansion machine, which has characteristics of high energy efficiency and low noise and the like.

SUMMARY

According to an aspect of the present disclosure, there is provided fluid machinery including a crankshaft, a cylinder sleeve, a crossed groove structure and sliding blocks, where, the crankshaft is provided with two eccentric parts along an axial direction thereof, and there is a phase difference of a first included angle A between the two eccentric portions. The crankshaft and the cylinder sleeve are eccentrically arranged and have a fixed eccentric distance therebetween. The crossed groove structure is rotationally arranged in the cylinder sleeve, and the crossed groove structure has two limiting channels. The two limiting channels are sequentially arranged along the axial direction of the crankshaft. Extension directions of the two limiting channels are perpendicular to the axial direction of the crankshaft, and there is a phase difference of a first included angle B between the extension directions of the two limiting channels. The first included angle A is twice of the second included angle B. The sliding blocks are provided with through holes, and the number of the sliding blocks is two. The two eccentric parts correspondingly extend into the two through holes of the two sliding blocks, and the two sliding blocks are correspondingly arranged in the two limiting channels slidably, so that a volume-variable cavity is formed. The volume-variable cavity is located at a sliding direction of the sliding block. The crankshaft is rotated, to drive the sliding blocks to slide back and forth in the limiting channel while interacting with the crossed groove structure, so that the crossed groove structure and the sliding block is rotated in the cylinder sleeve.

In some embodiments, the crossed groove structure includes a first crossed groove section and a second crossed groove section which are connected along an axial direction thereof. The first crossed groove section and the second crossed groove section are arranged non-coaxially and are movably connected, and are both provided with the two limiting channels, respectively.

In some embodiments, eccentric amounts of the two eccentric portions are unequal.

In some embodiments, a distance, between an axis of an inner ring of the cylinder sleeve located at the first crossed groove section and an axis of an inner ring of the cylinder sleeve located at the second crossed groove section, is equal to an eccentric distance between the first crossed groove section and the second crossed groove section.

In some embodiments, the crossed groove structure further includes a first sliding connection member, and the first crossed groove section is movably connected to the second crossed groove section via the first sliding connection member. The first crossed groove section is rotated while the first sliding connection member slides relative to the first crossed groove section, and the second crossed groove section is rotated while the first sliding connection member slides relative to the second crossed groove section.

In some embodiments, the first sliding connection member has two first limiting sliding slots, extension directions of the two first limiting sliding slots are perpendicular to each other and are both perpendicular to the axial direction of the crankshaft. The first crossed groove section has a third protrusion structure at an end part of a side towards the first sliding connection member. The second crossed groove section has a fourth protrusion structure at an end part of a side towards the first sliding connection member. The third protrusion structure and the fourth protrusion structure are respectively arranged in the two first limiting sliding slots in a sliding manner. The first crossed groove section is rotated, to make the third protrusion structure slide back and forth in the corresponding first sliding connection member and interact with the first sliding connection member simultaneously, so that the first crossed groove section is rotated, and drives the fourth protrusion structure to slide back and forth in the corresponding first sliding connection member while driving the second crossed groove section to rotate. Or, the second crossed groove section is rotated, to make the fourth protrusion structure slide back and forth in the corresponding first sliding connection member and interact with the first sliding connection member simultaneously, so that the first crossed groove section is rotated, and drives the third protrusion structure to slide back and forth in the corresponding first sliding connection member while driving the first crossed groove section to rotate.

In some embodiments, the first sliding connection member has two first limiting protrusions extending towards the first crossed groove section and the second crossed groove section, respectively. The first crossed groove section has a third sliding slot structure at an end part of a side towards the first sliding connection member, and the second crossed groove section has a fourth sliding slot structure at an end part of a side towards the first sliding connection member. The two first limiting protrusions are respectively arranged in the third sliding slot structure and the fourth sliding slot structure slidably, and an extension direction of the third sliding slot structure is perpendicular to an extension direction of the fourth sliding slot structure. The first crossed groove section is rotated, to make the corresponding first limiting protrusion slide back and forth in the third sliding slot structure and the third sliding slot structure interact with the first sliding connection member simultaneously, so that the first sliding connection member is rotated, and drives the first limiting protrusion to slide back and forth in the fourth sliding slot structure while driving the second crossed groove section to rotate. Or, the second crossed groove section is rotated, to make the corresponding first limiting protrusion slide back and forth in the fourth sliding slot structure and the fourth sliding slot structure interact with the first sliding connection member simultaneously, so that the first sliding connection member is rotated, and drives the first limiting protrusion to slide back and forth in the third sliding slot structure while driving the first crossed groove section to rotate.

In some embodiments, a shaft body portion of the crankshaft is integrally formed and has only one axis.

In some embodiments, a shaft body portion of the crankshaft includes a first section and a second section which are connected along the axial direction thereof. The first section and the second section are coaxially arranged, and the two eccentric parts are respectively arranged at the first section and the second section.

In some embodiments, the first section is detachably connected to the second section.

In some embodiments, eccentric amounts of the two eccentric parts are unequal, where, the eccentric amount of the first eccentric part is equal to an assembly eccentric amount between the crankshaft and the corresponding first crossed groove section, and the eccentric amount of a second eccentric part is equal to an assembly eccentric amount between the crankshaft and the corresponding second crossed groove section.

In some embodiments, a shaft body portion of the crankshaft includes a first section and a second section which are connected along the axial direction thereof, the first section and the second section are non-coaxially arranged and are movably connected, and the two eccentric parts are respectively arranged at the first section and the second section.

In some embodiments, the crankshaft further includes a sliding connection member, and the first section movably is connected to the second section via the sliding connection member. The first section is rotated while the sliding connection member slides relative to the first section, and the second section is rotated while the sliding connection member slides relative to the second section.

In some embodiments, the sliding connection member has two limiting sliding slots, extension directions of the two limiting sliding slots are perpendicular to each other and are both perpendicular to the axial direction of the crankshaft. The first section has a first protrusion structure at an end part of a side towards the sliding connection member, and the second section has a second protrusion structure at an end part of a side towards the sliding connection member, where the first protrusion structure and the second protrusion structure are arranged in the two limiting sliding slots in a sliding manner, respectively. The first section is rotated, to make the first protrusion structure slide back and forth in the corresponding limiting sliding slot and interact with the sliding connection member simultaneously, so that the sliding connection member is rotated, and drives the second protrusion structure to slide back and forth in the corresponding limiting sliding slot while driving the second section to rotate. Or, the second section is rotated, to make the second protrusion structure slide back and forth in the corresponding limiting sliding slot and interact with the sliding connection member simultaneously, so that the sliding connection member is rotated, and drives the first protrusion structure to slide back and forth in the corresponding limiting sliding slot while driving the first section to rotate.

In some embodiments, the sliding connection member has two limiting protrusions extending towards the first section and the second section respectively. The first section has a first sliding slot structure at an end part of a side towards the sliding connection member, and the second section has a second sliding slot structure at an end part of a side towards the sliding connection member. The two the limiting protrusions are respectively arranged in the first sliding slot structure and the second sliding slot structure slidably, and an extension direction of the first sliding slot structure is perpendicular to an extension direction of the second sliding slot structure. The first section is rotated, to make the corresponding limiting protrusion slide back and forth in the first sliding slot structure and the first sliding slot structure simultaneously interact with the sliding connection member, so that the sliding connection member is rotated, and drives the limiting protrusion to slide back and in the second sliding slot structure while driving the second section to rotate. Or, the second section is rotated, to make the corresponding limiting protrusion slide back and forth in the second sliding slot structure and the second sliding slot structure simultaneously interact with the sliding connection member, so that the sliding connection member is rotated, and drives the limiting protrusion to slide back and forth in the first sliding slot structure while driving the first section to rotate.

In some embodiments, an assembly eccentric amount, between the first section and the cylinder sleeve, is equal to the eccentric amount of the eccentric part arranged at the first section, and an assembly eccentric amount, between the second section and the cylinder sleeve, is equal to the eccentric amount the eccentric parts arranged at the second section.

In some embodiments, eccentric amounts of the two the eccentric parts are equal, where an assembly eccentric amount, between the first section and the corresponding first crossed groove section, is equal to the eccentric amount of the eccentric part which is arranged at the first section, and an assembly eccentric amount, between the second section and the corresponding second crossed groove section, is equal to the eccentric amount of the eccentric part which is arranged at the second section.

In some embodiments, eccentric amounts of the two eccentric parts are unequal, where an assembly eccentric amount, between the first section and the corresponding first crossed groove section, is equal to the eccentric amount of the eccentric part which is arranged at the first section, and an assembly eccentric amount, between the second section and the corresponding second crossed groove section, is equal to the eccentric amount of the eccentric part which is arranged at the second section.

In some embodiments, a shaft body portion of the crankshaft is integrally formed with the eccentric part; or, a shaft body portion of the crankshaft is detachably connected to the eccentric part.

In some embodiments, two ends of the limiting channel penetrate to a peripheral surface of the crossed groove structure.

In some embodiments, two ends of one of the two limiting channels penetrate through a peripheral surface of the first crossed groove section, and two ends of the other of the two limiting channels penetrate through a peripheral surface of the second crossed groove section.

In some embodiments, the two sliding blocks are concentrically arranged with the two eccentric parts respectively, and the sliding block performs a circular motion around the axis of the crankshaft where the sliding block is located, there is a first rotating gap between a hole wall of the through hole and the eccentric part, and the first rotating gap ranges from 0.005 mm to 0.05 mm.

In some embodiments, there is a second rotating gap between a peripheral surface of the first crossed groove section and an inner wall surface of an end of the axial direction of the cylinder sleeve, and the second rotating gap ranges from 0.01 mm to 0.08 mm, there is a third rotating gap between a peripheral surface of the second crossed groove section and an inner wall surface of the other end of the axial direction of the cylinder sleeve, and the third rotating gap ranges from 0.01 mm to 0.08 mm.

In some embodiments, the first included angle A ranges from 160 degrees to 200 degrees, and the second included angle B ranges from 80 degrees to 100 degrees.

In some embodiments, the fluid machinery further includes a flange arranged at an end of the axial direction of the cylinder sleeve, and the crankshaft and the flange are concentrically arranged.

In some embodiments, there is a first assemble gap between the crankshaft and the flange, and the first assemble gap ranges from 0.005 mm to 0.05 mm.

In some embodiments, the first assemble gap ranges from 0.01 mm to 0.03 mm.

In some embodiments, the eccentric part is provided with an arc surface, and a central angle of the arc surface is larger than or equal to 180 degrees.

In some embodiments, the eccentric part is cylindrical.

In some embodiments, a proximal end of the eccentric part is arranged as one of the following: the proximal end of the eccentric part is flush with an outer circle of a shaft body portion of the crankshaft; or, the proximal end of the eccentric part is protruded from an outer circle of a shaft body portion of the crankshaft; or, the proximal end of the eccentric part is provided at an inner side of an outer circle of a shaft body portion of the crankshaft.

In some embodiments, the sliding block includes a plurality of sub-sliding blocks which are spliced to form the through hole.

In some embodiments, the two eccentric parts are arranged at intervals in the axial direction of the crankshaft.

In some embodiments, the first crossed groove section and the second crossed groove section all have a central hole, the two central holes are non-concentrically arranged, and the two limiting channels communicate with each other via the two central holes, where apertures of the two central holes are both larger than a diameter of the shaft body portion.

In some embodiments, the aperture of the central hole is larger than a diameter of the eccentric part.

In some embodiments, a projection of the sliding block, in an axial direction of the through hole, has two relatively parallel straight-line segments and arc segments connecting ends of the two straight line segments.

In some embodiments, the limiting channel has a set of first sliding surfaces arranged opposite to each other and in sliding contact with the sliding block, and the sliding block has a second sliding surface matched with the first sliding surface and a pressing surface towards an end of the limiting channel. The pressing surface serves as a head of the sliding block, the two second sliding surfaces is connected via the pressing surface, and the pressing surface faces to the volume-variable cavity.

In some embodiments, the pressing surface is an arc surface, a distance, between an arc center of the arc surface and a center of the through hole, is equal to an eccentric amount of the eccentric part.

In some embodiments, a curvature radius of the arc surface is equal to a radius of an inner circle of the cylinder sleeve; or there is a difference value between a curvature radius of the arc surface and a radius of an inner circle of the cylinder sleeve, and the difference value ranges from −0.05 mm to 0.025 mm.

In some embodiments, the difference value ranges from −0.02 mm to 0.02 mm.

In some embodiments, a ratio, between a projection area $S_{sliding\ block}$ in the sliding direction of the sliding block, of the pressing surface and, an area $S_{exhaus}$ of a compression exhaust port of the cylinder sleeve, is $S_{sliding\ block}/S_{exhaus}$, which ranges from 8 to 25.

In some embodiments, the ratio $S_{sliding\ block}/S_{exhaus}$ ranges from 12 to 18.

In some embodiments, the cylinder sleeve has a compression intake port and a compression exhaust port, in the case that any of the sliding blocks is at an intake position, the compression intake port communicates with the corresponding volume-variable cavity; in the case that any of the sliding blocks is at an exhaust position, the corresponding volume-variable cavity communicates with the compression exhaust port.

In some embodiments, an inner wall surface of the cylinder sleeve has an air-suction cavity, and the air-suction cavity communicates with the compression intake port.

In some embodiments, the air-suction cavity extends a first preset distance around a circumference of the inner wall surface of the cylinder sleeve, to form an arc-shaped air-suction cavity.

In some embodiments, there are two air-suction cavities, and the two air-suction cavities are arranged at intervals along the axial direction of the cylinder sleeve. The cylinder sleeve further has an air-suction communicating cavity, and the two air-suction cavities all communicate with the air-suction communicating cavity, and the compression intake port communicates with the air-suction cavity via the air-suction communicating cavity.

In some embodiments, the air-suction communicating cavity extends a second preset distance along the axial direction of the cylinder sleeve, and at least one end of the air-suction communicating cavity penetrates through an axial end surface of the cylinder sleeve.

In some embodiments, an outer wall of the cylinder sleeve is provided with an exhaust cavity, and the compression exhaust port communicates with the exhaust cavity via the inner wall of the cylinder sleeve. The fluid machinery further includes an exhaust valve assembly arranged in the exhaust cavity and corresponding to the compression exhaust port.

In some embodiments, there are two the compression exhaust ports, and the two compression exhaust ports are arranged at intervals along the axial direction of the cylinder sleeve. There are two of the exhaust valve assemblies, the two exhaust valve assemblies are arranged corresponding to the two compression exhaust ports respectively.

In some embodiments, an axial end surface of the cylinder sleeve is further provided with a communicating hole, and the communicating hole communicates with the exhaust cavity. The fluid machinery further includes a flange provided with an exhaust channel, and the communicating hole communicates with the exhaust channel.

In some embodiments, the exhaust cavity penetrates through an outer wall surface of the cylinder sleeve, the fluid machinery further includes an exhaust cover plate connected to the cylinder sleeve and sealing the exhaust cavity.

In some embodiments, the fluid machinery is a compressor.

In some embodiments, the cylinder sleeve has an expansion intake port and an expansion exhaust port. In the case that any of the sliding blocks is at an air inlet position, the expansion exhaust port communicates with the corresponding volume-variable cavity; and in the case that any of the sliding blocks is at an air exhaust position, the corresponding volume-variable cavity communicates with the expansion intake port.

In some embodiments, an inner wall surface of the cylinder sleeve has an expansion exhaust cavity communicating with the expansion exhaust port.

In some embodiments, the expansion exhaust cavity extends a first preset distance around a circumference of the inner wall surface of the cylinder sleeve, to form an arc-shaped expansion exhaust cavity, and the expansion exhaust cavity extends from the expansion exhaust port to a side where the expansion intake port is located. An extension direction of the expansion exhaust cavity is the same as a rotation direction of the crossed groove structure.

In some embodiments, there are two expansion exhaust cavities, the two expansion exhaust cavities are arranged at intervals along the axial direction of the cylinder sleeve. The cylinder sleeve is further provided with an expansion exhaust communicating cavity, the two expansion exhaust cavities both communicate with the expansion exhaust communicating cavity, and the expansion exhaust port communicates with the expansion exhaust cavity via the expansion exhaust communicating cavity.

In some embodiments, the expansion exhaust communicating cavity extends a second preset distance along the axial direction of the cylinder sleeve, and at least one end of the expansion exhaust communicating cavity penetrates through an axial end surface of the cylinder sleeve.

In some embodiments, the fluid machinery is an expansion machine.

According to another aspect of the present disclosure, a heat exchange apparatus is provided, including fluid machinery above-mentioned.

According to another aspect of the present disclosure, an operation method for fluid machinery is provided, including: performing, by a crankshaft, rotation, around an axis $O_0$ thereof; performing, by a first crossed groove section, revolution, around the axis $O_0$ of the crankshaft, and the axis $O_0$ of the crankshaft and an axis $O_1$ of the first crossed groove section being eccentrically arranged and having a fixed eccentric distance therebetween; and performing, by a second crossed groove section, revolution, around the axis $O_0$ of the crankshaft, where the axis $O_0$ of the crankshaft and an axis $O_0'$ of the second crossed groove section being eccentrically arranged and having a fixed eccentric distance therebetween; taking the axis $O_0$ of the crankshaft as a center of a circle and, performing, by a first sliding block, a circular motion, a distance, between a center $O_3$ of the first sliding block and the axis $O_0$ of the crankshaft, being equal to an eccentric amount of the first eccentric part corresponding to the crankshaft, and the eccentric amount being equal to the eccentric distance between the axis $O_0$ of the crankshaft and the axis $O_0$ of the first crossed groove section; the crankshaft being rotated, to drive the first sliding block to perform the circular motion, and the first sliding block interacting with the first crossed groove section and sliding back and forth in the limiting channel of the first crossed groove section; and taking the axis $O_0$ of the crankshaft as a center of a circle and, performing, by a second sliding block, a circular motion, a distance, between a center $O_4$ of the second sliding block and the axis $O_0$ of the crankshaft, being equal to an eccentric amount of the second eccentric part corresponding to the crankshaft, the eccentric amount being equal to the eccentric distance between the axis $O_0$ of the crankshaft and the axis $O_0'$ of the second crossed groove section, the crankshaft being rotated, to drive the second sliding block to perform the circular motion, and the second sliding block interacting with the second crossed groove section and sliding back and forth in the limiting channel of the second crossed groove section.

In some embodiments, a mechanism principle of a cross-shaped sliding block is adopted by the operation method, where the two eccentric portions of the crankshaft serve as a first connecting rod $L_1$ and a second connecting rod $L_2$ respectively, the limiting channel of the first crossed groove section serves as a third connecting rod $L_3$, and the limiting channel of the second crossed groove section serves as a fourth connecting rod $L_4$, where lengths of the first connecting rod $L_1$ and the second connecting rod $L_2$ are not equal.

In some embodiments, there is a first included angle A between the first connecting rod $L_1$ and the second connecting rod $L_2$, and there is a second included angle B between the third connecting rod $L_3$ and the fourth connecting rod $L_4$, where, the first included angle A is twice of the second included angle B.

In some embodiments, a connecting line, among the axis $O_0$ of the crankshaft, the axis $O_1$ of the first crossed groove section and the axis $O_0'$ of the second crossed groove section, is $O_0O_1O_1'$. There is a third included angle C between the first connecting rod $L_1$ and the connecting line $O_0O_1O_1'$, and correspondingly, there is a fourth included angle D between the third connecting rod $L_3$ and the connecting line $O_0O_1O_1'$, where the third included angle C is twice of the fourth included angle D. There is a fifth included angle E between the second connecting rod $L_2$ and the connecting line $O_0O_1O_1'$, and correspondingly, there is a sixth included angle F between the fourth connecting rod $L_4$ and the connecting line $O_0O_1O_1'$, where the fifth included angle E is twice of the sixth included angle F. A sum of the third included angle C and the fifth included angle E is the first included angle A, and a sum of the fourth included angle D and the sixth included angle F is the second included angle B.

In some embodiments, the operation method further includes that an angular velocity of the rotation of the sliding block is equal to an angular velocity of the revolution of the sliding block; and angular velocities of the revolution of the first crossed groove section and the second crossed groove section are equal to the angular velocity of the rotation of the sliding block.

In some embodiments, during a rotating process of the crankshaft, the crankshaft is rotated two circles, to implement four times of air suction and exhaust process.

In some embodiments, the operation method further includes: performing, by a first section of the crankshaft, rotation, around the axis $O_0$ of the first section, and performing, by a second section of the crankshaft, rotation, around the axis $O_0'$ of the second section, where the $O_0$ and the $O_0'$ do not coincide; the axis $O_0$ of the first section and the axis $O_0$ of the first crossed groove section being eccentrically arranged and having a fixed eccentric distance therebetween, and the axis $O_0'$ of the second section and the axis $O_0'$ of the second crossed groove section, being eccentrically arranged and having a fixed eccentric distance therebetween; taking the axis $O_0$ of the first section as a center of a circle and, performing, by a first sliding block, a circular motion, a distance, between a center $O_3$ of the first sliding block and the axis $O_0$ of the first section, being equal to the eccentric amount of the eccentric part on the first section, and the eccentric amount of the eccentric part on the first section being equal to the eccentric distance between the axis $O_0$ of the first section and the axis $O_1$ of the first crossed groove section, the first section being rotated, to drive the first sliding block to perform the circular motion, and the first sliding block interacting with the first crossed groove section and sliding back and forth in the limiting channel of the first crossed groove section; and taking the axis $O_0'$ of the second section as a center of a circle and, performing, by a second sliding block, a circular motion, a distance, between a center $O_4$ of the second sliding block and the axis $O_0'$ of the second section, being equal to the eccentric amount of the eccentric part on the second section, and the eccentric amount on the second section being equal to the eccentric distance between the axis $O_0'$ of the second section and the axis $O_1'$ of the second crossed groove section, the second section being rotated, to drive the second sliding block to perform a circular motion, and the second sliding block interacting with the second crossed groove section and sliding back and forth in the limiting channel of the second crossed groove section.

In some embodiments, a mechanism principle of a cross-shaped sliding block is adopted by the operation method, where the eccentric portion of the first section serves as a first connecting rod $L_1$, the eccentric portion of the second section serves as a second connecting rod $L_2$, the limiting channel of the first crossed groove section serves as a third connecting rod $L_3$, and the limiting channel of the second crossed groove section serves as a fourth connecting rod $L_4$, where a length of the first connecting rod L1 is equal to a length of the second connecting rod $L_2$.

In some embodiments, a mechanism principle of a cross-shaped sliding block is adopted by the operation method, where the eccentric portion of the first section serves as a first connecting rod $L_1$, the eccentric portion of the second section serves as a second connecting rod $L_2$, the limiting channel of the first crossed groove section serves as a third connecting rod $L_3$, and the limiting channel of the second crossed groove section serves as a fourth connecting rod $L_4$, where lengths of the first connecting rod $L_1$ and the second connecting rod $L_2$ are not equal.

In some embodiments, there is a first included angle A between the first connecting rod $L_1$ and the second connecting rod $L_2$, and there is a first included angle B between the third connecting rod $L_3$ and the fourth connecting rod $L_4$, where the first included angle A is twice of the second included angle B.

In some embodiments, a connecting line, among the axis $O_0$ of the first section, the axis $O_0'$ of the second section, the axis $O_1$ of first crossed groove section and the axis $O_1'$ of second crossed groove section, is $O_0O_0'O_1O_1'$. There is a third included angle C between the first connecting rod $L_1$ and the connecting line $O_0O_0'O_1O_1'$, and correspondingly, there is a fourth included angle D between the third connecting rod $L_3$ and the connecting line $O_0O_0'O_1O_1'$, where the third included angle C is twice of the fourth included angle D. There is a fifth included angle E between the second connecting rod $L_2$ and the connecting line $O_0O_0'O_1O_1'$, and correspondingly, there is a sixth included angle F between the fourth connecting rod $L_4$ and the connecting line $O_0O_0'O_1O_1'$, where the fifth included angle E is twice of the sixth included angle F. A sum of the third included angle C and the fifth included angle E is the first included angle A, and a sum of the fourth included angle D and the sixth included angle F is the second included angle B.

In some embodiments, the operation method further includes that an angular velocity of the rotation of the sliding block is equal to an angular velocity of the revolution of the sliding block; and angular velocities of the revolution of the first crossed groove section and the second crossed groove section are equal to the angular velocity of the rotation of the sliding block.

In some embodiments, during a rotating process of the crankshaft, the crankshaft is rotated two circles, to implement four times of air suction and exhaust process.

According to another aspect of the present disclosure, an operation method for fluid machinery is provided. The operation method including: performing, by a first section of the crankshaft, rotation, around an axis $O_0$ of the first section, and performing, by a second section of the crankshaft, rotation, around an axis $O_0'$ of the second section, where the $O_0$ and the $O_0'$ do not coincide; the axis $O_0$ of the first section and an axis $O_1$ of the crossed groove structure being eccentrically arranged and having a fixed eccentric distance therebetween, and the axis $O_0'$ of the second section and the axis $O_1$ of the crossed groove structure being eccentrically arranged and having a fixed eccentric distance therebetween; taking the axis $O_0$ of the first section as a center of a circle and, performing, by a first sliding block, a circular motion, a distance, between a center $O_3$ of the first sliding block and the axis $O_0$ of the first section, being equal to the eccentric amount of the eccentric part at the first section, the eccentric amount of the eccentric part at the first section being equal to the eccentric distance between the axis $O_0$ of the first section and the axis $O_0$ of the crossed groove, the crankshaft being rotated, to drive the first sliding block to perform the circular motion, and the first sliding block interacting with the crossed groove structure and sliding back and forth in the limiting channel of the crossed groove structure; and taking the axis $O_0'$ of the second section as a center of a circle and, performing, by a second sliding block, a circular motion, a distance, between a center $O_0$ of the second sliding block and the axis $O_0'$ of the second section, being equal to the eccentric amount of the eccentric part at the second section, the eccentric amount at the second section being equal to an eccentric distance between the axis $O_0'$ of the second section and the axis $O_1$ of the crossed groove, the crankshaft being rotated, to drive the second sliding block to perform the circular motion, and the second sliding block interacting with the crossed groove structure and sliding back and forth in the limiting channel of the crossed groove structure.

In some embodiments, the operation method adopts a mechanism principle of a cross-shaped sliding block, the eccentric part of the first section serves as a first connecting rod $L_1$, the eccentric part of the second section serves as a second connecting rod $L_2$, and the two limiting channels of the crossed groove structure respectively serve as a third connecting rod $L_3$ and a fourth connecting rod $L_4$, where a length of the first connecting rod $L_1$ is not equal to a length of the second connecting rod $L_2$.

In some embodiments, a connecting line, among the axis (% of the first section, the axis $O_0'$ of the second section and the axis $O_0$ of the crossed groove, is $O_0O_0'O_1$. There is a third included angle C between the first connecting rod $L_1$ and the connecting line $O_0O_0'O_1$, and correspondingly, there is a fourth included angle D between the third connecting rod $L_3$ and the connecting line $O_0O_0'O_1$. The third included angle C is twice of the fourth included angle D. There is a fifth included angle E between the second connecting rod $L_2$ and the connecting line $O_0O_0'O_1$, and correspondingly, there is a sixth included angle F between the fourth connecting rod $L_4$ and the connecting line $O_0O_0'O_1$. The fifth included angle E is twice of the sixth included angle F. A sum of the third included angle C and the fifth included angle E is the first included angle A, and a sum of the fourth included angle D and the sixth included angle F is the second included angle B.

In some embodiments, the operation method further includes: an angular velocity of the rotation of the sliding block is equal to an angular velocity of the revolution of the sliding block, and an angular velocity of the revolution of the crossed groove structure is equal to the angular velocity of the rotation of the sliding block.

According to technical solutions of the present disclosure, the crossed groove structure is designed to be a structure provided with two limiting channels, and correspondingly, two sliding blocks are provided. The two eccentric parts of the crankshaft correspondingly extend into the two through holes of the two sliding blocks, meanwhile, the two sliding blocks are correspondingly arranged in the two limiting channels in a sliding manner, so that a volume-variable cavity is formed. Since the first included angle A between the two eccentric parts is twice of the second included angle B between the extension directions of the two limiting channels, in the case that one of the two sliding blocks is at a dead point position, that is, driving torque, of the eccentric part corresponding to the sliding block at the dead-point position, is zero, so that the sliding block at the dead-point position cannot continue rotating. At this point, driving torque, of the sliding block corresponding to the other of the two eccentric parts, is the maximum value, to ensure that the eccentric part with the maximum driving torque may normally drive the corresponding sliding block to rotate, so that the crossed groove structure is driven to rotate by this sliding block, further the sliding block at the dead-point position is driven to continue to rotate by the crossed groove structure, so that a stable operation of the fluid machinery is achieved, and the dead-point position of the motion mechanism is avoided, and thus motion reliability of the fluid machinery is improved.

Moreover, the fluid machinery provided by the present discourse is capable to be stably operated, that is, energy efficiency of the fluid machinery, such as a compressor and an expansion machine is improved, and noise is reduced, so that operational reliability of the heat exchange apparatus is ensured.

BRIEF DESCRIPTION OF THE DRAWINGS

The drawings described herein are used to provide a further understanding of the present disclosure, and constitute a part of the present disclosure. The illustrative embodiments of the present disclosure and the description thereof are used to explain the present disclosure, and do not constitute an improper limitation on the present disclosure.

DETAILED DESCRIPTIONS OF THE EMBODIMENTS

Figure 75:
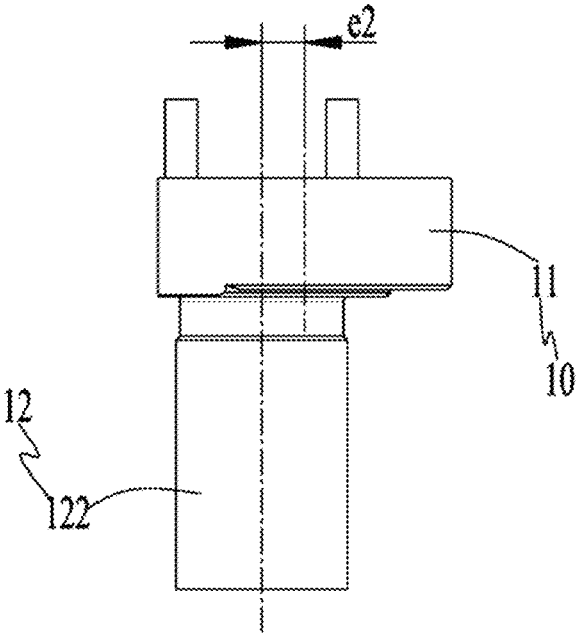
FIG. 75 shows a schematic structural diagram of a second section and an eccentric amount of an eccentric part at the second section in FIG. 73.

Technical solutions of embodiments of the present disclosure will be clearly and completely described below with reference to FIGS. 1 to 75. Apparently, the described embodiments are merely a portion but not all of the embodiments of the present disclosure. Based on the embodiments of the present disclosure, all other embodiments obtained by a person having ordinary skill in the art without creative efforts shall fall within the protection scope of the present disclosure.

In description of the present disclosure, it should be understood that, orientation or positional relationships indicated by terms "center", "longitudinal", "transverse", "front", "rear", "left", "right", "vertical", "horizontal", "top", "bottom", "inner", "outer" and the like, are based on the orientation or positional relationships shown in the drawings, rather than indicating or implying that the indicated device or element must have a particular orientation, constructed and operated in a particular orientation, and therefore cannot be understood as a limitation to the protection scope of the present disclosure.

Some embodiments of the present disclosure provide fluid machinery, a heat exchange apparatus, and an operation method for fluid machinery, to solve problems of low energy efficiency and loud noise about fluid machinery, such as a compressor and an expansion machine.

Figure 46:
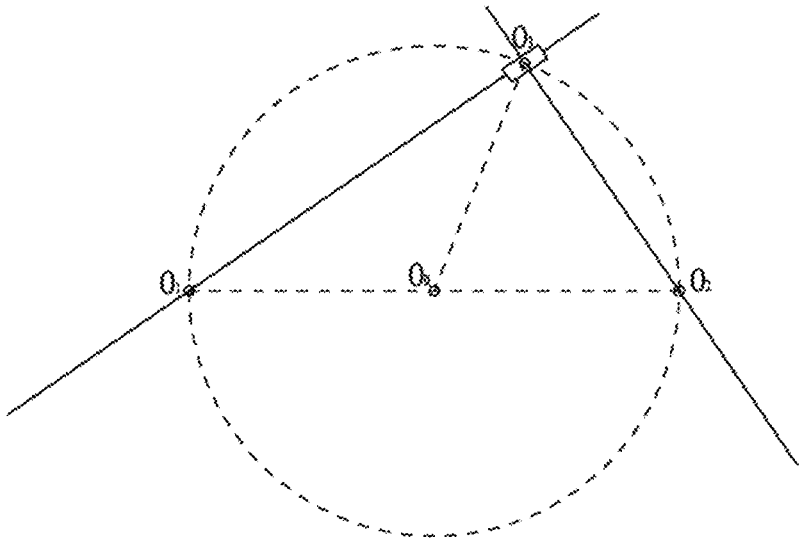
FIG. 46 shows a schematic diagram of a mechanism principle of an operation of a compressor in some related technologies.

In some related technologies, as shown in FIG. 46, based on a cross-shaped sliding block mechanism, a mechanism principle about an operation of a compressor is provided, that is, a point $O_1$ serves as a center of a cylinder, a point $O_2$ serves as a center of a driving shaft, and a point $O_3$ serves as a center of a sliding block. The cylinder and the driving shaft are eccentrically arranged, where, the center $O_3$ of the sliding block performs a circular motion on a circle, and a diameter of the circle is equal to a length of a line segment $O_1O_2$.

In the above-mentioned mechanism principle of the operation, the center $O_0$ of the cylinder and the center $O_2$ of the driving shaft are two rotation centers of the motion mechanism, and at the same time, a midpoint $O_0$ of the line segment $O_1O_2$ serves as a virtual center of the center $O_3$ of the sliding block, to make the sliding block slide back and forth relative to the cylinder, and the sliding block also slides back and forth relative to the driving shaft simultaneously.

Figure 47:
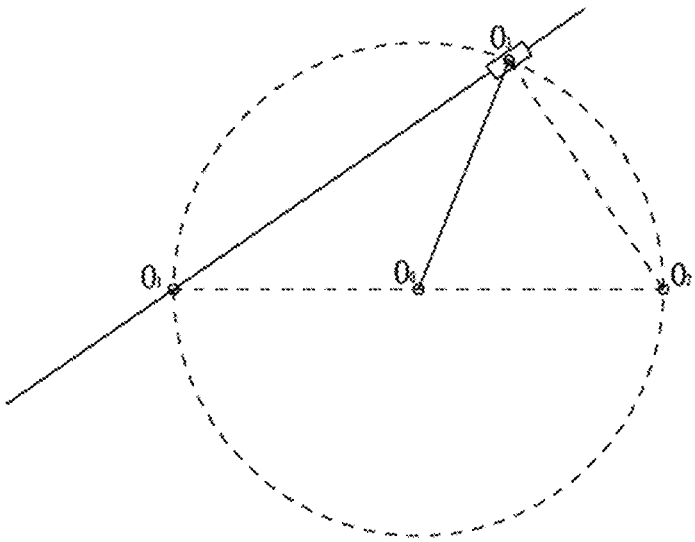
FIG. 47 shows a schematic diagram of a mechanism principle of an operation of a compressor after being improved in some related technologies.

Since the midpoint $O_0$ of the line segment $O_1O_2$ is a virtual center, a balancing system could not be set, resulting in a problem that a high-frequency vibration characteristic of the compressor is deteriorated. Based on the above-mentioned mechanism principle of the operation, as shown in FIG. 47, a motion mechanism taking the $O_0$ as a center of the driving shaft is provided, that is, the center $O_1$ of the cylinder and the center $O_0$ of the driving shaft are taken as two rotation centers of the motion mechanism. The driving shaft is provided with an eccentric part. The sliding block and the eccentric part are arranged coaxially. An assembly eccentric amount of the driving shaft and a cylinder is equal to an eccentric amount of the eccentric part, so that a center $O_3$ of the sliding block performs a circular motion with the center $O_0$ of the driving shaft as a center of a circle and the $O_1O_2$ as the radius.

An operation mechanism is provided correspondingly, including a cylinder, a limiting groove structure, a sliding block and a driving shaft. The limiting groove structure is rotationally arranged in the cylinder, and the cylinder and the limiting groove structure are arranged coaxially, that is, the center $O_1$ of the cylinder is also a center of the limiting groove structure. The sliding block slides back and forth relative to the limiting groove structure. The sliding block and an eccentric part of the driving shaft are assembled coaxially. The sliding block performs a circular motion around a shaft body portion of the driving shaft. Specifically, a motion process is as follows: the driving shaft is rotated, to drive the sliding block to perform revolution around the center of the shaft body portion of the driving shaft, and the sliding block performs rotation relative to the eccentric part simultaneously, and the sliding block slides back and forth in a limiting groove of the limiting groove structure, so that the limiting groove structure is pushed to rotate.

Figure 48:
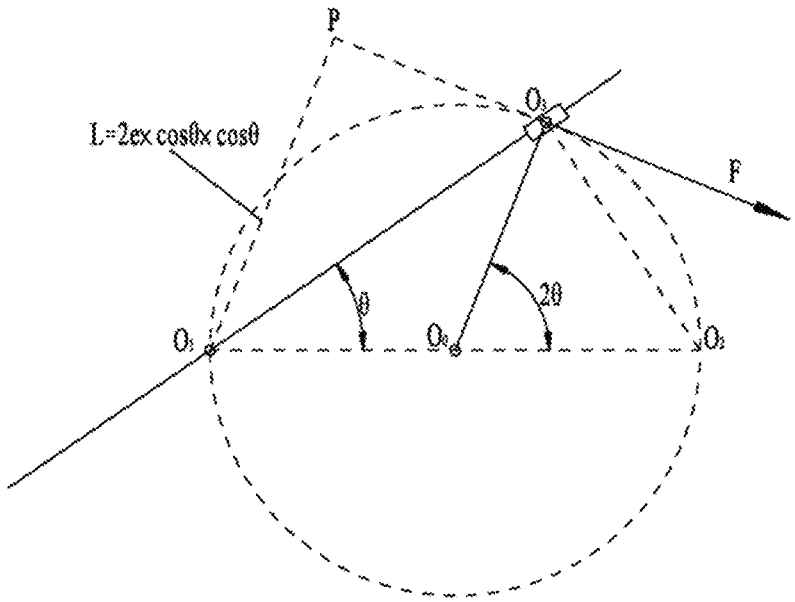
FIG. 48 shows a schematic diagram of the mechanism principle of the operation of the compressor in FIG. 47, and in this figure, a force arm that a driving shaft driving a sliding block to rotate is shown.

However, as shown in FIG. 48, a length of a force arm that the driving shaft drives the sliding block to rotate is $L=2e\times\cos\theta\times\cos\theta$, where the e is an eccentric amount of the eccentric part, and the θ is an included angle between the line segment $O_1O_2$ and a sliding direction of the sliding block in the limiting groove.

Figure 49:
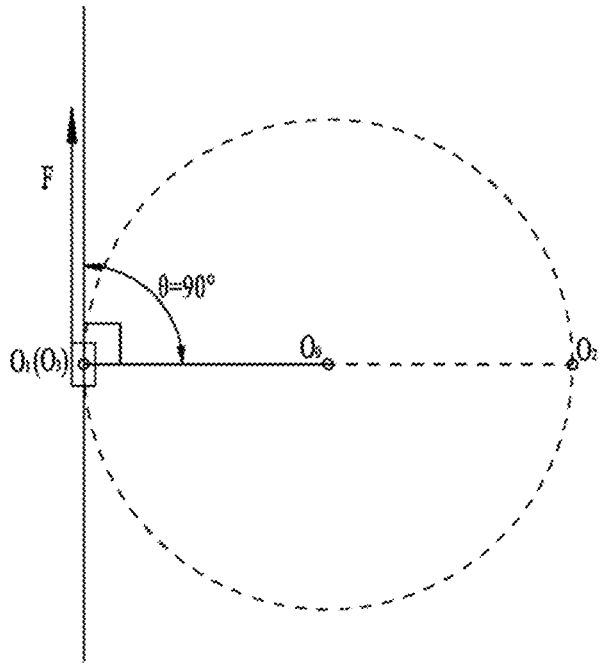
FIG. 49 shows a schematic diagram of the mechanism principle of the operation of the compressor in FIG. 47, and in this figure, a center of a limiting groove structure coincides with a center of an eccentric part.

As shown in FIG. 49, when the center $O_1$ of the cylinder (that is, the center of the limiting groove structure) and the center of the eccentric part coincide, a resultant force of driving forces of the driving shaft passes through the center of the limiting groove structure. That is, torque which is applied to the limiting groove structure is zero, so that the limiting groove structure could not be rotated. At this point, the motion mechanism is at a dead point position, so that the sliding block could not be driven to rotate.

Based on this, the present disclosure provides a mechanism principle including a crossed groove structure having two limiting channels and two sliding blocks. Based on this principle, fluid machinery such as a compressor and an expansion machine is constructed. The fluid machinery has characteristics of high energy efficiency and low noise. In the following, taking a compressor as an example, a compressor including a crossed groove structure having two limiting channels and two sliding blocks is introduced in details.

To solve problems of low energy efficiency and loud noise of the fluid machinery, such as a compressor and an expansion machine in the related technologies, the present disclosure provides fluid machinery, a heat exchange apparatus, and an operation method for fluid machinery. The heat exchange apparatus includes the fluid machinery mentioned below, and the fluid machinery is operated by adopting the following operation method.

Figure 5:
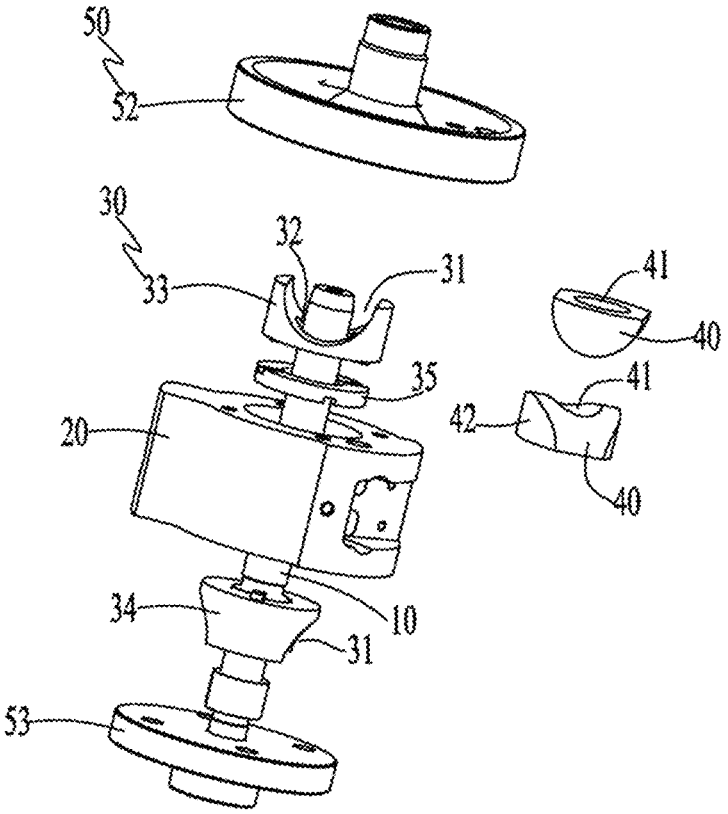
FIG. 5 shows a schematic exploded structural diagram of the pump body assembly in FIG. 4.
Figure 11:
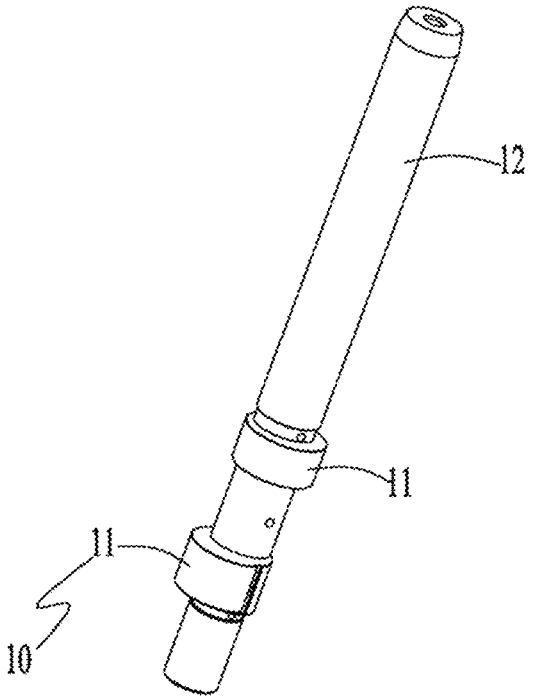
FIG. 11 shows a schematic structural diagram of a crankshaft in FIG. 5.
Figure 24:
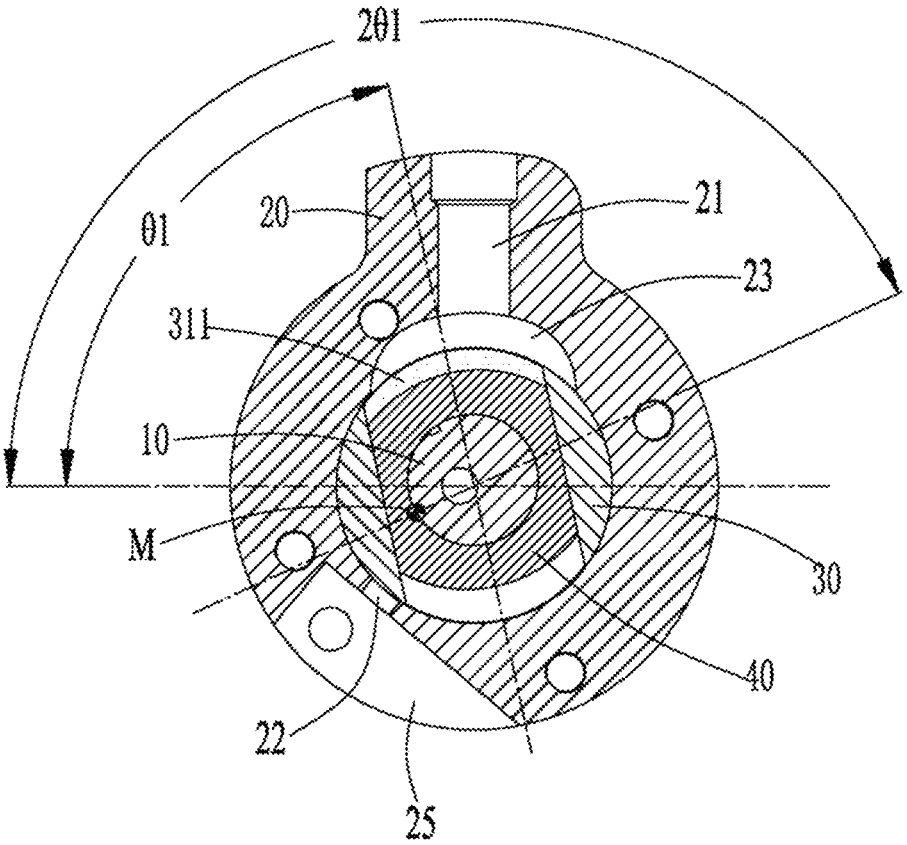
FIG. 24 shows a schematic diagram of a state structure of the compressor in FIG. 3 which in an air-suction process.
Figure 56:
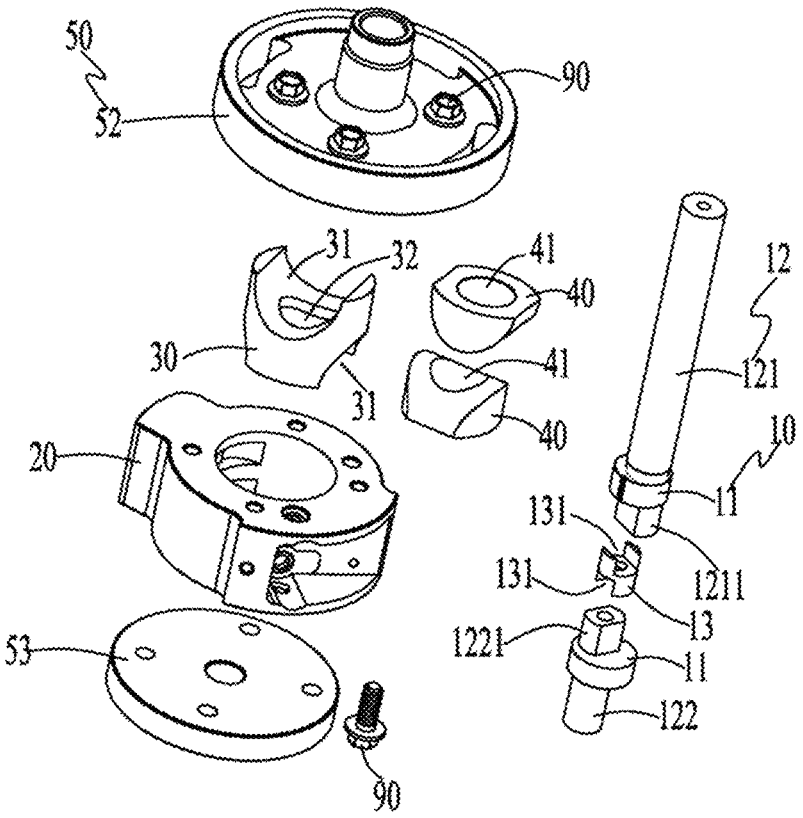
FIG. 56 shows a schematic exploded structural diagram of the pump body assembly in FIG. 55.
Figure 57:
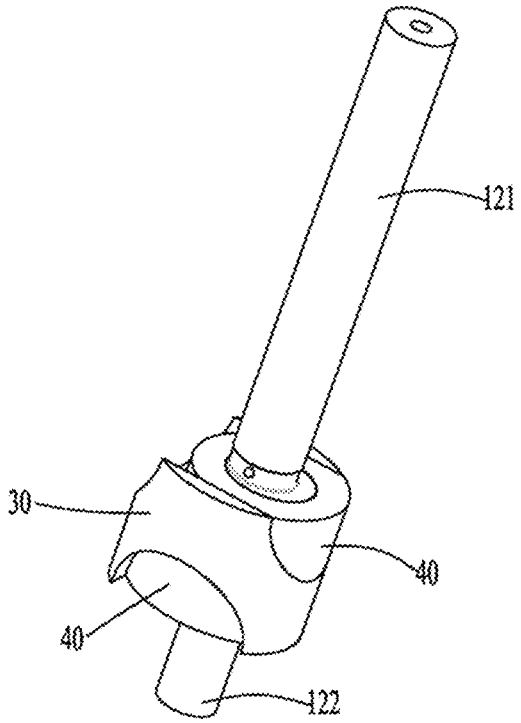
FIG. 57 shows a schematic diagram of an assembly structure of a crankshaft, a crossed groove structure and a sliding block in FIG. 56.
Figure 58:
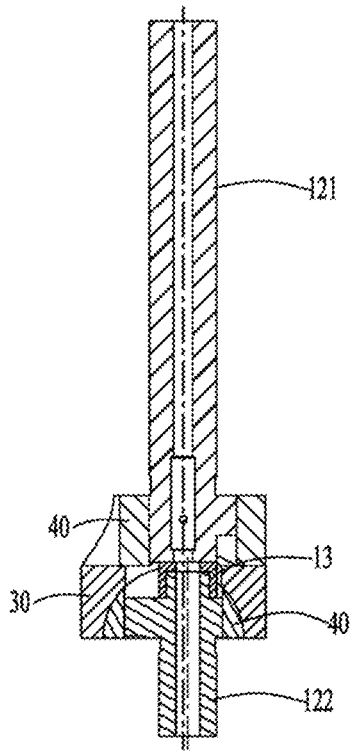
FIG. 58 shows a schematic sectional view of the crankshaft, the crossed groove structure and the sliding block in FIG. 57.

Referring to FIG. 5 or FIG. 56, the fluid machinery of the present disclosure includes a crankshaft 10, a cylinder sleeve 20, a crossed groove structure 30 and sliding blocks 40. Referring to FIG. 11, the crankshaft 10 is provided with two eccentric parts 11 along the axial direction of the crankshaft 10. There is a phase difference of a first included angle A between the two eccentric parts 11, referencing to FIG. 1 or FIG. 52. The crankshaft 10 and the cylinder sleeve 20 are eccentrically arranged and have a fixed eccentric distance therebetween. The crossed groove structure 30 is rotationally arranged in the cylinder sleeve 20. The crossed groove structure 30 has two limiting channels 31, and the two limiting channels 31 are sequentially arranged along the axial direction of the crankshaft 10. Extension directions of the two limiting channels 31 are perpendicular to the axial direction of the crankshaft 10, and there is a phase difference of a first included angle B between the extension directions of the two limiting channels 31, referring to FIG. 1 or FIG. 52. The first included angle A is twice of the second included angle B. The sliding blocks 40 are provided with through holes 41, and the number of the sliding blocks 40 is two. The two eccentric parts 11 correspondingly extend into the two through holes 41 of the two sliding blocks 40, and the two sliding blocks 40 are correspondingly arranged in the two limiting channels 31 in a sliding manner, so that a volume-variable cavity 311 is formed. Referring to FIG. 24, the volume-variable cavity 311 is located at a sliding direction of the sliding block 40. The crankshaft 10 is rotated, to drive the sliding blocks 40 to slide back and forth in the limiting channel 31 while interacting with the crossed groove structure 30, so that the crossed groove structure and the sliding block 40 is rotated in the cylinder sleeve 20.

Figure 6:
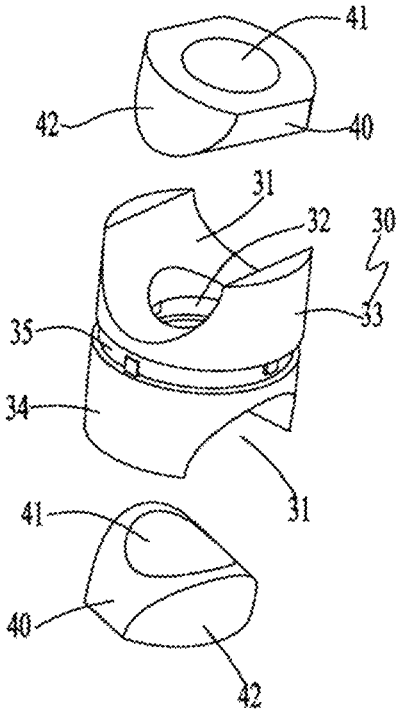
FIG. 6 shows a schematic structural diagram of a crossed groove structure and sliding blocks in FIG. 5 which are at an exploded state.

In some embodiments, the crossed groove structure 30 includes a first crossed groove section and a second crossed groove section which are connected along the axial direction thereof, referring to FIG. 6. The first crossed groove section 33 and the second crossed groove section 34 are arranged non-coaxially and are movably connected. The first crossed groove section 33 and the second crossed groove section 34 have the two limiting channel 31, respectively.

Figure 40:
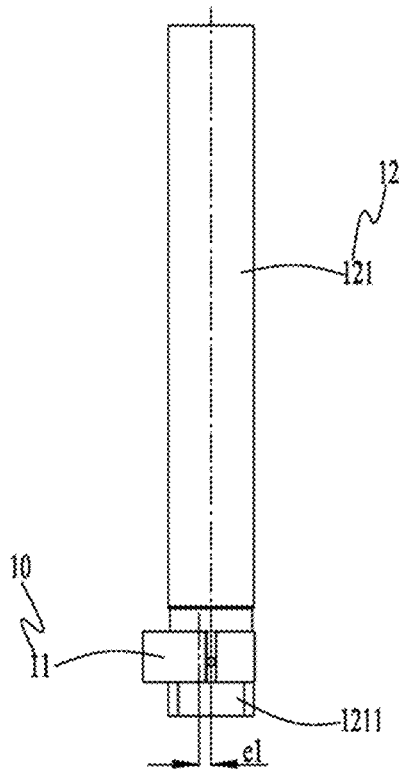
FIG. 40 shows a schematic structural diagram of a front view of the crankshaft in FIG. 39.
Figure 41:
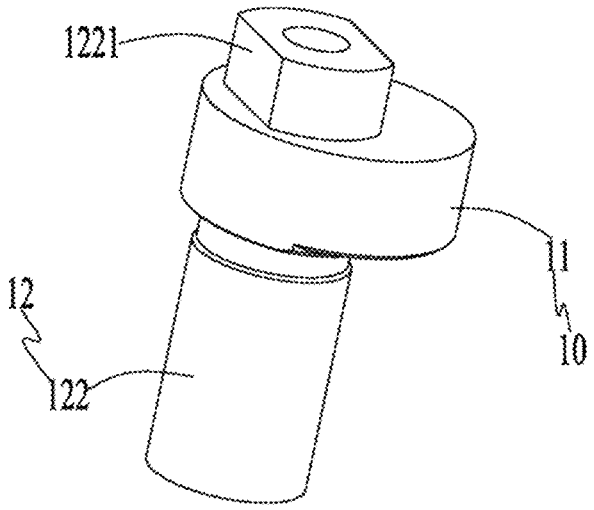
FIG. 41 shows a schematic structural diagram of a second section of the crankshaft in FIG. 38.
Figure 42:
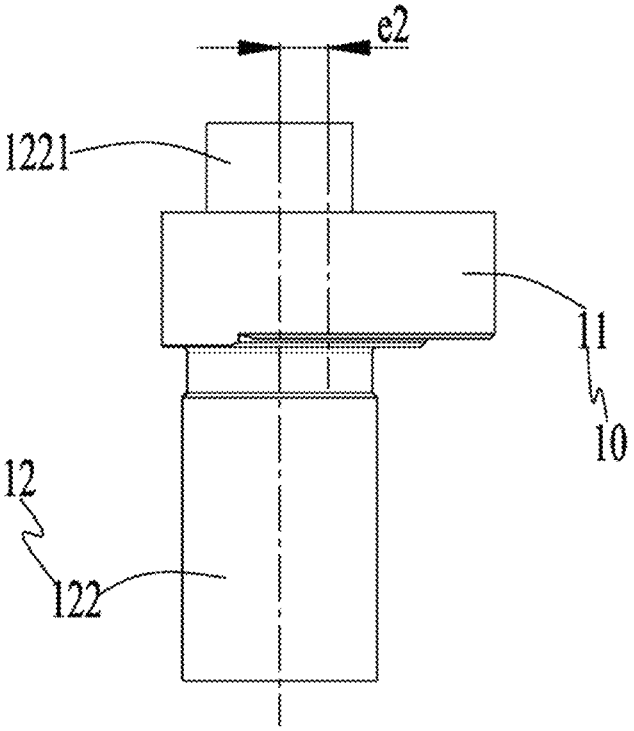
FIG. 42 shows a schematic structural diagram of a front view of the crankshaft in FIG. 41.

In some embodiments, eccentric amounts of the two eccentric parts 11 are unequal, referring to FIG. 40 and FIG. 42.

The crossed groove structure 30 is set in a structure having two limiting channels 31, and two sliding blocks 40 are correspondingly provided. The two eccentric parts 11 of the crankshaft 10 extend into the two through holes 41 of the two sliding blocks 40 correspondingly. The two sliding blocks 40 are correspondingly arranged in the two limiting channels 31 in a sliding manner, so that the volume-variable cavity 311 is formed. The first included angle A between the two eccentric parts 11 is twice of the second included angle B between the extension directions of two the limiting channels 31. In the case that one of the two sliding blocks 40 is at a dead point position, that is, driving torque, of the eccentric part 11 corresponding to the sliding block 40 at the dead point position, is zero, the sliding block 40 at the dead point position is unable to continue rotating. At this point, driving torque, of the sliding block 40 corresponding to the other of the eccentric parts 11, is the maximum value, ensuring that the eccentric part 11 with the maximum driving torque could normally drive the corresponding sliding block 40 to rotate, so that the crossed groove structure 30 is driven to rotate by the sliding block 40, and thus, the sliding block 40 at the dead point position is driven to continue to rotate by the crossed groove structure 30. Consequently, a stable operation of the fluid machinery is achieved, and the dead point position of the motion mechanism is avoided, so that operation reliability of the fluid machinery is improved, and thus, operation reliability of a heat exchange apparatus is ensured.

In addition, since the fluid machinery provided by the present disclosure may be stably operated, that is, it is ensured that higher energy efficiency and lower noise of the fluid machinery, such as a compressor and an expansion machine, the operational reliability of the heat exchange apparatus is ensured.

It should be noted that, in the present disclosure, neither the first included angle A nor the second included angle B is zero.

It should be noted that, in the present disclosure, during a rotating process of the crankshaft 10, the crankshaft 10 is rotated two circles, to implement four times of air suction and exhaust process.

To introduce the structure of the fluid machinery in details, five optional embodiments are shown in the followings, so that the operation method of the fluid machinery may be better described by structural features.

First Embodiment

This embodiment is described below with reference to FIGS. 1 to 51.

In this embodiment, the crossed groove structure 30 is rotationally arranged in the cylinder sleeve 20. The crossed groove structure 30 includes a first crossed groove section and a second crossed groove section which are connected along an axial direction thereof, referring to FIG. 6. The first crossed groove section 33 and the second crossed groove section 34 are arranged non-coaxially and are movably connected. The first crossed groove section 33 and the second crossed groove section 34 have the two limiting channel 31, respectively.

Figure 1:
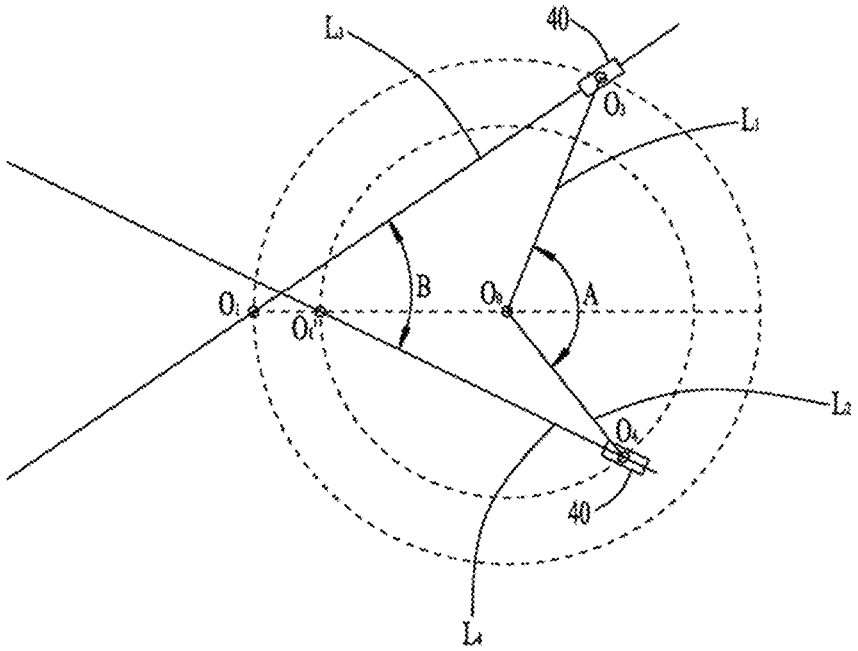
FIG. 1 shows a schematic diagram of a mechanism principle of an operation of a compressor according to a first embodiment of the present disclosure.
Figure 2:
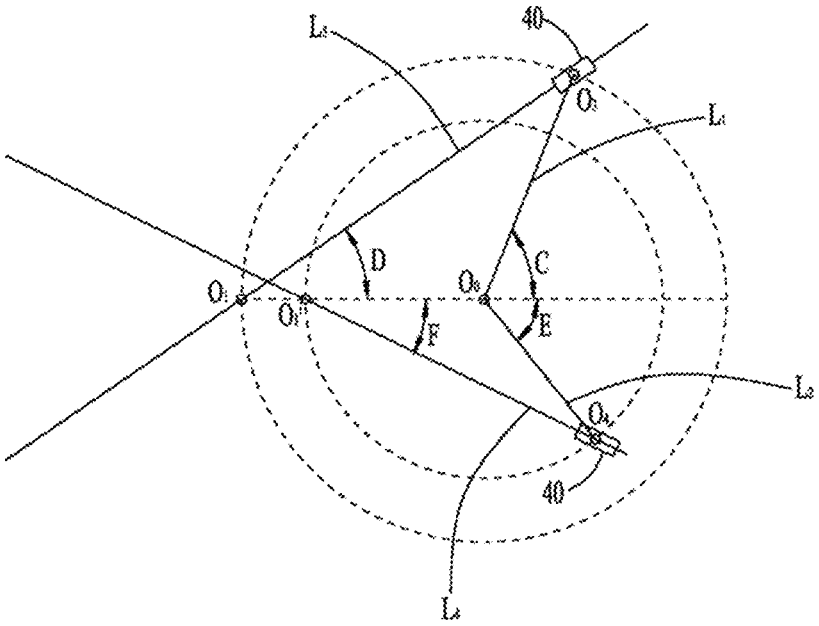
FIG. 2 shows a schematic diagram of the mechanism principle of the operation of the compressor operation in FIG. 1.

As shown in FIG. 1 and FIG. 2, under this condition, when the above-mentioned fluid machinery is operated, a crankshaft 10 performs rotation around an axis $O_0$ thereof; a first crossed groove section 33 performs revolution around the axis $O_0$ of the crankshaft 10, where the axis $O_0$ of the crankshaft 10 and an axis of the first crossed groove section 33 are eccentrically arranged and have a fixed eccentric distance therebetween. A second crossed groove section 34 performs revolution around the axis $O_0$ of the crankshaft 10. The axis $O_0$ of the crankshaft 10 and an axis $O_0'$ of the second crossed groove section 34 are eccentrically arranged and have a fixed eccentric distance therebetween. A first sliding block 40 takes the axis $O_0$ of the crankshaft 10 as a center of a circle and performs a circular motion. A distance, between a center $O_0$ of the first sliding block 40 and the axis $O_0$ of the crankshaft 10, is equal to an eccentric amount of the first eccentric part 11 corresponding to the crankshaft 10, and the eccentric amount is equal to the eccentric distance between the axis $O_0$ of the crankshaft 10 and the axis $O_1$ of the first crossed groove section 33. The crankshaft 10 is rotated, to drive the first sliding block 40 to perform the circular motion, and the first sliding block 40 interacts with the first crossed groove section 33 and slides back and forth in the limiting channel 31 of the first crossed groove section 33. A second sliding block 40 takes the axis $O_0$ of the crankshaft 10 as a center of a circle and performs a circular motion. A distance, between a center $O_4$ of the second sliding block 40 and the axis $O_0$ of the crankshaft 10, is equal to an eccentric amount of the second eccentric part 11 corresponding to the crankshaft 10, and the eccentric amount is equal to the eccentric distance between the axis $O_0$ of the crankshaft 10 and an axis $O_1'$ of the second crossed groove section 34. The crankshaft 10 is rotated, to drive the second sliding block 40 to perform the circular motion, and the second sliding block 40 interacts with the second crossed groove section 34 and slides back and forth in the limiting channel 31 of the second crossed groove section 34.

The fluid machinery operated by the operation method described above, constitutes a cross-shaped sliding block mechanism, and this operation method adopts a mechanism principle of a cross-shaped sliding block. The two eccentric portions 11 of the crankshaft 10 serve as a first connecting rod $L_1$ and a second connecting rod $L_2$ respectively, the limiting channel 31 of the first crossed groove section 33 serves as a third connecting rod $L_3$, and the limiting channel 31 of the second crossed groove section 34 serves as a fourth connecting rod $L_4$, where lengths of the first connecting rod $L_1$ and the second connecting rod $L_2$ are not equal.

As shown in FIG. 1, there is a first included angle A between the first connecting rod $L_1$ and the second connecting rod $L_2$, and there is a second included angle B between the third connecting rod $L_3$ and the fourth connecting rod $L_4$, where, the first included angle A is twice of the second included angle B.

As shown in FIG. 2, a connecting line, among the axis $O_0$ of the crankshaft 10, the axis $O_0$ of the first crossed groove section 33 and the axis $O_1'$ of the second crossed groove section 34, is $O_0O_1O_1'$. There is a third included angle C between the first connecting rod $L_1$ and the connecting line $O_0O_1O_1'$, and correspondingly, there is a fourth included angle D between the third connecting rod $L_3$ and the connecting line $O_0O_1O_1'$, where the third included angle C is twice of the fourth included angle D. There is a fifth included angle E between the second connecting rod $L_2$ and the connecting line $O_0O_1O_1'$, and correspondingly, there is a sixth included angle F between the fourth connecting rod $L_4$ and the connecting line $O_0O_1O_1'$, where the fifth included angle E is twice of the sixth included angle F. A sum of the third included angle C and the fifth included angle E is the first included angle A, and a sum of the fourth included angle D and the sixth included angle F is the second included angle B.

In some embodiments, the operation method further includes that an angular velocity of the rotation of the sliding block 40 is equal to an angular velocity of revolution of the sliding block; and angular velocities of the revolution of the first crossed groove section 33 and the second crossed groove section 34 are equal to the angular velocity of the rotation of the sliding block 40.

To be specific, the axis $O_0$, of the crankshaft 10 is equivalent to a rotation center of the first connecting rod $L_1$ and the second connecting rod $L_2$. The axis $O_1$, of the first crossed groove section 33 is equivalent to a rotation center of the third connecting rod $L_3$, and the axis $O_0'$ of the second crossed groove section 34 is equivalent to a rotation center of the fourth connecting rod $L_4$. The two eccentric parts 11 of the crankshaft 10 serve as the first connecting rod $L_1$ and second connecting rod $L_2$, respectively. The two limiting channels 31 of the crossed groove structure 30 serve as the third connecting rod $L_3$ and a fourth connecting rod $L_4$, respectively. The lengths of the first connecting rod $L_1$ and the second connecting rod $L_2$ are unequal. In this way, when the crankshaft 10 is rotated, the eccentric part 11 on the crankshaft 10 drives the corresponding sliding block 40 to perform revolution around the axis $O_0$ of the first crankshaft 10, at the same time, the sliding block 40 is able to performs rotation relative to the eccentric part 11, and rotation velocities of them are the same. The first sliding block 40 and the second sliding block 40 perform reciprocating motion in the two corresponding limiting channels 31, respectively, and drives the crossed groove structure 30 to perform a circular motion. Limited by the two limiting channels 31 of the crossed groove structure 30, moving directions of the two sliding blocks 40 always have a phase difference with the second included angle B. In the case that one of the two sliding blocks 40 is at the dead point position, the eccentric part 11 for driving the other of the two sliding blocks 40 has the maximum driving torque. The eccentric part 11 with the maximum driving torque could normally drive the corresponding sliding block 40 to rotate, so that the crossed groove structure 30 is driven to rotate by the sliding block 40, and thus, the sliding block 40 at the dead point position is driven to continue to rotate by the crossed groove structure 30. Consequently, a stable operation of the fluid machinery is achieved, and the dead-point position of the motion mechanism is avoided, so that operation reliability of the fluid machinery is improved, and thus, operation reliability of a heat exchange apparatus is ensured.

Under this operation method, running tracks of the sliding blocks 40 are both circles, where, one circle takes the axis $O_0$ of the crankshaft 10 as a center of the circle and the connecting line $O_0O_1$ as a radius, and the other circle takes the axis $O_0$ of the crankshaft 10 as a center of the circle and the line $O_0O_1'$ as a radius.

It should be noted that, in the present disclosure, during a rotating process of the crankshaft 10, the crankshaft 10 is rotated two circles, to implement four times of air suction and exhaust process.

To introduce the structure of the fluid machinery in details, an optional embodiment is shown in the following, so that the operation method of the fluid machinery may be better described by structural features.

It should be noted that, in the present disclosure, a distance, between an inner ring axis of the cylinder sleeve 20 located at the first crossed groove section 33 and an inner ring axis of the cylinder sleeve 20 located at the second crossed groove section 34, is equal to an eccentric distance between the first crossed groove section 33 and the second crossed groove section 34. In this way, it is ensured that the normal operation of the motion mechanism constructed in FIG. 1 may be implemented.

As shown in FIGS. 4 to 10, the crossed groove structure 30 further includes a first sliding connection member 35. The first crossed groove section 33 is movably connected to the second crossed groove section 34 via the first sliding connection member 35. The first crossed groove section 33 is rotated while the first sliding connection member 35 slides relative to the first crossed groove section 33, and the second crossed groove section 34 is rotated while the first sliding connection member 35 slides relative to the second crossed groove section 34. In this way, connection reliability between the first crossed groove section 33 and the second crossed groove section 34 is ensured, and rotation reliability therebetween is also ensured meanwhile.

Figure 7:
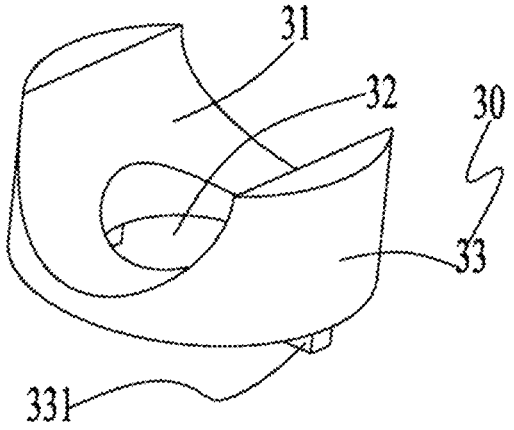
FIG. 7 shows a schematic structural diagram of a first crossed groove section of the crossed groove structure in FIG. 6.
Figure 8:
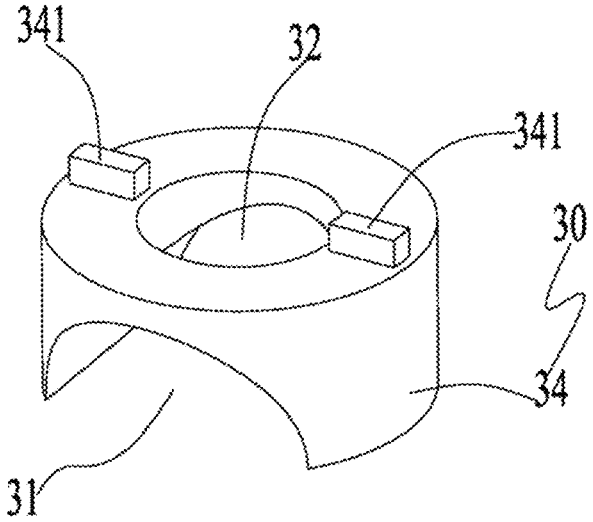
FIG. 8 shows a schematic structural diagram of a second crossed groove section of the crossed groove structure in FIG. 6.
Figure 9:
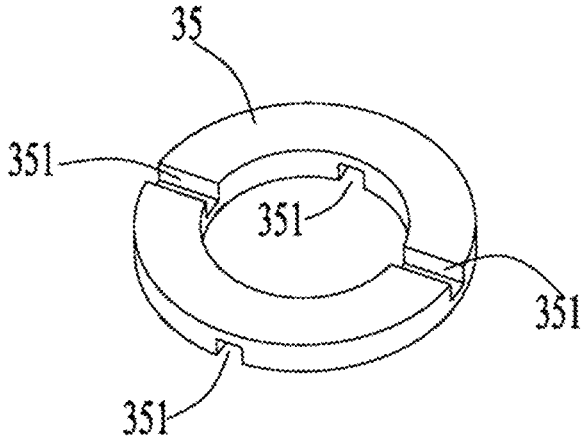
FIG. 9 shows a schematic structural diagram of a first sliding connection member of the crossed groove structure in FIG. 6.

As shown in FIGS. 7 to 9, the first sliding connection member 35 has two first limiting sliding slots 351, and extension directions of the two first limiting sliding slots 351 are perpendicular to each other and are both perpendicular to the axial direction of the crankshaft 10. The first crossed groove section 33 has a third protrusion structure 331 at an end part of a side towards the first sliding connection member 35, and the second crossed groove section 34 has a fourth protrusion structure 341 at an end part of a side towards the first sliding connection member 35. The third protrusion structure 331 and the fourth protrusion structure 341 are respectively arranged in the two first limiting sliding slots 351 in a sliding manner. The first crossed groove section 33 is rotated, to make the third protrusion structure 331 slide back and forth in the corresponding first sliding connection member 35 and interact with the first sliding connection member 35 simultaneously, so that the first sliding connection member 35 is rotated, and drives the fourth protrusion structure 341 to slide back and forth in the corresponding first sliding connection member 35 while driving the second crossed groove section 34 to rotate. Or, the second crossed groove section 34 is rotated, to make the fourth protrusion structure 341 slide back and forth in the corresponding first sliding connection member 35 and interact with the first sliding connection member 35 simultaneously, so that the first sliding connection member 35 is rotated, and drives the third protrusion structure 331 to slide back and forth in the corresponding first limiting sliding slot 351 while driving the first crossed groove section 33 to rotate. In this way, connection reliability between the first crossed groove section 33 and the second crossed groove section 34 is ensured, and rotation reliability therebetween is ensured meanwhile.

It should be noted that, in an embodiment of the present disclosure not shown in the drawings, the first sliding connection member 35 has two first limiting protrusions extending towards the first crossed groove section 33 and the second crossed groove section 34, respectively. The first crossed groove section 33 has a third sliding slot structure at an end part of a side towards the first sliding connection member 35, and the second crossed groove section 34 has a fourth sliding slot structure at an end part of a side towards the first sliding connection member 35. The two first limiting protrusions are respectively arranged in the third sliding slot structure and the fourth sliding slot structure slidably, and an extension direction of the third sliding slot structure is perpendicular to an extension direction of the fourth sliding slot structure. The first crossed groove section 33 is rotated, to make the first limiting protrusion slide back and forth in the third sliding slot structure and the third sliding slot structure interact with the first sliding connection member 35 simultaneously, so that the first sliding connection member 35 is rotated, and drives the first limiting protrusion to slide back and forth in the fourth sliding slot structure while driving the second crossed groove section 34 to rotate. Or, the second crossed groove section 34 is rotated, to make the first limiting protrusion slide back and forth in the fourth sliding slot structure and the fourth sliding slot structure interact with the first sliding connection member 35 simultaneously, so that the first sliding connection member 35 is rotated, and drives the first limiting protrusion to slide back and forth in the third sliding slot structure while driving the first crossed groove section 33 to rotate. In this way, connection reliability between the first crossed groove section 33 and the second crossed groove section 34 is ensured, and rotation reliability therebetween is ensured meanwhile.

Figure 10:
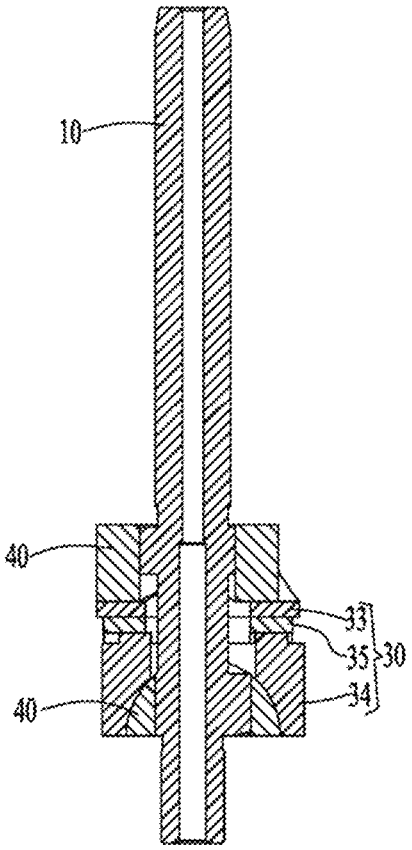
FIG. 10 shows a schematic structural diagram of a crankshaft, a crossed groove structure and sliding blocks in FIG. 4.
Figure 12:
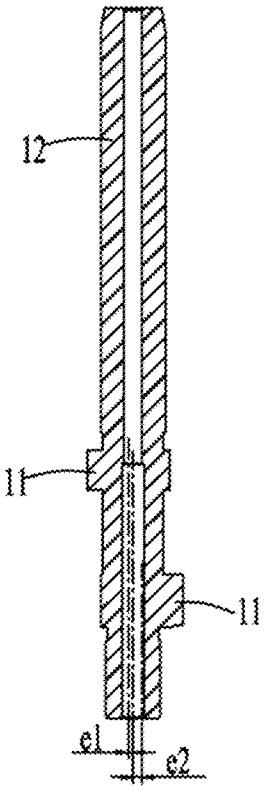
FIG. 12 shows a schematic sectional view of the crankshaft in FIG. 11.

As shown in FIGS. 10 to 12, a shaft body portion 12 of the crankshaft 10 is integrally formed and has only one axis. In this way, it is convenient for one-step forming of the shaft body portion 12, thus difficulty of processing and manufacturing of the shaft body portion 12 is reduced.

It should be noted that, in an embodiment of the present disclosure not shown in the drawings, a shaft body portion 12 of the crankshaft 10 includes a first section 121 and a second section 122 which are connected along the axial direction thereof. The first section 121 and the second section 122 are coaxially arranged, and the two eccentric portions 11 are respectively arranged at the first section 121 and the second section 122.

In some embodiments, the first section 121 is detachably connected to the second section 122. In this way, convenience about assembly and disassembly of the crankshaft 10 is ensured.

Figure 14:
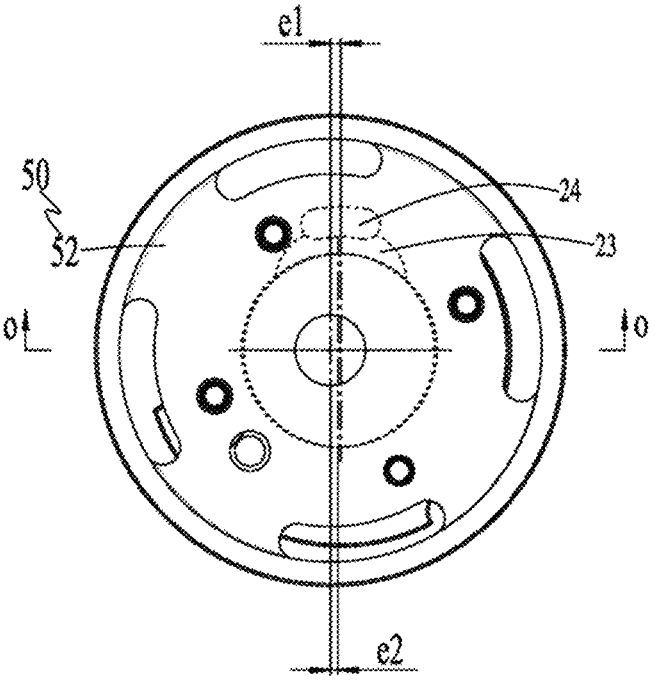
FIG. 14 shows a schematic structural diagram of eccentric amounts respectively between a first section and a second section of a crankshaft and a cylinder sleeve in FIG. 5.

As shown in FIG. 12 and FIG. 14, eccentric amounts of the two eccentric parts 11 are unequal, where, the eccentric amount of the first eccentric part 11 is equal to an assembly eccentric amount between the crankshaft 10 and the corresponding first crossed groove section 33; and the eccentric amount of the second eccentric part 11 is equal to an assembly eccentric amount between the crankshaft 10 and the corresponding second crossed groove section 34. In this way, it is ensured that normal operation of the motion mechanism constructed in FIG. 1 may be implemented.

As shown in FIGS. 10 to 12, a shaft body portion 12 of the crankshaft 10 is integrally formed with the eccentric portion 11. In this way, it is convenient for one-step forming of the shaft body portion 12, and thus processing and manufacturing difficulty of the crankshaft 10 is reduced.

It should be noted that, in an embodiment of the present disclosure not shown in the drawings, a shaft body portion 12 of the crankshaft 10 is detachably connected to the eccentric portion 11. In this way, it is convenient to assemble and disassemble the eccentric portion 11.

As shown in FIGS. 5 to 8, two ends of one of the two limiting channels 31 penetrates through a peripheral surface of the first crossed groove section 33, and two ends of the other of the two limiting channels 31 penetrates through a peripheral surface of the second crossed groove section 34. In this way, it is beneficial to reduce difficulty about processing and manufacturing of the crossed groove structure 30.

In some embodiments, the two sliding blocks 40 are concentrically arranged with the two eccentric parts 11, respectively. The sliding blocks 40 performs a circular motion around the axis of the crankshaft 10 where the sliding blocks 40 is located, and there is a first rotating gap between a hole wall of the through hole 41 and the eccentric part 11, where the first rotating gap ranges from 0.005 mm to 0.05 mm.

In some embodiments, there is a second rotating gap between a peripheral surface of the first crossed groove section 33 and an inner wall surface of an end of the axial direction of the cylinder sleeve 20, and the second rotating gap ranges from 0.01 mm to 0.08 mm. There is a third rotating gap between a peripheral surface of the second crossed groove section 34 and an inner wall surface of the other end of the axial direction of the cylinder sleeve 20, and the third rotating gap ranges from 0.01 mm to 0.08 mm.

It should be noted that, in the present disclosure, the first included angle A ranges from 160 degrees to 200 degrees, and the second included angle B ranges from 80 degrees to 100 degrees, as long as a relationship that the first included angle A is twice of the second included angle B is met.

In some embodiments, the first included angle A is 160 degrees, and the second included angle B is 80 degrees.

In some embodiments, the first included angle A is 165 degrees, and the second included angle B is 82.5 degrees.

In some embodiments, the first included angle A is 170 degrees, and the second included angle B is 85 degrees.

In some embodiments, the first included angle A is 175 degrees, and the second included angle B is 87.5 degrees.

In some embodiments, the first included angle A is 180 degrees, and the second included angle B is 90 degrees.

In some embodiments, the first included angle A is 185 degrees, and the second included angle B is 92.5 degrees.

In some embodiments, the first included angle A is 190 degrees, and the second included angle B is 95 degrees.

In some embodiments, the first included angle A is 195 degrees, and the second included angle B is 97.5 degrees.

As shown in FIGS. 3 to 28, the fluid machinery further includes a flange 50 arranged at an end of the axial direction of the cylinder sleeve 20. The crankshaft 10 is concentrically arranged with the flange 50. The crossed groove structure 30 and the cylinder sleeve 20 are arranged coaxially. An assembly eccentric amount between the crankshaft 10 and the crossed groove structure 30 is determined by a relative position relation between the flange 50 and the cylinder sleeve 20. The flange 50 is fixed on the cylinder sleeve 20 by a fastener 90. A relative position, between an axis of the flange 50 and an axis of an inner ring of the cylinder sleeve 20, is controlled by adjusting a center of the flange 50. The relative position, between the axis of the flange 50 and the axis of the inner ring of the cylinder sleeve 20, determines the relative position between the axis of the crankshaft 10 and the axis of the crossed groove structure 30. The essence of adjusting the center of the flange 50 is to make the eccentric amount of the eccentric part 11 equal to the assembly eccentric amount between the crankshaft 10 and the cylinder sleeve 20.

Figure 15:
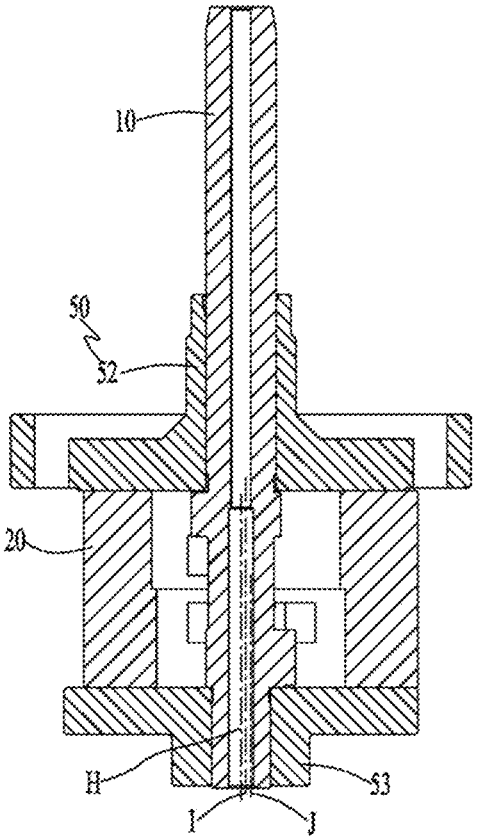
FIG. 15 shows a schematic sectional view of O-O view angle in FIG. 14.

To be specific, as shown in FIG. 12, the eccentric amount of the first eccentric part is equal to $e_1$, and the eccentric amount of the second eccentric part is equal to $e_2$. As shown in FIG. 14 and FIG. 15, an assembly eccentric amount between the first section of the crankshaft 10 and the cylinder sleeve 20 is equal to $e_1$, and an assembly eccentric amount between the second section of the crankshaft 10 and the cylinder sleeve 20 is equal to $e_2$ (since the crossed groove structure 30 and the cylinder sleeve 20 are coaxially arranged, the assembly eccentric amount between the crankshaft 10 and the crossed groove structure 30 is equal to the assembly eccentric amount between the crankshaft 10 and the cylinder sleeve 20). In FIG. 15, a label H represents the axis of the shaft body part 12 of the crankshaft 10, a label I represents an axis of an upper half portion of the inner ring of the cylinder sleeve 20, and a label J represents an axis of a lower half portion of the inner ring of the cylinder sleeve 20. The flange 50 includes an upper flange 52 and a lower flange 53, as shown in FIG. 11, and a distance between an axis of an inner ring of the cylinder sleeve 20 and an axis of an inner ring of the lower flange 53 is e, that is, it equal to the eccentric amount of the eccentric part 11.

In some embodiments, there is a first assemble gap between the crankshaft 10 and the flange 50, and the first assemble gap ranges from 0.005 mm to 0.05 mm.

In some embodiments, the first assemble gap ranges from 0.01 mm to 0.03 mm.

It should be noted that, in the present application, the eccentric part 11 has an arc surface, and a central angle of the arc surface is larger than or equal to 180 degrees. In this way, it is ensured that the arc surface of the eccentric part 11 may apply an effective driving on the sliding block 40, and thereby motion reliability of the sliding block 40 is ensured.

As shown in FIGS. 10 to 12, the eccentric part 11 is cylindrical.

In some embodiments, a proximal end of the eccentric part 11 is flush with an outer circle of a shaft body part 12 of the crankshaft 10.

In some embodiments, a proximal end of the eccentric part 11 is protruded from an outer circle of a shaft body part 12 of the crankshaft 10.

In some embodiments, a proximal end of the eccentric part 11 is provided at an inner side of an outer circle of a shaft body part 12 of the crankshaft 10.

It should be noted that, in an embodiment of the present disclosure not shown in the drawings, the sliding block 40 includes a plurality of sub-sliding blocks which are spliced to form the through hole 41.

As shown in FIGS. 10 to 12, the two eccentric parts 11 are arranged at intervals in the axial direction of the crankshaft 10. In this way, during a process of assembling the crankshaft 10, the cylinder sleeve 20 and the two sliding blocks, it is ensured that a space distance between the two eccentric parts may provide an assembling space for the cylinder sleeve 20, so that convenience about assembly is ensured.

As shown in FIG. 7 and FIG. 8, the first crossed groove section 33 and the second crossed groove section 34 both have a central hole 32, the two central holes 32 are non-concentrically arranged, and the two limiting channels 31 communicate with each other via the two central holes 32. Apertures of the central holes 32 are both larger than a diameter of a shaft body portion 12 of the crankshaft 10. In this way, it is ensured that the crankshaft 10 may smoothly pass through the central hole 32.

In some embodiments, the aperture of the central hole 32 is larger than a diameter of the eccentric part 11. In this way, it is ensured that the eccentric part 11 of the crankshaft 10 may pass through smoothly.

Figure 16:
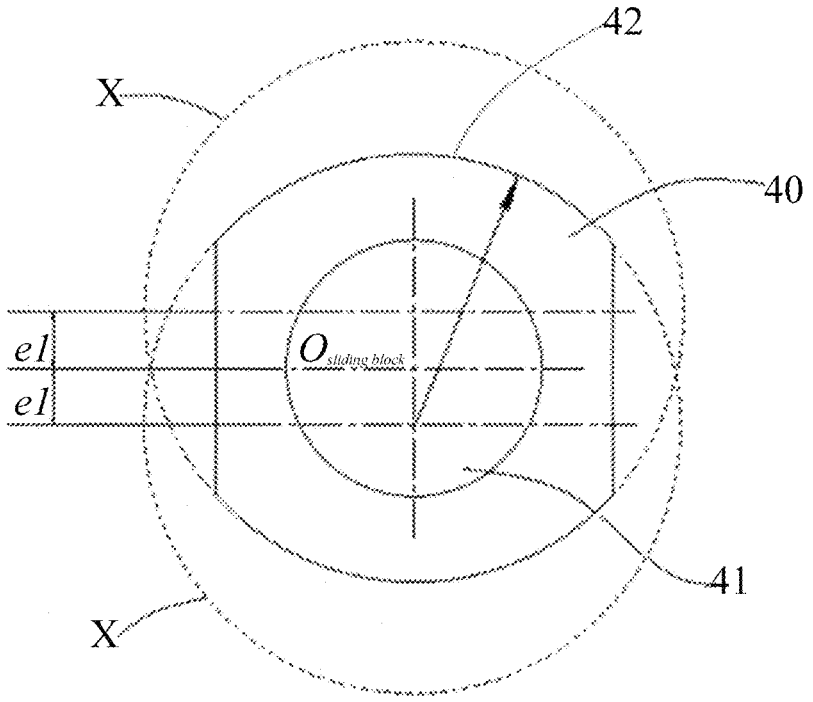
FIG. 16 shows a schematic structural diagram of a first sliding block in FIG. 5 in an axial direction of a through hole thereof.
Figure 17:
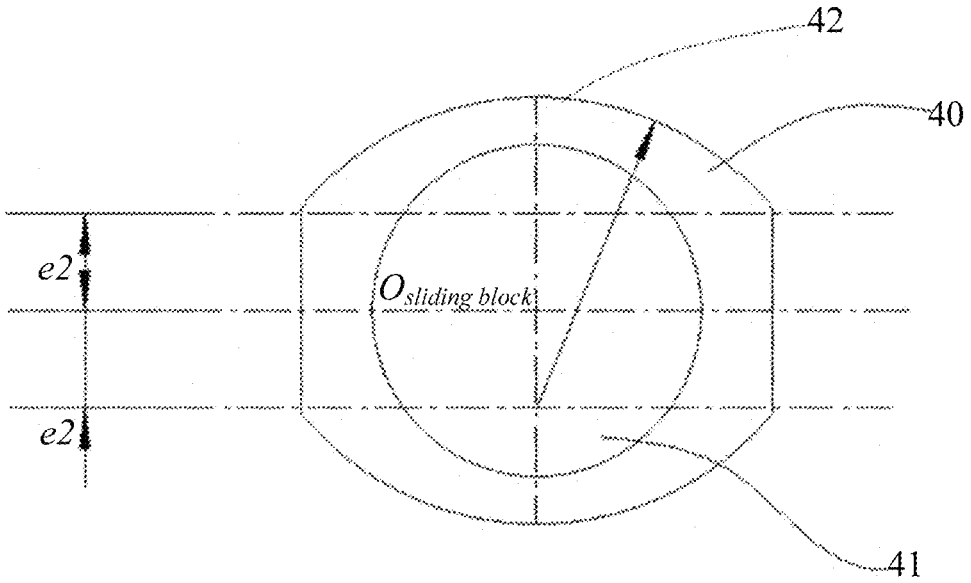
FIG. 17 shows a schematic structural diagram of a second sliding block in FIG. 5 in an axial direction of a through hole thereof.

As shown in FIG. 16 and FIG. 17, a projection of the sliding block 40 in the axial direction of the through hole 41 has two relatively parallel straight-line segments and arc segments connecting ends of the two straight line segments. The limiting channel 31 has a set of first sliding surfaces arranged opposite to each other and in sliding contact with the sliding block 40. The sliding block 40 has a second sliding surface matched with the first sliding surface and a pressing surface 42 towards ends of the limiting channel 31. The pressing surface 42 serves as a head of the sliding block 40, the two second sliding surfaces are connected via the pressing surface 42, and the pressing surface 42 faces to the volume-variable cavity 311. In this way, a projection of the second sliding surface of the sliding block 40 on the axial direction of the through hole 41 thereof is a straight-line segment, and a projection of the pressing surface 42 of the sliding block 40 on the axial direction of the through hole 41 thereof is an arc segment.

To be specific, the pressing surface 42 is an arc surface, and a distance, between an arc center of the arc surface and a center of the through hole 41, is equal to the eccentric amount of the eccentric part 11. As shown in FIG. 16 and FIG. 17, a center of the through hole 41 of the crankshaft 10 is $O_{sliding\ block}$, and distances, between the arc centers of the two arc surfaces and centers of each of the corresponding through hole 41, are $e_1$ and $e_2$, respectively. That is, they correspond to the eccentric amount $e_1$ of the eccentric part 11 on the first section 121 and the eccentric amount $e_2$ of the eccentric part 11 on the second section 122 of the crankshaft 10, respectively. Dotted lines X in FIG. 16 represent circles on which the arc centers of the arc surfaces are located.

In some embodiments, a curvature radius of the arc surface is equal to a radius of an inner circle of the cylinder sleeve 20.

In some embodiments, there is a difference value between a curvature radius of the arc surface and a radius of an inner circle of the cylinder sleeve 20, and the difference value ranges from −0.05 mm to 0.025 mm.

In some embodiments, the difference value ranges from −0.02 mm to 0.02 mm.

In some embodiments, a ratio, between a projection area $S_{sliding\ block}$, of the pressing surface 42 in the sliding direction, of the sliding block 40 and, an area $S_{exhaus}$ of a compression exhaust port of the cylinder sleeve 20, is $S_{sliding\ block}/S_{exhaust}$, which ranges from 8 to 25.

In some embodiments, the ratio $S_{sliding\ block}/S_{exhaust}$ ranges from 12 to 18.

Figure 3:
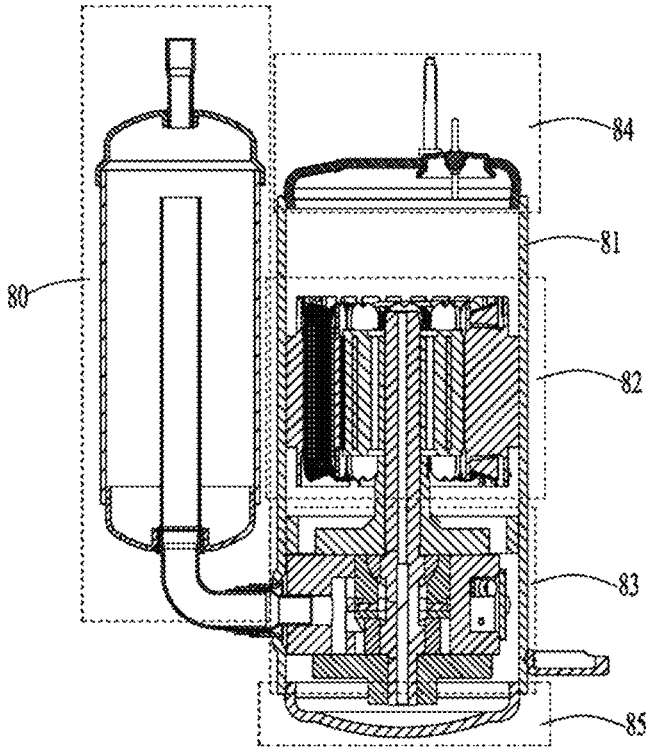
FIG. 3 shows a schematic diagram of an internal structure of a compressor according to some embodiments of the present disclosure.
Figure 4:
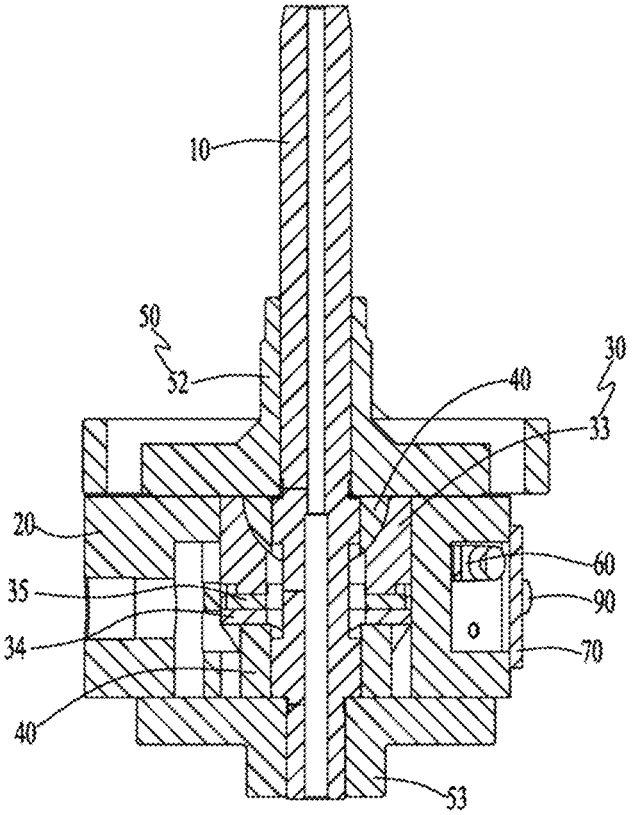
FIG. 4 shows a schematic structural diagram of a pump body assembly of the compressor in FIG. 3.

It should be noted that, the fluid machinery shown in the present disclosure is a compressor. As shown in FIG. 3, the compressor includes a liquid separator component 80, a housing assembly 81, a motor assembly 82, a pump body assembly 83, an upper cover assembly 84 and a lower cover assembly 85. The liquid separator component 80 is disposed outside the housing assembly 81, the upper cover assembly 84 is assembled at an upper end of the housing assembly 81, the lower cover assembly 85 is assembled at a lower end of the housing assembly 81, and the motor assembly 82 and the pump body assembly 83 are both located in the housing assembly 81. The motor assembly 82 is located above or below the pump body assembly 83. The pump body assembly 83 of the compressor includes the crankshaft 10, the cylinder sleeve 20, the crossed groove structure 30, the sliding block 40, the upper flange 52 and the lower flange 53 above-mentioned.

In some embodiments, the above-mentioned components are all connected by means of welding, hot sleeve or cold pressing.

An assembly process of the entire pump body assembly 83 is as follows: the lower flange 53 is fixed on the cylinder sleeve 20; one of the sliding blocks 40 is disposed in the corresponding limiting channel 31 of the second crossed groove section 34, and then the two are disposed in the cylinder sleeve 20; the first sliding connector 35 is disposed into the cylinder liner 20 and assembled with the second cross groove section 34, then the other of the sliding blocks 40 is disposed in the corresponding limiting channel 31 of the first crossed groove section 33, and then the two are disposed in the cylinder sleeve 20, and are assembled with the first sliding connection member 35; the two eccentric parts 11 of the crankshaft 10 extends into the two through holes 41 of the two corresponding sliding blocks 40, respectively; then the assembled crankshaft 10, the crossed groove structure 30 and the two sliding blocks 40 are disposed in the cylinder sleeve 20. One end of the crankshaft 10 is mounted on the lower flange 53, and the other end of the crankshaft 10 penetrates through the upper flange 52. For details, referring to FIG. 4 and FIG. 5.

It should be noted that, in the present embodiment, an enclosed space, surrounded by the sliding block 40, the limiting channel 31, the cylinder sleeve 20 and the upper flange 52 (or the lower flange 53), is the volume-variable cavity 311. The pump body assembly 83 has four volume-variable cavities. In the process of the crankshaft 10 being rotated, the crankshaft 10 is rotated two circles, and a single volume-variable cavity 311 completes one time of an air suction and exhaust process. For the compressor, the crankshaft 10 is rotated two circles, to implement four times of air suction and exhaust process.

Figure 23:
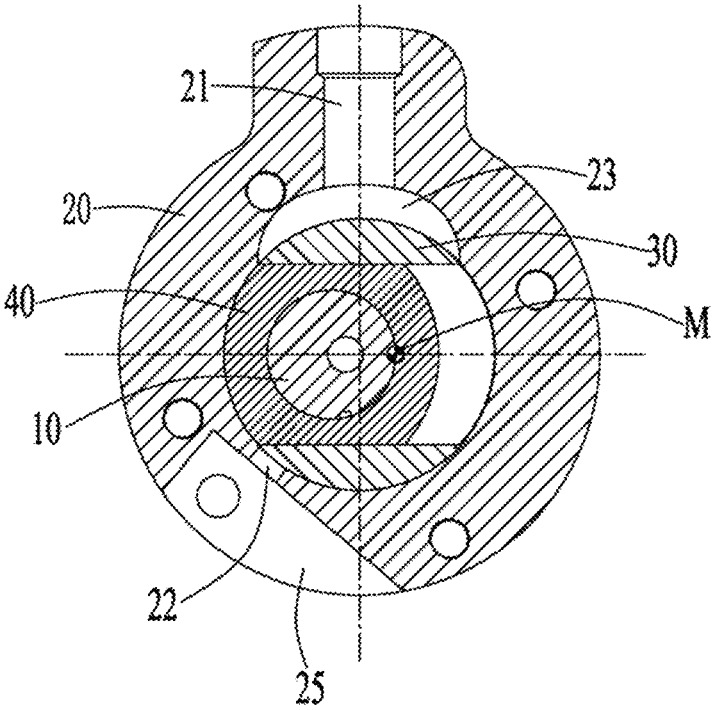
FIG. 23 shows a schematic diagram of a state structure of the compressor in FIG. 3 which at a point that an air-suction process is started.
Figure 25:
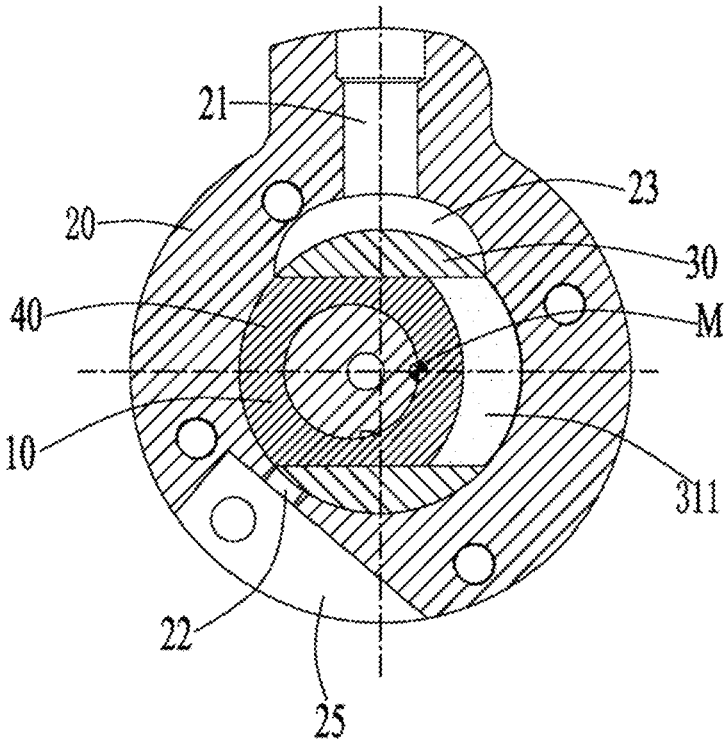
FIG. 25 shows a schematic diagram of a state structure of the compressor in FIG. 3 which at a point that an air-suction process is finished.
Figure 26:
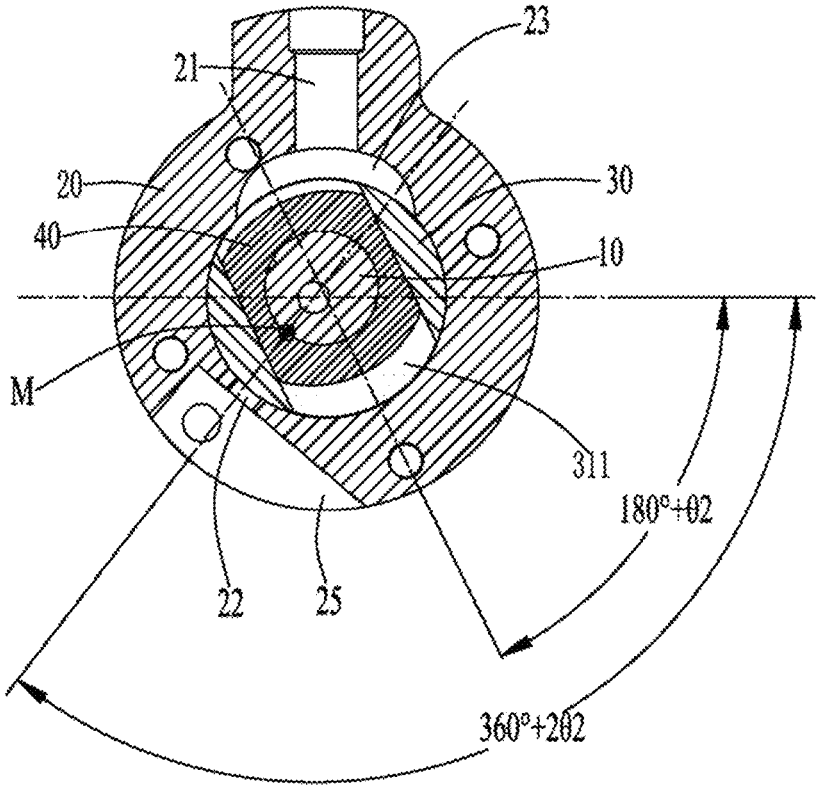
FIG. 26 shows a schematic diagram about a state structure of the compressor in FIG. 3 when the compressor is compressing gas.
Figure 27:
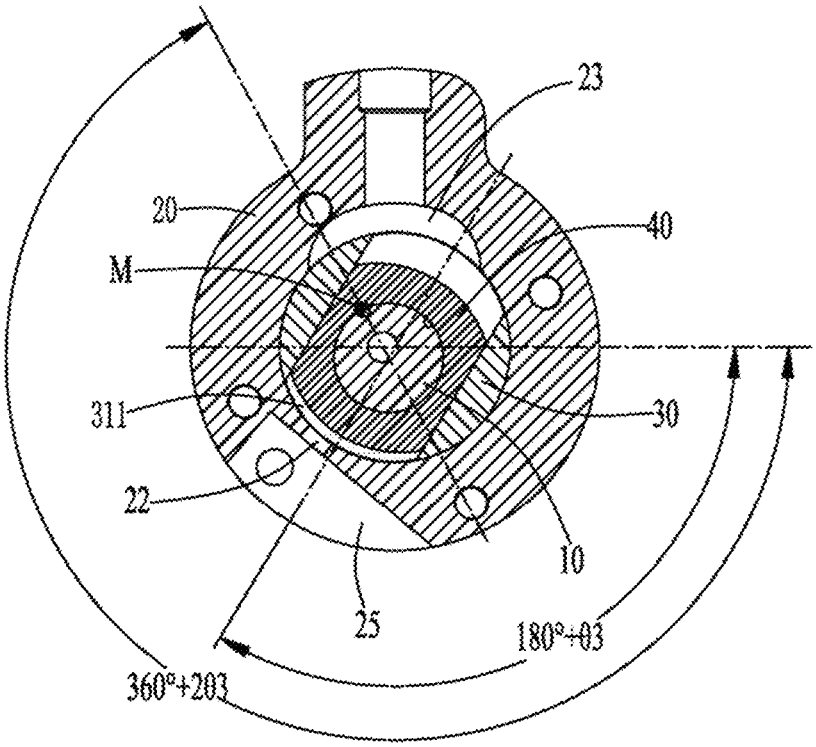
FIG. 27 shows a schematic diagram of a state structure of the compressor in FIG. 3 which in an exhaust process.
Figure 28:
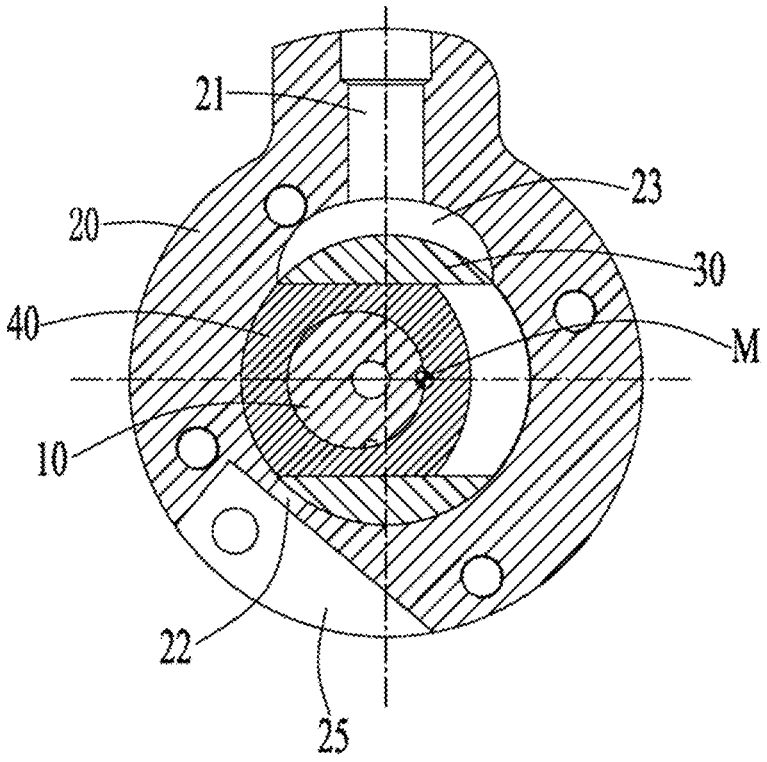
FIG. 28 shows a schematic diagram of a state structure of the compressor in FIG. 3 which at a point that an exhaust process is finished.

As shown in FIGS. 23 to 28, during the sliding block 40 reciprocating in the limiting channel 31, the sliding block 40 is also rotated relative to the cylinder sleeve 20. In FIGS. 23 to 25, the volume-variable cavity 311 is enlarged as the sliding block 40 is clockwise rotated from 0 degree to 180 degrees. During a process that the volume-variable cavity 311 is enlarged, the volume-variable cavity 311 communicates with the air-suction cavity 23 of the cylinder sleeve 20. When the sliding block 40 is rotated to 180 degrees, volume of the volume-variable cavity 311 reaches a maximum value. At this point, the volume-variable cavity 311 is detached from the air suction cavity 23, and thereby the air suction and exhaust operations are completed. In FIGS. 26 to 28, during the process that the sliding block 40 continues to rotate in the clockwise direction from 180 degrees to 360 degrees, the volume-variable cavity 311 is decreased, and gas in the volume-variable cavity 311 is compressed by the sliding block 40. When the sliding block 40 is rotated until the volume-variable cavity 311 communicates with the compression exhaust port 22, and a pressure of the gas in the volume-variable cavity 311 reaches an exhaust pressure, referring to FIG. 50, an exhaust valve sheet 61 of an exhaust valve assembly 60 is opened to start the exhaust operation, until the compression process is finished, and then it enters a next cycle. The valve plate baffle 62 of the exhaust valve assembly 60 plays a role of shielding the exhaust valve sheet 61, and thereby a large deformation of the valve plate baffle 62 is avoided.

As shown in FIGS. 23 to 28, a point labeled by M serves as a reference point for relative movement of the sliding block 40 and the crankshaft 10. FIG. 24 shows a process that the sliding block 40 is rotated clockwise from 0 degrees to 180 degrees. A rotation angle of the sliding block 40 is $\theta_1$, and correspondingly, a rotation angle of the crankshaft 10 is $2\theta_1$. FIG. 26 shows a process that the sliding block 40 continues to rotate from 180 degrees to 360 degrees along a clockwise direction. The rotation angle of the sliding block 40 is $180°+\theta_2$, and correspondingly, the rotation angle of the crankshaft 10 is $180°+2\theta_2$. FIG. 27 shows a process that the sliding block 40 continues to rotate from 180 degrees to 360 degrees along the clockwise direction, and the volume-variable cavity 311 communicates with the compression exhaust port 22. The rotation angle of the sliding block 40 is $180°+\theta_3$, and correspondingly, the rotation angle of the crankshaft 10 is $360°+2\theta_2$, that is, the sliding block 40 rotates one circle, and correspondingly the crankshaft 10 rotates two circles, where $\theta_1<\theta_2<\theta_3$.

To be specific, and as shown in FIG. 13 and FIGS. 18 to 26, the cylinder sleeve 20 has a compression intake port 21 and a compression exhaust port 22. In the case that any of the sliding blocks 40 is at an intake position, the compression intake port 21 communicates with the corresponding volume-variable cavity 311. In the case that any of the sliding block 40 is at an exhaust position, the corresponding volume-variable cavity 311 communicates with the compression exhaust port 22.

As shown in FIG. 13 and FIGS. 18 to 26, an inner wall surface of the cylinder sleeve 20 has an air-suction cavity 23, and the air-suction cavity 23 communicates with the compression intake port 21. In this way, it is ensured that the air-suction cavity 23 may store a large amount of gas, so that the gas may be fully sucked into the volume-variable cavity 311, and thus, a sufficient amount of the gas may be sucked into the compressor. When the air suction amount is insufficient, the stored gas may be supplied to the volume-variable cavity 311 in time, and thus compression efficiency of the compressor is ensured.

In some embodiments, the air suction cavity 23 is formed by hollowing out the inner wall surface of the cylinder sleeve 20 along a radial direction. There may be one air-suction cavity 23, or there may be two air-suction cavities disposed at an upper portion and a lower portion of the inner wall surface of the cylinder sleeve 20, respectively.

To be specific, the air suction cavity 23 extends a first preset distance around a circumference of the inner wall surface of the cylinder sleeve 20, to form an arc-shaped air suction cavity 23. In this way, it is ensured that volume of the air-suction cavity 23 is large enough, to store a large amount of gas.

As shown in FIG. 13 and FIGS. 20 to 22, there are two air-suction cavities 23, and the two air-suction cavities 23 are arranged at intervals along the axial direction of the cylinder sleeve 20. The cylinder sleeve 20 further has an air-suction communicating cavity 24. The two air-suction cavities 23 both communicate with the air-suction communicating cavity 24, and the compression intake port 21 communicates with the air-suction cavity 23 via the air-suction communicating cavity 24. In this way, it is beneficial to increase volume of the air-suction cavity 23, and thus fluctuation of a suction pressure is reduced.

Figure 18:
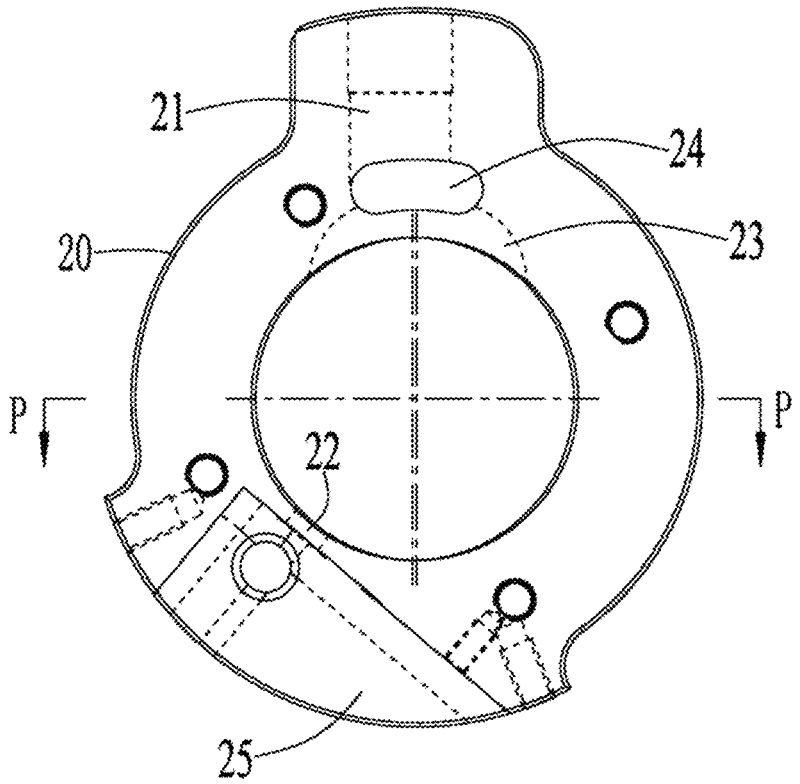
FIG. 18 shows a schematic structural diagram of a first view angle of the cylinder sleeve in FIG. 13.
Figure 21:
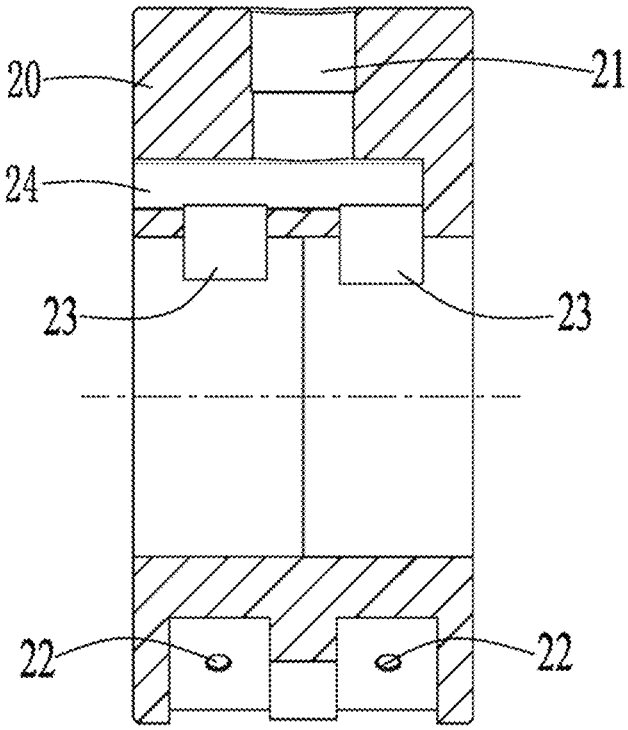
FIG. 21 shows a schematic sectional view of a second view angle of the cylinder sleeve in FIG. 18.

As shown in FIG. 18 and FIG. 21, the air-suction communicating cavity 24 extends a second preset distance along the axial direction of the cylinder sleeve 20. At least one end of the air-suction communicating cavity 24 penetrates through an axial end surface of the cylinder sleeve 20. In this way, the air-suction communicating cavity 24 is conveniently formed at an end surface of the cylinder sleeve 20, and thereby processing convenience of the air-suction communicating cavity 24 is ensured.

As shown in FIG. 13, FIGS. 20 to 22 and FIG. 50, an outer wall of the cylinder sleeve 20 is provided with an exhaust cavity 25. The compression exhaust port 22 communicates with the exhaust cavity 25 via the inner wall of the cylinder sleeve 20. The fluid machinery further includes an exhaust valve assembly 60 arranged in the exhaust cavity 25 and corresponding to the compression exhaust port 22. In this way, the exhaust cavity 25 is applied to accommodate the exhaust valve assembly 60, and thereby an occupied space of the exhaust valve assembly 60 is effectively reduced, enabling the components to be reasonably arranged, and thus, a space utilization rate of the cylinder sleeve 20 is improved.

Figure 19:
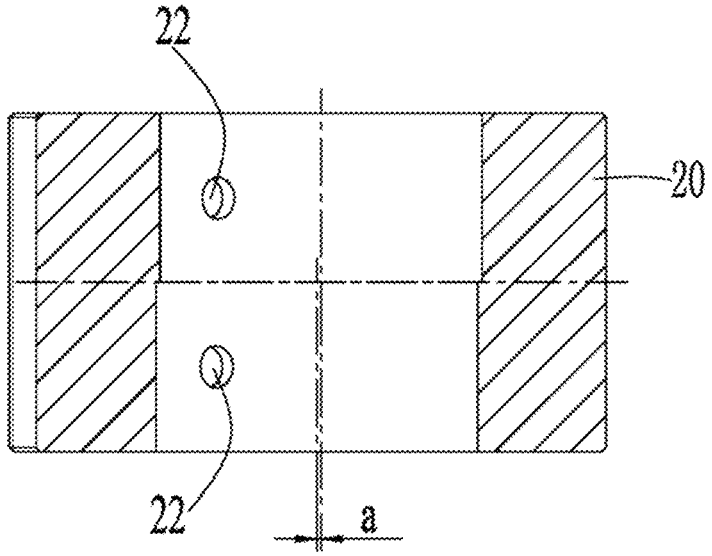
FIG. 19 shows a schematic sectional view of a P-P view angle in FIG. 18.
Figure 20:
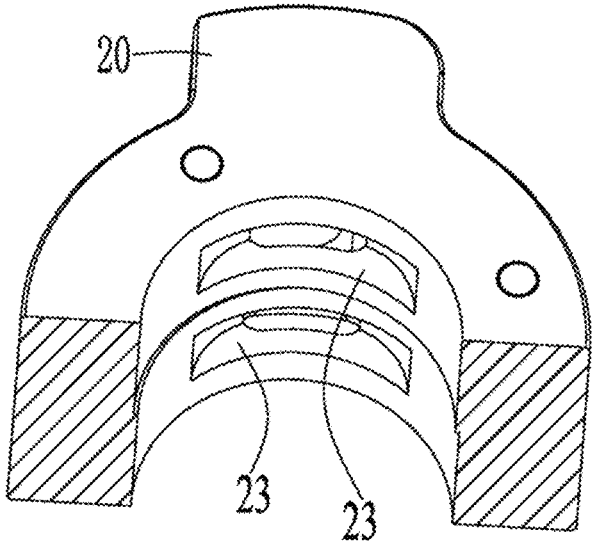
FIG. 20 shows a schematic sectional view of a first view angle of the cylinder sleeve in FIG. 18.

As shown in FIG. 19 and FIG. 21, there are two compression exhaust ports 22, and the two compression exhaust ports 22 are arranged at intervals along the axial direction of the cylinder sleeve 20. There are two the exhaust valve assemblies 60, and the two exhaust valve assemblies 60 are arranged corresponding to the two compression exhaust ports 22, respectively. In this way, since the two compression exhaust ports 22 are respectively provided with the exhaust valve assembly 60, gas in the volume-variable cavity 311 is effectively prevented from being leaked with a large quantity, so that the compression efficiency of the volume-variable cavity 311 is ensured.

Figure 50:
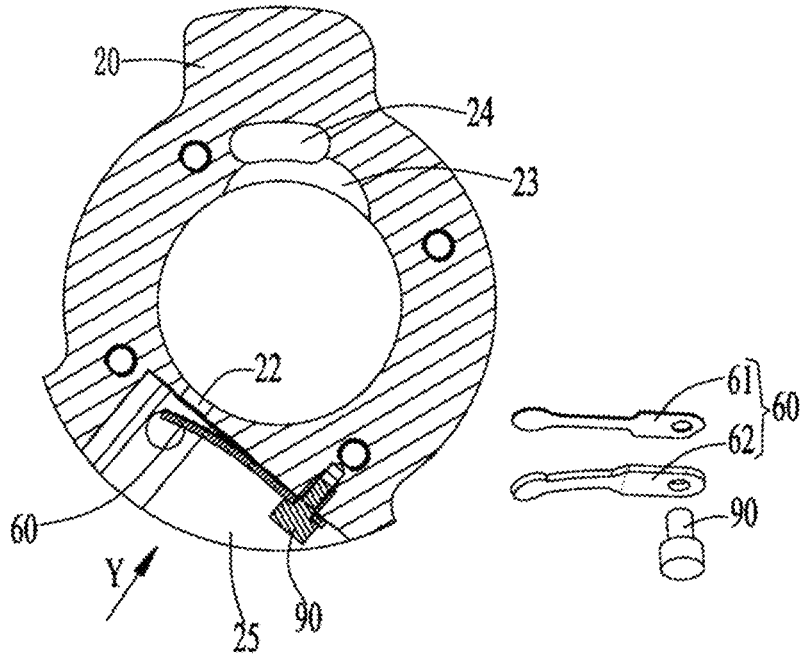
FIG. 50 shows a schematic sectional view of a second view angle of the cylinder sleeve in FIG. 13.

The exhaust valve assembly 60 is connected to the cylinder sleeve 20 by a fastener 90. Referring to FIG. 50, the exhaust valve assembly 60 includes an exhaust valve sheet 61 and a valve plate baffle 62. The exhaust valve sheet 61 is arranged in the exhaust cavity 25 and shields the corresponding compression exhaust port 22. The valve plate baffle 62 is superimposed on the exhaust valve sheet 61. In this way, arrangement of the valve plate baffle 62 effectively prevents the exhaust valve sheet 61 from being excessively opened, thereby exhaust performance of the cylinder sleeve 20 is ensured.

In some embodiments, the fastener 90 is a screw.

Figure 13:
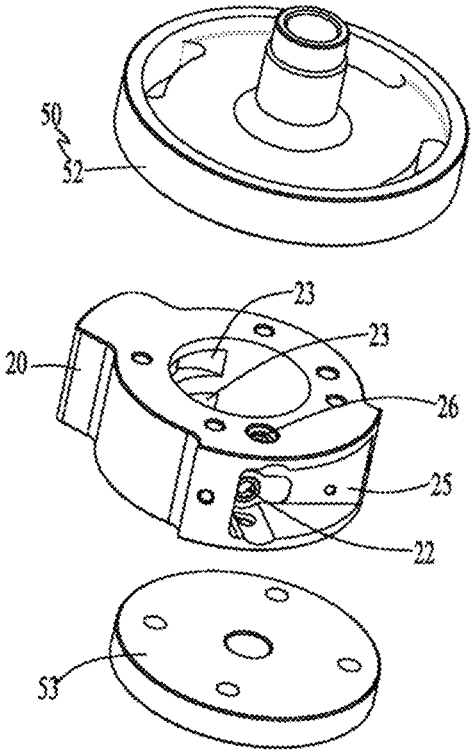
FIG. 13 shows a schematic exploded structural diagram of an upper flange, a cylinder sleeve and a lower flange in FIG. 5.
Figure 51:
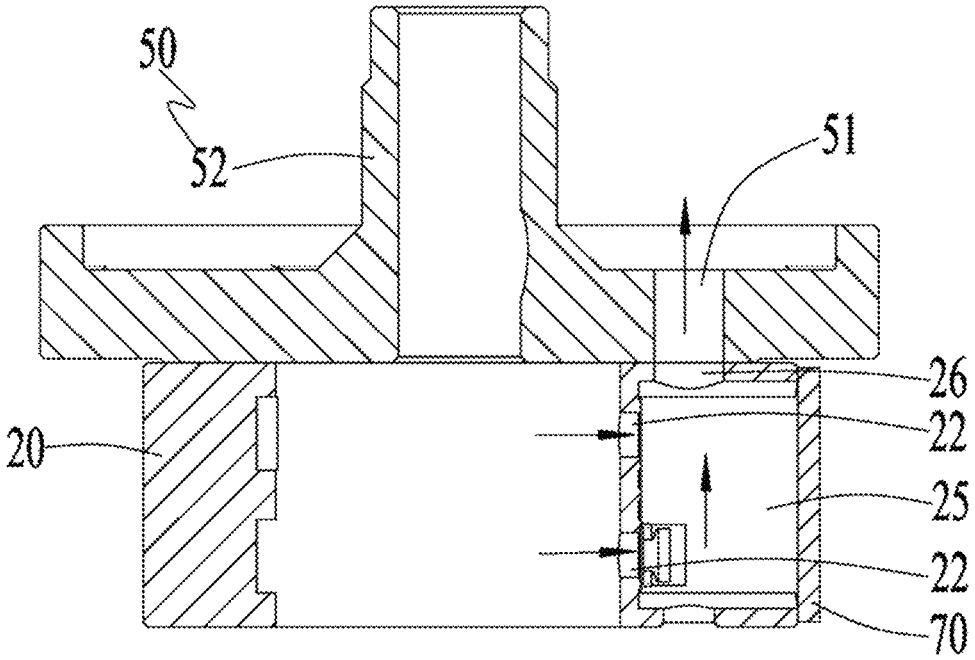
FIG. 51 shows a schematic sectional view of an upper flange and a cylinder sleeve in FIG. 4, and in this figure, an exhaust path of the pump body assembly is shown.

As shown in FIG. 13 and FIG. 51, an axial end surface of the cylinder sleeve 20 is further provided with a communicating hole 26. The communicating hole 26 communicates with the exhaust cavity 25. The fluid machinery further includes a flange 50 provided with an exhaust channel. The communicating hole 26 is communicated to the exhaust channel 51. In this way, exhaust reliability of the cylinder sleeve 20 is ensured.

As shown in FIG. 13 and FIG. 51, the exhaust cavity 25 penetrates through an outer wall surface of the cylinder sleeve 20. The fluid machinery further includes an exhaust cover plate 70 connected to the cylinder sleeve 20 and sealing the exhaust cavity 25. In this way, the exhaust cover plate 70 functions to separate the volume-variable cavity 311 from an external space of the pump body assembly 83.

It should be noted that, in the present disclosure, when the volume-variable cavity 311 communicates with the compression exhaust port 22, and the pressure of the volume-variable cavity 311 reaches the exhaust pressure, the exhaust valve sheet 61 is opened. Compressed gas enters into the exhaust cavity 25 via the compression exhaust port 22, and passes through the communicating hole 26 on the cylinder sleeve 20. Then the compressed gas is discharged through the exhaust channel 51 and enters in an external space (that is, a cavity of the compressor) of the pump body assembly 83, and thereby the exhaust process is finished.

In some embodiments, the exhaust cover plate 70 is fixed on the cylinder sleeve 20 by a fastener 90.

In some embodiments, the fastener 90 is a screw.

In some embodiments, an outer contour of the exhaust cover plate 70 is matched with an outer contour of the exhaust cavity 25.

An operation of the compressor is specifically described below.

As shown in FIG. 3, the motor assembly 82 drives the crankshaft 10 to rotate, so that the two eccentric parts 11 of the crankshaft 10 respectively drive the two corresponding sliding blocks 40 to move. The sliding block 40 performs revolution around the axis of the crankshaft 10, at the same time, the sliding block 40 performs rotation relative to the eccentric part 11, and the sliding block 40 reciprocates along the limiting channel 31 and drives the crossed groove structure 30 to rotate in the cylinder sleeve 20. When the sliding block 40 performs revolution, the sliding block 40 reciprocates along the limiting channel 31 simultaneously, to form a motion mode of a cross-shaped sliding block mechanism.

In other usage scenarios: exchanging positions of the intake port and the exhaust port of this compressor, and the machine serves as an expansion machine. That is, the exhaust port of the compressor serves as an intake port of the expansion machine to inlet high-pressure gas, the high-pressure gas pushes the mechanism to rotate, and after the gas being expanded, the gas is discharged through the compressor suction port (which is an exhaust port of the expansion machine).

When the fluid machinery is an expansion machine, the cylinder sleeve 20 has an expansion intake port and an expansion exhaust port. In the case that any of the sliding blocks 40 is at an intake position, the expansion exhaust port communicates with the corresponding volume-variable cavity 311. In the case that any of the sliding blocks 40 is at an air exhaust position, the corresponding volume-variable cavity 311 communicates with the expansion intake port.

In some embodiments, an inner wall surface of the cylinder sleeve 20 has an expansion exhaust cavity 25 communicating with the expansion exhaust port.

In some embodiments, the expansion exhaust cavity 25 extends a first preset distance around a circumference direction of an inner wall surface of the cylinder sleeve 20, to form an arc-shaped expansion exhaust cavity 25. The expansion exhaust cavity 25 extends from the expansion exhaust port to a side where the expansion intake port is located. An extension direction of the expansion exhaust cavity 25 is the same as a rotation direction of the crossed groove structure 30.

In some embodiments, there are two expansion exhaust cavities 25, and the two expansion exhaust cavities 25 are arranged at intervals along the axial direction of the cylinder sleeve 20. The cylinder sleeve 20 further has an expansion exhaust communicating cavity. The two expansion exhaust cavities 25 both communicates with the expansion exhaust communicating cavity, and the expansion exhaust port communicates with the expansion exhaust cavity 25 via the expansion exhaust communicating cavity.

In some embodiments, the expansion exhaust communicating cavity extends a second preset distance along the axial direction of the cylinder sleeve 20. At least one end of the expansion exhaust communicating cavity penetrates through an axial end surface of the cylinder sleeve 20.

Second Embodiment

Differences between this embodiment and the first embodiment is that the crankshaft 10 is arranged in two sections, and the two sections of the crankshaft 10 are arranged non-coaxially.

Figure 29:
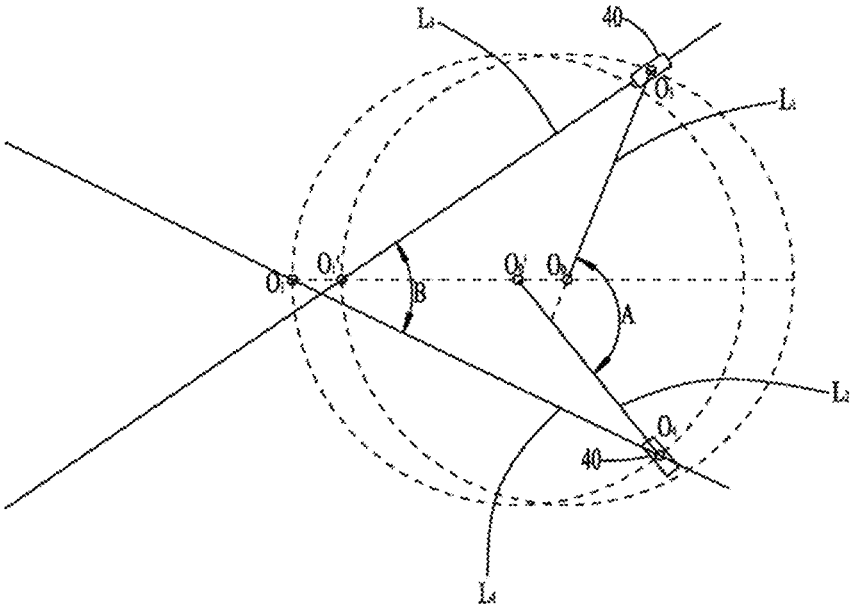
FIG. 29 shows a schematic diagram of a mechanism principle of an operation of a compressor according to a second embodiment of the present disclosure.
Figure 30:
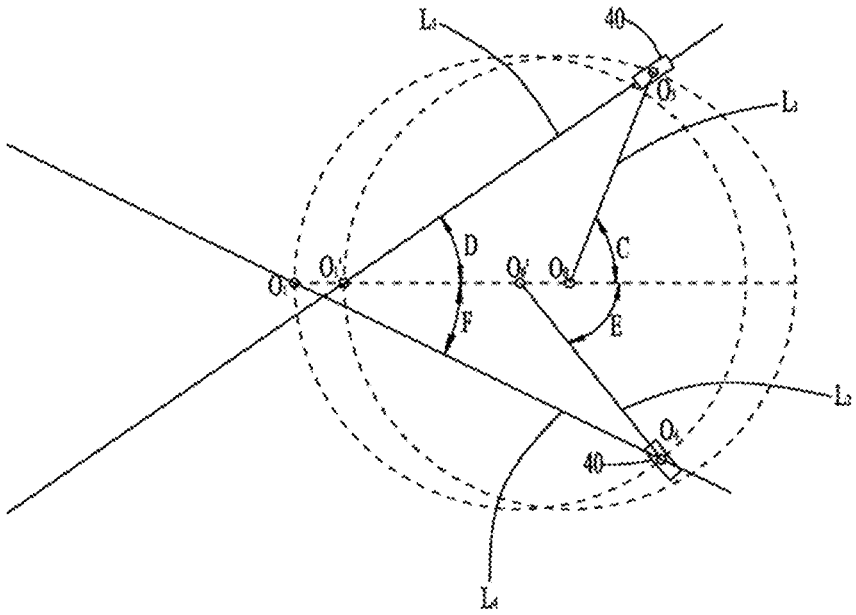
FIG. 30 shows a schematic diagram of the mechanism principle of the operation of the compressor in FIG. 29.

As shown in FIG. 29 and FIG. 30, when the above-mentioned fluid machinery is operated, a first section 121 of the crankshaft 10 performs rotation around the axis $O_0$ of the first section 121, and a second section 122 of the crankshaft 10 performs rotation around the axis $O_0'$ of the second section, where the $O_0$ and the $O_0'$ do not coincide. The axis $O_0$ of the first section 121 and the axis $O_0$ of the first crossed groove section 33 are eccentrically arranged and have a fixed eccentric distance therebetween, and the axis $O_0'$ of the second section 122 and the axis $O_1'$ of the second crossed groove section 34 are eccentrically arranged and have a fixed eccentric distance therebetween. A first sliding block takes the axis $O_0$ of the first section 121 as the center of a circle and performs a circular motion, a distance, between a center $O_3$ of the first sliding block 40 and the axis $O_0$ of the first section 121, is equal to the eccentric amount of the eccentric part 11 on the first section 121, and the eccentric amount of the eccentric part 11 on the first section 121, is equal to the eccentric distance between the axis $O_0$ of the first section 121 and the axis $O_1$ of the first crossed groove section 33. The first section 121 is rotated, to drive the first sliding block 40 to perform the circular motion, and the first sliding block 40 interacts with the first crossed groove section 33 and slides back and forth in the limiting channel 31 of the first crossed groove section 33. A second sliding block takes the axis $O_0'$ of the second section 122 as the center of a circle and performs a circular motion, a distance, between a center $O_4$ of the second sliding block 40 and the axis $O_0'$ of the second section 122, is equal to the eccentric amount of the eccentric part 11 on the second section 122, and the eccentric amount on the second section 122 is equal to the eccentric distance between the axis $O_0'$ of the second section 122 and the axis $O_1'$ of the second crossed groove section 34. The second section 122 is rotated, to drive the second sliding block 40 to perform a circular motion, and the second sliding block 40 interacts with the second crossed groove section 34 and slides back and forth in the limiting channel 31 of the second crossed groove section 34.

The fluid machinery operated by the second operation method constitutes a cross-shaped sliding block mechanism, and this operation method adopts a principle of the cross-shaped sliding block mechanism. The two eccentric portions 11 of the crankshaft 10 serve as a first connecting rod $L_1$ and a second connecting rod $L_2$ respectively, the limiting channel 31 of the first crossed groove section 33 serves as a third connecting rod $L_3$, and the limiting channel 31 of the second crossed groove section 34 serves as a fourth connecting rod $L_4$, where, a length of the first connecting rod $L_1$ is equal to a length of the second connecting rod $L_2$ (referring to FIG. 29).

As shown in FIG. 29, there is a first included angle A between the first connecting rod $L_1$ and the second connecting rod $L_2$, and there is a second included angle B between the third connecting rod $L_3$ and the fourth connecting rod $L_4$, where, the first included angle A is twice of the second included angle B.

As shown in FIG. 30, a connecting line, among the axis $O_0$ of the first section 121, the axis $O_0'$ of the second section 122, the axis $O_0$ of the first crossed groove section 33 and the axis $O_1'$ of the second crossed groove section 34, is $O_0O_0'O_1O_1'$, there is a third included angle C between the first connecting rod $L_1$ and the connecting line $O_0O_0'O_1O_1'$, and correspondingly, there is a fourth included angle D between the third connecting rod $L_3$ and the connecting line $O_0O_0'O_1O_1'$, where the third included angle C is twice of the fourth included angle D. There is a fifth included angle E between the second connecting rod $L_2$ and the connecting line $O_0O_0'O_1O_1'$, and correspondingly, there is a sixth included angle F between the fourth connecting rod $L_4$ and the connecting line $O_0O_0'O_1O_1'$, where the fifth included angle E is twice of the sixth included angle F. A sum of the third included angle C and the fifth included angle E is the first included angle A, and a sum of the fourth included angle D and the sixth included angle F is the second included angle B.

In some embodiments, the operation method further includes: an angular velocity of the rotation of the sliding block 40 is equal to an angular velocity of the revolution of the sliding block 40; and angular velocities of the revolution of the first crossed groove section 33 and the second crossed groove section 34 are equal to the angular velocity of the rotation of the sliding block 40.

To be specific, the axis $O_0$, of the first section 121 is equivalent to a rotation center of the first connecting rod $L_1$, and the axis $O_0$, of the second section 122 is equivalent to a rotation center of the second connecting rod $L_2$. The axis $O_0$ of the first crossed groove section 33 is equivalent to a rotation center of the third connecting rod $L_3$, and the axis $O_0'$ of the second crossed groove section 34 is equivalent to a rotation center of the fourth connecting rod $L_4$. The two eccentric parts 11 of the crankshaft 10 respectively serve as the first connecting rod $L_1$ and second connecting rod $L_2$. The two limiting channels 31 of the crossed groove structure 30 serve as the third connecting rod $L_3$ and a fourth connecting rod La respectively. A length of the first connecting rod $L_1$ is same as a length of the second connecting rod $L_2$. In this way, when the crankshaft 10 is rotated, the eccentric parts 11 on the crankshaft 10 simultaneously drive the corresponding sliding blocks 40 to perform the revolution around the corresponding axis $O_0$ of the first section 121 and the corresponding axis $O_0$ of the second section 122 respectively. At the same time, the sliding block 40 is capable of performing the rotation relative to the eccentric part 11, and the rotation velocities of the rotation and revolution are same. Since the first sliding block 40 and the second sliding block 40 perform reciprocating motion in two corresponding limiting channels 31 respectively, and drives the crossed groove structure 30 to perform a circular motion, limited by the two limiting channels 31 of the crossed groove structure 30, motion directions of the two sliding blocks 40 always have a phase difference with the second included angle B. When one of the two sliding blocks 40 is at the dead point position, the eccentric part 11 for driving the other of the two sliding blocks 40 has the maximum driving torque. The eccentric part 11 with the maximum driving torque is able to normally drive the corresponding sliding block 40 to rotate, so that the crossed groove structure 30 is driven to rotate by this sliding block 40, and thus the sliding block 40 at dead point position being driven to continue rotating by the crossed groove structure 30. Consequently, a stable operation of the fluid machinery is achieved, and the dead point position of the motion mechanism is avoided, so that motion reliability of the fluid machinery is improved, and thus operation reliability of heat exchange apparatus is ensured.

It should be noted that, in the present disclosure, a maximum force arm of the driving torque of the eccentric part 11 is 2e.

Under this motion method, running tracks of each of the sliding blocks 40 are both circles, where one of the circles takes the axis $O_0$ of the first section as a center of the circle and takes the connecting line $O_0O_1$ as a radius, and the other of the circles takes the axis $O_0'$ of the second section as a center of the circle and takes the connecting line $O_0'O_1$ as a radius.

It should be noted that, in the present disclosure, during a process of the crankshaft 10 is rotated, the crankshaft 10 is rotated two circles, and four times of air suction and exhaust process are completed.

Two alternative embodiments are shown in the followings, to describe the structure of the fluid machinery in details, so that the operation method of the fluid machinery is better described by structural features.

As shown in FIG. 33, FIG. 34, FIG. 35, and FIGS. 37 to 42, a shaft body part 12 of the crankshaft 10 includes a first section 121 and a second section 122 which are connected along the axial direction thereof. The first section 121 and the second section 122 are non-coaxially arranged and are movably connected. The two eccentric parts 11 are respectively arranged at the first section 121 and the second section 122. In this way, it is ensured that a normal operation of the motion mechanism constructed in FIG. 29 may be implemented.

As shown in FIG. 33, FIG. 34, FIG. 35, and FIGS. 37 to 42, the crankshaft 10 further includes a sliding connection member 13, and the first section 121 is movably connected to the second section 122 via the sliding connection member 13. The first section 121 is rotated while the sliding connection member 13 slides relative to the first section 121, and the second section 122 is rotated while the sliding connection member 13 slides relative to the second section 122. In this way, connection reliability between the first section 121 and the second section 122 is ensured, and rotation reliability of the first section 121 and the second section 122 is ensured.

As shown in FIG. 35, FIG. 36, and FIGS. 38 to 42, the sliding connection member 13 has two limiting sliding slots, and extension directions of the two limiting sliding slots are perpendicular to each other and, are both perpendicular to the axial direction of the crankshaft 10. The first section 121 has a first protrusion structure 1211 at an end part of a side towards the sliding connection member 13, and the second section 122 has a second protrusion structure 1221 at an end part of a side towards the sliding connection member 13. The first protrusion structure 1211 and the second protrusion structure 1221 are respectively arranged in the two limiting sliding slots in a sliding manner. The first section 121 is rotated, to make the first protrusion structure 1211 slide back and forth in the corresponding limiting sliding slot and interact with the sliding connection member 13 simultaneously, so that the sliding connection member 13 is rotated, and drives the second protrusion structure 1221 to slide back and forth in the corresponding limiting sliding slot while driving the second section 122 to rotate. Or, the second section 122 is rotated, to make the second protrusion structure 1221 slide back and forth in the corresponding limiting sliding slot and interact with the sliding connection member 13 simultaneously, so that the sliding connection member 13 is rotated, and drives the first protrusion structure 1211 to slide back and forth in the corresponding limiting sliding slot while driving the first section 121 to rotate. In this way, connection reliability between the first section 121 and the second section 122 is ensured, and rotation reliability of therebetween is also ensured.

It should be noted that, in an embodiment of the present disclosure which is not shown in the drawings, the sliding connection member 13 has two limiting protrusions extending towards the first section 121 and the second section 122 respectively. The first section 121 has a first sliding slot structure at an end part of a side towards the sliding connection member 13, and the second section 122 has a second sliding slot structure at an end part of a side towards the sliding connection member 13. The two limiting protrusions respectively arranged in the first sliding slot structure and the second sliding slot structure in a sliding manner, and an extension direction of the first sliding slot structure is perpendicular to an extension direction of the second sliding slot structure. The first section 121 is rotated, to make the corresponding limiting protrusion slide back and forth in the first sliding slot structure and the first sliding slot structure simultaneously interact with the sliding connection member 13, so that the sliding connection member 13 is rotated, and drives the limiting protrusion to slide back and in the second sliding slot structure while driving the second section 122 to rotate. Or, the second section 122 is rotated, to make the corresponding limiting protrusion slide back and forth in the second sliding slot structure and the second sliding slot structure simultaneously interact with the sliding connection member 13, so that the sliding connection member 13 is rotated, and drives the limiting protrusion to slide back and forth in the first sliding slot structure while driving the first section 121 to rotate. In this way, connection reliability between the first section 121 and the second section 122 is ensured, and rotation reliability therebetween is also ensured.

Figure 43:
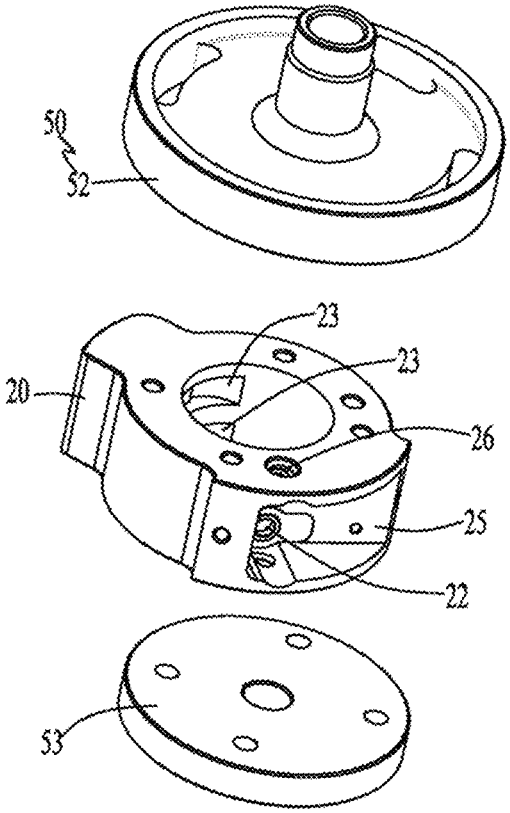
FIG. 43 shows a schematic exploded structural diagram of an upper flange, a cylinder sleeve and a lower flange in FIG. 35.
Figure 44:
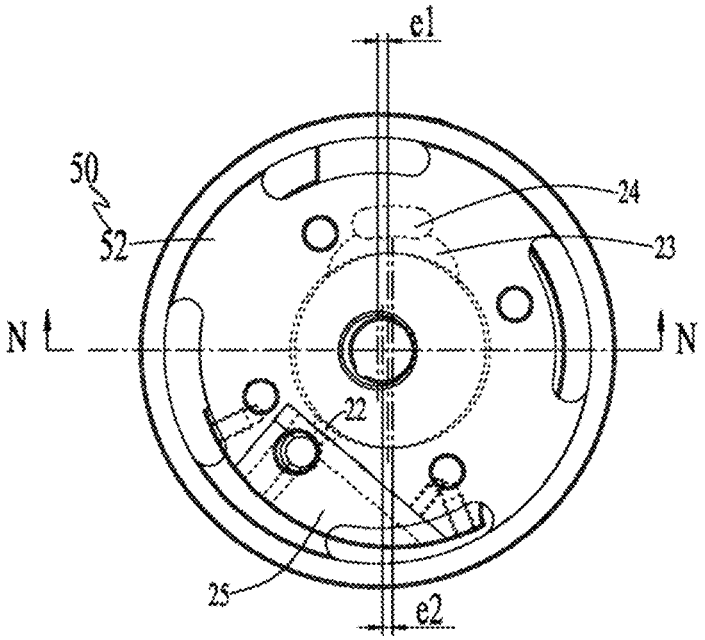
FIG. 44 shows a schematic structural diagram of eccentric amounts respectively between the first section and the second section of the crankshaft and the cylinder sleeve in FIG. 35.
Figure 45:
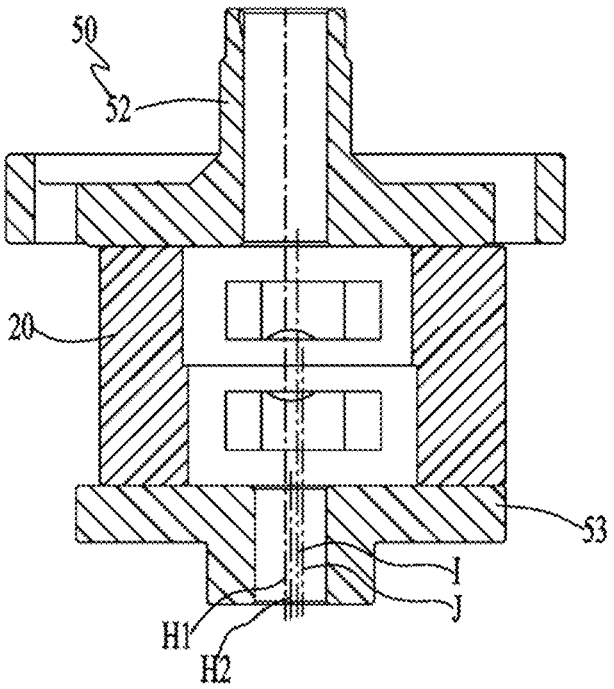
FIG. 45 shows a schematic sectional view of an N-N view angle in FIG. 44.

As shown in FIGS. 39 to 45, eccentric amounts of the two eccentric parts 11 are equal, where, an assembly eccentric amount, between the first section 121 and the corresponding first crossed groove section 33, is equal to the eccentric amount of the eccentric part 11 which is arranged at the first section 121, and an assembly eccentric amount, between the second section 122 and the corresponding second crossed groove section 34, is equal to the eccentric amount of the eccentric part 11 which is arranged at the second section 122. In this way, it is ensured that the normal operation of the motion mechanism constructed in FIG. 29 may be implemented. The eccentric amount of the eccentric part 11 on the first section 121 is $e_1$, the eccentric amount of the eccentric part 11 on the second section 122 is $e_2$, and the $e_1$ is not equal to the $e_1$. In FIG. 44 and FIG. 45, a label H1 represents the axis of the first section 121, a label H2 represents the axis of the second section 122, a label I represents an axis of an upper half portion of an inner ring of the cylinder sleeve 20, and a label J represents an axis of a lower half portion of the inner ring of the cylinder sleeve 20.

Figure 31:
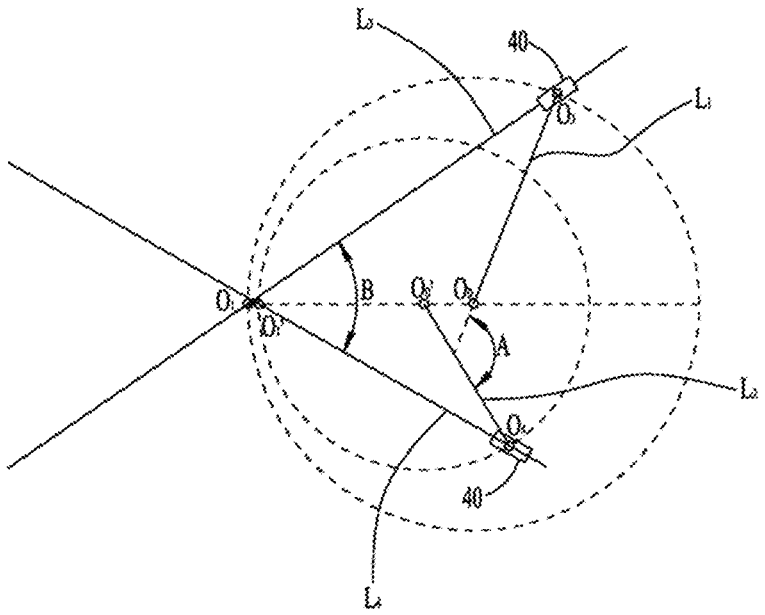
FIG. 31 shows a schematic diagram of a mechanism principle of an operation of a compressor according to a third embodiment of the present disclosure.
Figure 32:
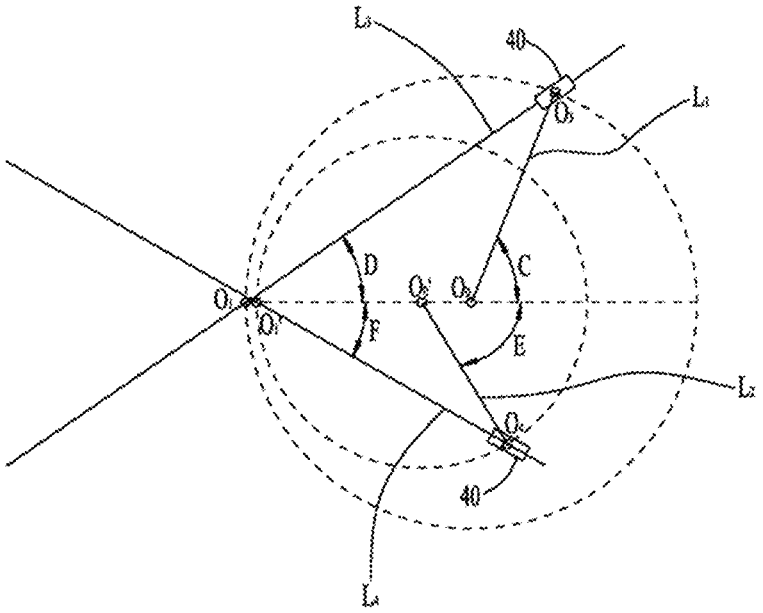
FIG. 32 shows a schematic diagram of the mechanism principle of the operation of the compressor in FIG. 31.
Figure 33:
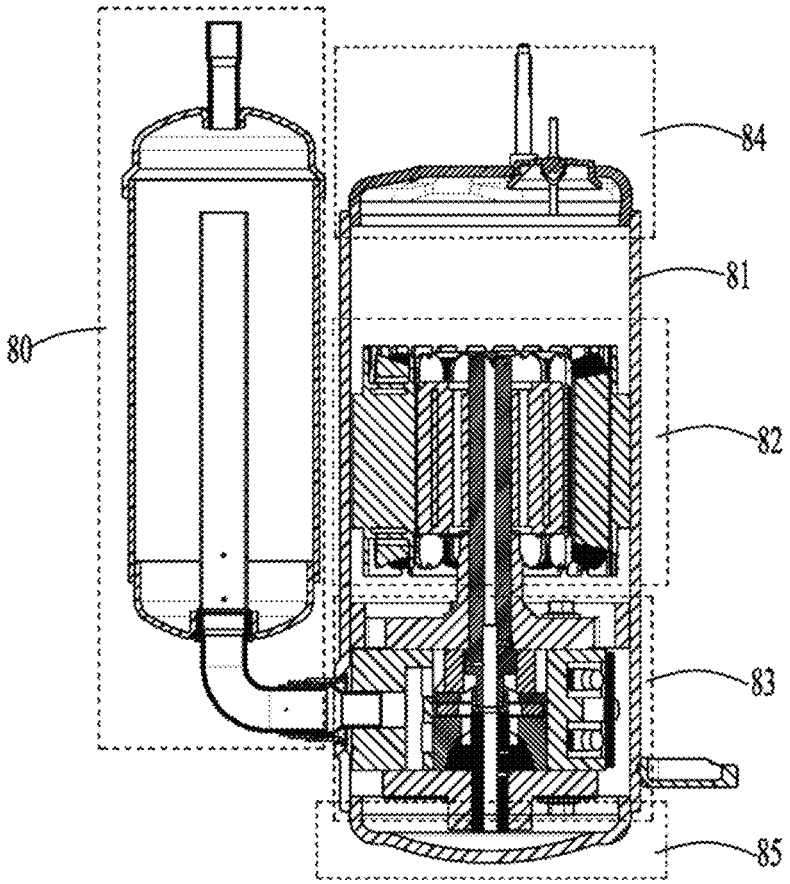
FIG. 33 shows a schematic diagram of an internal structure of a compressor according to some embodiments of the present application.
Figure 34:
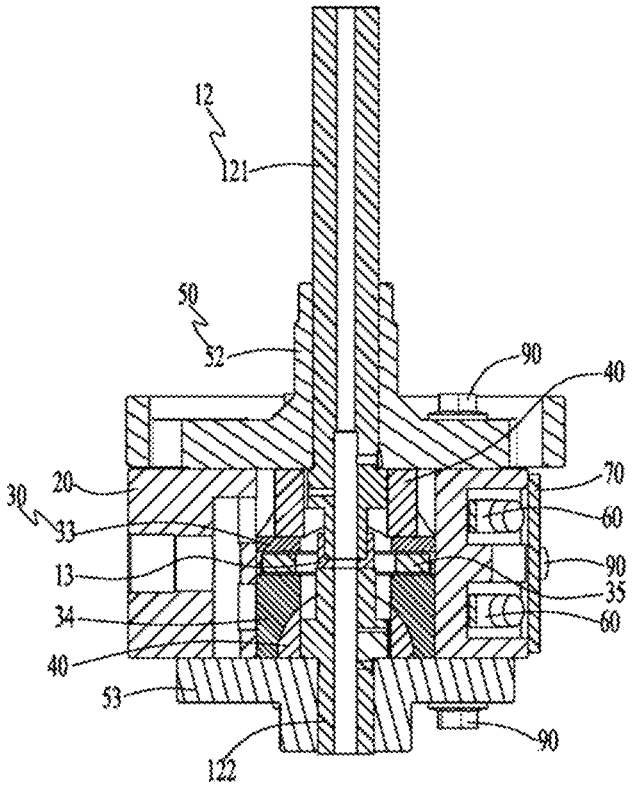
FIG. 34 shows a schematic structural diagram of a pump body assembly of the compressor in FIG. 33.
Figure 35:
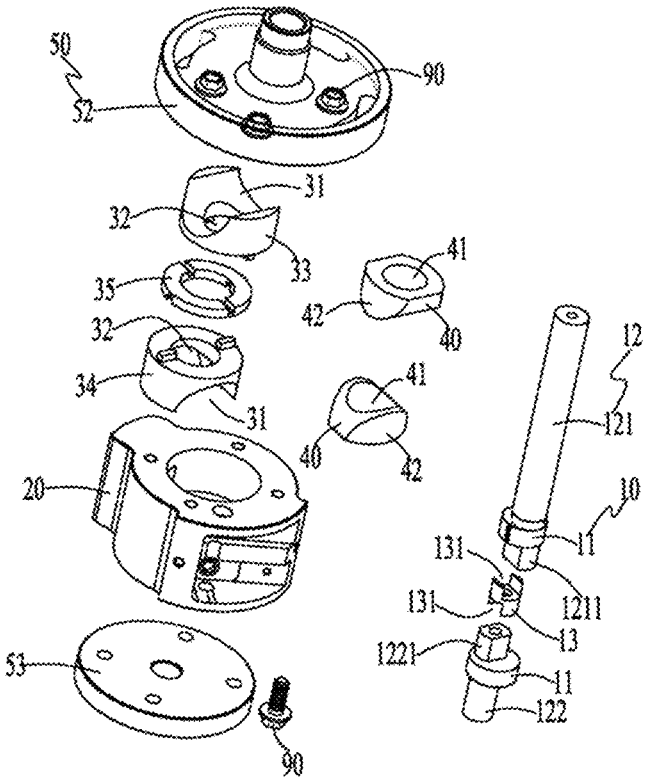
FIG. 35 shows a schematic exploded diagram of the pump body assembly in FIG. 34.
Figure 36:
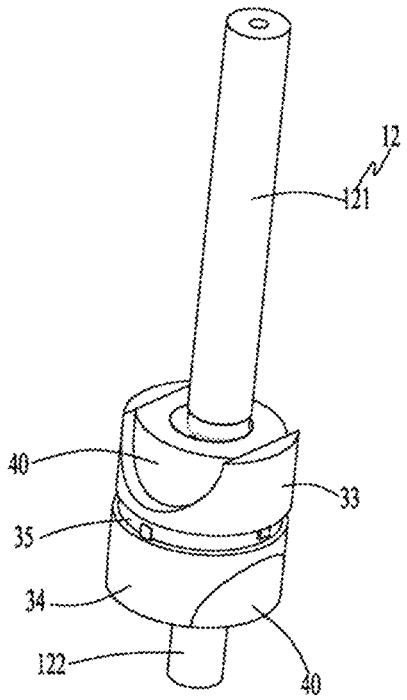
FIG. 36 shows a schematic diagram of an assembly structure of a crankshaft, a crossed groove structure and sliding blocks in FIG. 35.
Figure 37:
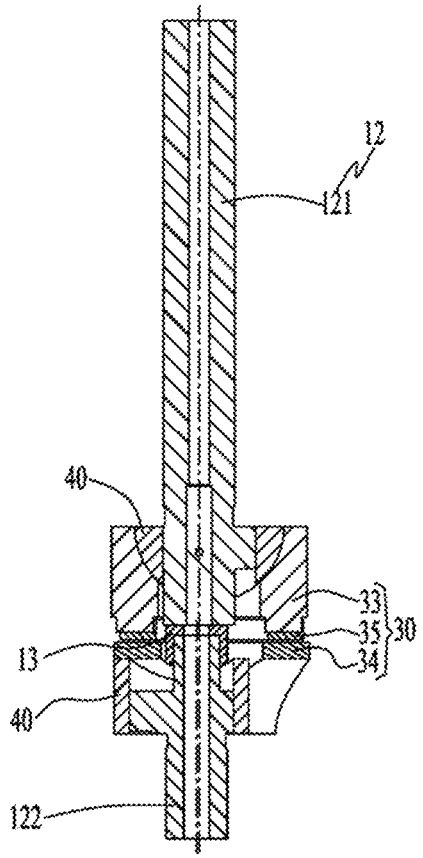
FIG. 37 shows a schematic sectional view of the crankshaft, the crossed groove structure and the sliding blocks in FIG. 36.
Figure 38:
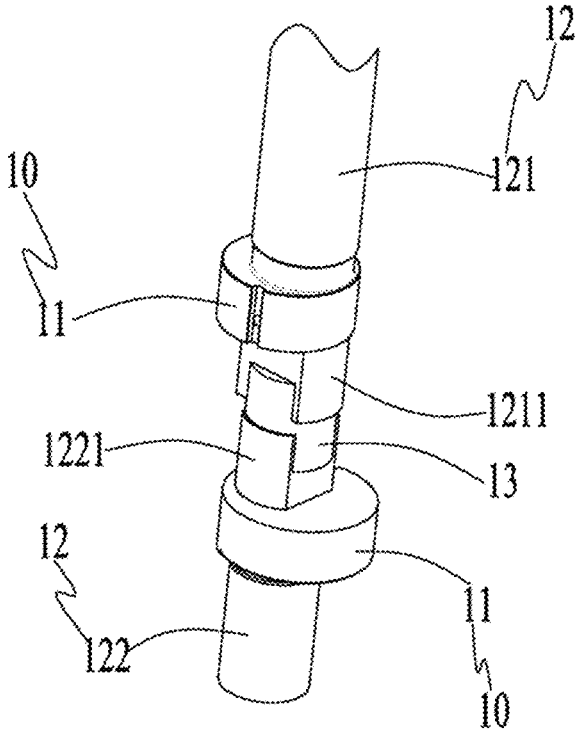
FIG. 38 shows a schematic partial view of the crankshaft in FIG. 35.
Figure 39:
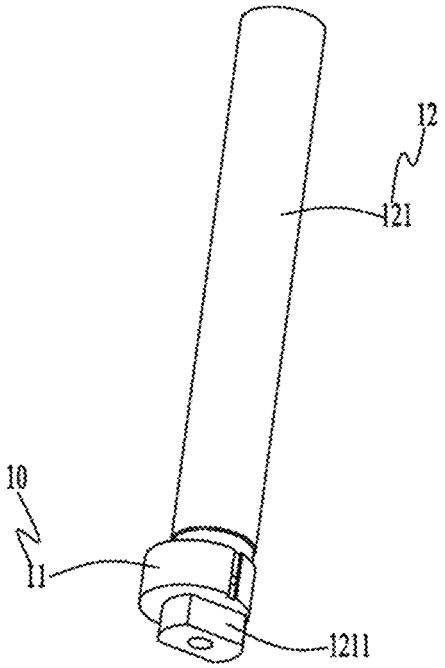
FIG. 39 shows a schematic structural diagram of a first section of the crankshaft in FIG. 38.

In a second implementation of this embodiment, as shown in FIG. 31 and FIG. 32, the fluid machinery operated by the operation method above-mentioned constitutes a cross-shaped sliding block mechanism, and this operation method adopts principle of a cross-shaped sliding block 40 mechanism. The eccentric part 11 at the first section 121 serves as a first connecting rod $L_1$, the eccentric part 11 at the second section 122 serves as a second connecting rod $L_2$, the limiting channel 31 of the first crossed groove section 33 serves as a third connecting rod $L_3$, and the limiting channel 31 of the second crossed groove section 34 serves as a fourth connecting rod $L_4$. A difference between this implementation and the first implementation is that a length of the first connecting rod $L_1$ is not equal to a length of the second connecting rod $L_2$.

It should be noted that, in this implementation, the eccentric amounts of the two eccentric parts 11 are unequal, where, an assembly eccentric amount, between the first section 121 and the corresponding first crossed groove section 33, is equal to the eccentric amount of the eccentric part 11 which is arranged at the first section 121, and an assembly eccentric amount, between the second section 122 and the corresponding second crossed groove section 34, is equal to the eccentric amount of the eccentric part 11 which is arranged at the second section 122. In this way, it is ensured that the normal operation of the motion mechanism constructed in FIG. 31 may be implemented.

Third Embodiment

This embodiment is described below with reference to FIGS. 22 to 28, FIGS. 39 to 43 and FIGS. 46 to 75.

In this embodiment, the eccentric amounts of the two eccentric parts 11 are not equal. The difference between this embodiment and the first Embodiment 1 is that they have different structures of the crossed groove structure 30 and the crankshaft 10.

Figure 52:
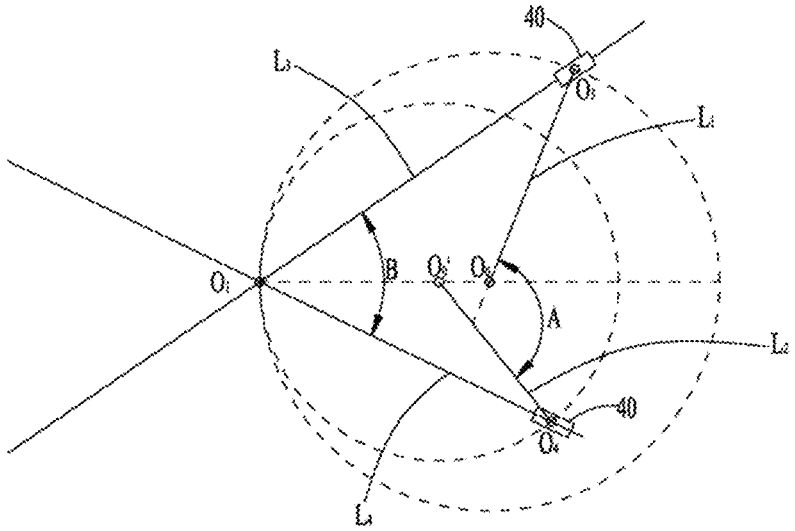
FIG. 52 show a schematic diagram of a mechanism principle about an operation of a compressor according to some embodiments of the present disclosure.
Figure 53:
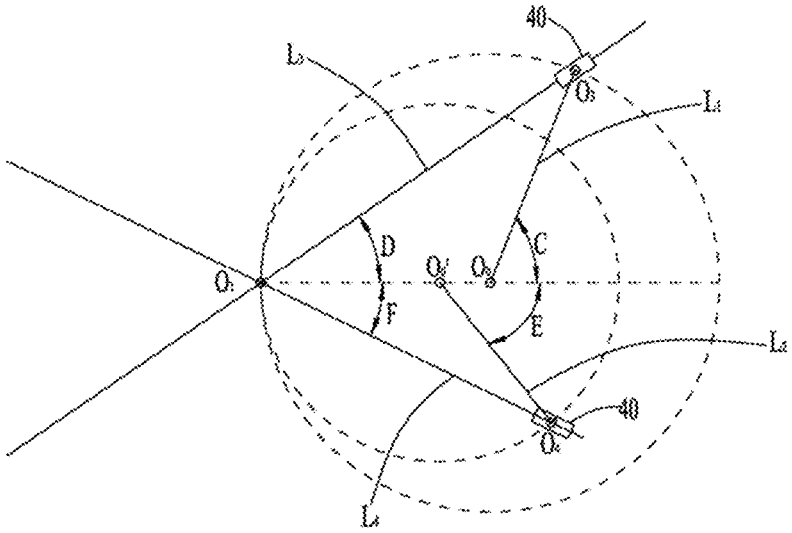
FIG. 53 shows a schematic diagram of the mechanism principle about the operation of the compressor in FIG. 52.

As shown in FIG. 52 and FIG. 53, under this condition, when the above-mentioned fluid machinery is operated, an operation method for the fluid machinery includes: performing, by a first section 121 of the crankshaft 10, rotation, around an axis $O_0$ of the first section 121, and performing, by a second section 122 of the crankshaft 10, rotation, around an axis $O_0'$ of the second section 122, where the $O_0$ and the $O_0'$ do not coincide; the axis $O_0$ of the first section 121 and an axis $O_0$ of the crossed groove structure 30 being eccentrically arranged and having a fixed eccentric distance therebetween; the axis $O_0'$ of the second section 122 and the axis $O_1$ of the crossed groove structure 30 being eccentrically arranged and having a fixed eccentric distance therebetween; taking the axis $O_0$ of the first section 121 as a center of a circle and, performing, by a first sliding block 40, a circular motion, a distance, between a center $O_0$ of the first sliding block 40 and the axis $O_0$ of the first section 121, being equal to the eccentric amount of the eccentric part 11 at the first section 121, and the eccentric amount of the eccentric part 11 at the first section 121, being equal to the eccentric distance between the axis $O_0$ of the crankshaft 10 and the axis $O_1$ of the crossed groove structure 30; the crankshaft 10 being rotated, to drive the first sliding block 40 to perform the circular motion, and the first sliding block 40 interacting with the crossed groove structure 30 and sliding back and forth in the limiting channel 31 of the crossed groove structure 30; taking the axis $O_0'$ of the second section 122 as a center of a circle and, performing, by a second sliding block 40, a circular motion, a distance, between a center $O_4$ of the second sliding block 40 and the axis $O_0'$ of the second section 122, being equal to the eccentric amount of the eccentric part 11 at the second section 122, and the eccentric amount of the eccentric part 11 at the second section 122, being equal to the eccentric distance between the axis $O_0'$ of the second section 122 and the axis $O_1$ of the crossed groove; the crankshaft 10 being rotated, to drive the second sliding block 40 to perform the circular motion, and the second sliding block 40 interacting with the crossed groove structure 30 and sliding back and forth in the limiting channel 31 of the crossed groove structure 30.

The fluid machinery which operated by the operation method described above, constitutes a cross-shaped sliding block mechanism, and this operation method adopts a mechanism principle of a cross-shaped sliding block. The eccentric part 11 of the first section 121 serves as a first connecting rod $L_1$, the eccentric part 11 of the second section 122 serves as a second connecting rod $L_2$, and the two limiting channels 31 of the crossed groove structure 30 respectively serve as a third connecting rod $L_3$ and a fourth connecting rod $L_4$, where a length of the first connecting rod $L_1$ and a length of the second connecting rod $L_2$ are unequal.

As shown in FIG. 52, there is a first included angle A between the first connecting rod $L_1$ and the second connecting rod $L_2$, and there is a second included angle B between the third connecting rod $L_3$ and the fourth connecting rod $L_4$, where the first included angle A is twice of the second included angle B.

As shown in FIG. 53, a connecting line, among the axis $O_0$ of the first section 121, the axis $O_0'$ of the second section 122 and the axis $O_0$ of the crossed groove, is $O_0O_0'O_1$. There is a third included angle C between the first connecting rod $L_1$ and the connecting line $O_0O_0'O_1$, and correspondingly, there is a fourth included angle D between the third connecting rod $L_3$ and the connecting line $O_0O_0'O_1$, where the third included angle C is twice of the fourth included angle D. There is a fifth included angle E between the second connecting rod $L_2$ and the connecting line $O_0O_0'O_1$, and correspondingly, there is a sixth included angle F between the fourth connecting rod $L_4$ and the connecting line $O_0O_0'O_1$, where the fifth included angle E is twice of the sixth included angle F. A sum of the third included angle C and the fifth included angle E is the first included angle A, and a sum of the fourth included angle D and the sixth included angle F is the second included angle B.

In some embodiments, the operation method further includes: an angular velocity of the rotation of the sliding block 40 is equal to an angular velocity of the revolution of the sliding block 40, and an angular velocity of the revolution of the crossed groove structure 30 is equal to the angular velocity of the rotation of the sliding block 40.

To be specific, as shown in 56, the axis $O_0$ of the first section 121 is equivalent to a rotation center of the first connecting rod $L_1$, the axis $O_0'$ of the second section 122 is equivalent to a rotation center of the second connecting rod $L_2$, and the axis $O_1$ of the crossed groove structure 30 is equivalent to a rotation center of the third connecting rod $L_3$ and a fourth connecting rod $L_4$. The two eccentric parts 11 of the crankshaft 10 respectively serve as the first connecting rod $L_1$ and second connecting rod $L_2$. The two limiting channels 31 of the crossed groove structure 30 serve as the third connecting rod $L_3$ and a fourth connecting rod $L_4$, respectively. The length of the first connecting rod $L_1$ is not equal to the length of the second connecting rod $L_2$. In this way, when the first section 121 is rotated, the eccentric part 11 at the first section 121 drives the corresponding sliding block 40 to perform revolution around the axis $O_0$ of the first section 121, at the same time, the sliding block 40 is able to performs rotation relative to the eccentric part 11, and rotation velocities of the revolution and rotation are the same. The first sliding block 40 and the second sliding block 40 perform reciprocating motion in the two corresponding limiting channels 31, respectively, and drives the crossed groove structure 30 to perform a circular motion, and limited by the two limiting channels 31 of the crossed groove structure 30, moving directions of the two sliding blocks 40 always have a phase difference with the second included angle B. In the case that the eccentric part 11 at the first section 121 is at the dead point position, the eccentric part 11 at the second section 122 has the maximum driving torque. The eccentric part 11 with the maximum driving torque could normally drive the corresponding sliding block 40 to rotate, so that the crossed groove structure 30 is driven to rotate by the sliding block 40, and thus, the sliding block 40 at the dead point position is driven to continue to rotate by the crossed groove structure 30. Consequently, a stable operation of the fluid machinery is achieved, and the dead point position of the motion mechanism is avoided, so that operation reliability of the fluid machinery is improved, and thus, operation reliability of the heat exchange apparatus is ensured. Or, in the case that the eccentric part 11 at the second section 122 is at the dead point position, the eccentric part 11 at the first section 121 has the maximum driving torque. The eccentric part 11 with the maximum driving torque could normally drive the corresponding sliding block 40 to rotate, so that the crossed groove structure 30 is driven to rotate by the sliding block 40, and thus, the sliding block 40 at the dead point position is driven to continue to rotate by the crossed groove structure 30. Consequently, a stable operation of the fluid machinery is achieved, and the dead point position of the motion mechanism is avoided, so that operation reliability of the fluid machinery is improved, and thus operational reliability of the heat exchange apparatus is improved.

It should be noted that, in the present invention, a maximum force arm of the driving torque of the eccentric part 11 is 2e.

Under this motion method, running tracks of the two sliding blocks 40 are both circles, where one circle takes the axis $O_0$ of the first section 121 as a center of the circle and the connecting line $O_0O_1$ as a radius, and the other circle takes the axis $O_0'$ of the second section 122 as a center of the circle and the line $O_0'O_1$ as a radius.

To introduce the structure of the fluid machinery in details, an optional embodiment is shown in the followings, so that the operation method of the fluid machinery may be better described by structural features.

As shown in FIGS. 22 to 28, FIGS. 39 to 43, FIG. 50, FIG. 51 and FIGS. 54-65, a shaft body portion 12 of the crankshaft 10 includes a first section 121 and a second section 122 which are connected along the axial direction thereof. The first section 121 and the second section 122 are arranged non-coaxially and are movably connected. The two eccentric parts 11 are respectively arranged at the first section 121 and the second section 122. In this way, the shaft body portion 12 of the crankshaft 10 is configured to be the first section 121 and the second section 122 which are connected along the axial direction thereof, at the same time, the first section 121 and the second section 122 are arranged non-coaxially and are movably connected, it is ensured that the eccentric amount of the eccentric part 11 at the first section 121 is not equal to the eccentric amount of the eccentric part 11 at the second section 122, and rotation reliability of the first section 121 and the second section 122 is also ensured meanwhile.

As shown in FIG. 56, the crankshaft 10 further includes a sliding connection member 13. The first section 121 is movably connected to the second section 122 via the sliding connection member 13. The sliding connection member 13 slides relative to the first section 121 while the first section 121 is rotated. The sliding connection member 13 slides relative to the second section 122 while the second section 122 is rotated. In this way, through the sliding connection member 13, it is ensured that the first section 121 and the second section 122 are arranged non-coaxially, and rotation reliability of the first section 121 and the second section 122 is also ensured.

As shown in FIG. 56, the sliding connection member 13 has two limiting sliding slots 131. Extension directions of the two limiting sliding slots 131 are perpendicular to each other and are both are perpendicular to the axial direction of the crankshaft 10. The first section 121 has a first protrusion structure 1211 at an end part of a side towards the sliding connection member 13. The second section 122 has a second protrusion structure 1221 at an end part of a side towards the sliding connection member 13. The first protrusion structure 1211 and the second protrusion structure 1221 are arranged in the two limiting sliding slots 131 in a sliding manner, respectively. The first section 121 is rotated, to make the first protrusion structure 1211 slide back and forth in the corresponding limiting sliding slot 131 and interact with the sliding connection member 13 simultaneously, so that the sliding connection member 13 is rotated and, drives the second protrusion structure 1221 to slide back and forth in the corresponding limiting sliding slot 131 while driving the second section 122 to rotate. Or, the second section 122 is rotated, to make the second protrusion structure 1221 slide back and forth in the corresponding limiting sliding slot 131 and interact with the sliding connection member 13, so that the sliding connection member 13 is rotated and, drives the first protrusion structure 1211 to slide back and forth in the corresponding limiting sliding slot while driving the first section 121 to rotate. In this way, the connection reliability between the first section 121 and the second section 122 is ensured, and rotation stationarity between the first section 121 and the second section 122 is also ensured.

Figure 59:
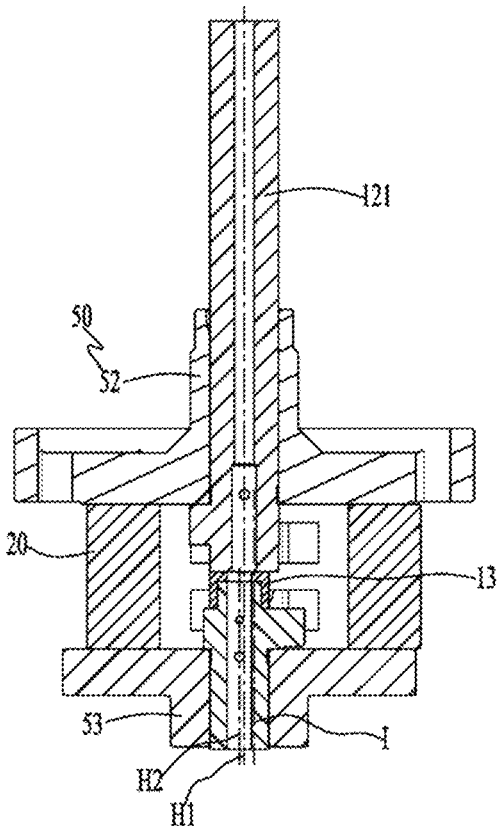
FIG. 59 shows a schematic structural diagram of an assembly eccentric amount between a crankshaft and a cylinder sleeve in FIG. 55.
Figure 60:
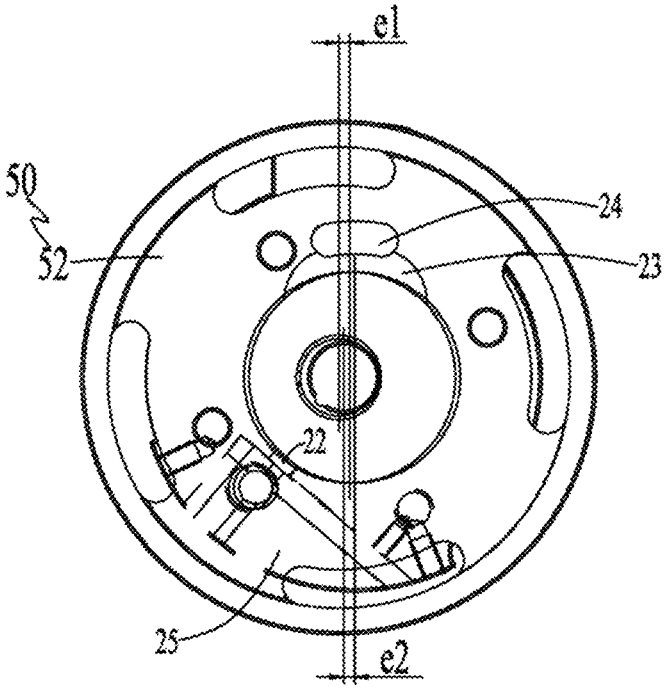
FIG. 60 shows a schematic structural diagram of an assembly eccentric amount between the cylinder sleeve and the lower flange in FIG. 43.

As shown in FIG. 40, FIG. 42, FIG. 59 and FIG. 60, an assembly eccentric amount, between the first section 121 and the cylinder sleeve 20, is equal to the eccentric amount of the eccentric part 11 arranged at the first section 121. An assembly eccentric amount, between the second section 122 and the cylinder sleeve 20, is equal to the eccentric amount of the eccentric parts 11 arranged at the second section 122. In this way, as shown in FIG. 40, the eccentric amount of the eccentric part 11 at the first section 121 is $e_1$. As shown in FIG. 60, the assembly eccentric amount between the first section 121 and the cylinder sleeve 20 is also $e_1$. At the same time, as shown in FIG. 42, the eccentric amount of the eccentric part 11 at the second section 122 is $e_2$, and as shown in FIG. 60, the assembly eccentric amount between the second section 122 and the cylinder sleeve 20 is also $e_1$. In this way, operation reliability of the motion mechanism constructed in FIG. 52 and FIG. 53 is ensured.

As shown in FIG. 59, a label H1 represents the axis of the first section 121, a label H2 represents the axis of the second section 122, and a label I represents an axis of an inner ring of the cylinder sleeve 20.

As shown in FIG. 56, two ends of the limiting channel 31 penetrates to an outer peripheral surface of the crossed groove structure 30. In this way, difficulty about processing and manufacturing of the crossed groove structure 30 may be reduced.

In some embodiments, the two sliding blocks 40 are concentrically arranged with the two eccentric parts 11 respectively. The sliding blocks 40 perform a circular motion around the axis of the crankshaft 10, and there is a first rotating gap between a hole wall of the through hole 41 and the eccentric part 11, where the first rotating gap ranges from 0.005 mm to 0.05 mm.

In some embodiments, the crossed groove structure 30 and the cylinder sleeve 20 are coaxially arranged. There is a second rotating gap between a peripheral surface of the crossed groove structure 30 and an inner wall surface of the cylinder sleeve 20, and the second rotating gap ranges from 0.005 mm to 0.1 mm.

It should be noted that, in the present invention, the first included angle A ranges from 160 degrees to 200 degrees, and the second included angle B ranges from 80 degrees to 100 degrees, as long as a relationship that the first included angle A is twice of the second included angle B is met.

In some embodiments, the first included angle A is 160 degrees, and the second included angle B is 80 degrees.

In some embodiments, the first included angle A is 165 degrees, and the second included angle B is 82.5 degrees.

In some embodiments, the first included angle A is 170 degrees, and the second included angle B is 85 degrees.

In some embodiments, the first included angle A is 175 degrees, and the second included angle B is 87.5 degrees.

In some embodiments, the first included angle A is 180 degrees, and the second included angle B is 90 degrees.

In some embodiments, the first included angle A is 185 degrees, and the second included angle B is 92.5 degrees.

In some embodiments, the first included angle A is 190 degrees, and the second included angle B is 95 degrees.

In some embodiments, the first included angle A is 195 degrees, and the second included angle B is 97.5 degrees.

Figure 55:
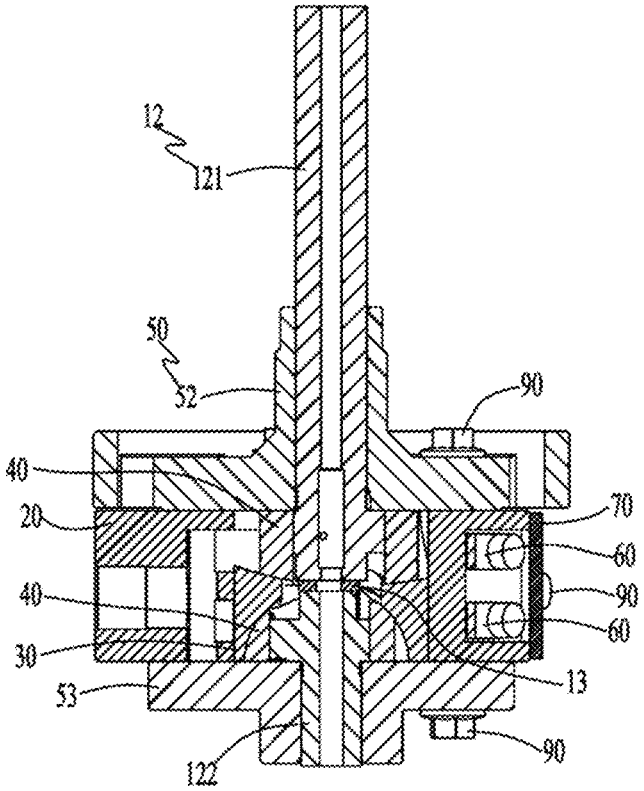
FIG. 55 shows a schematic structural diagram of a pump body assembly of the compressor in FIG. 54.

As shown in FIG. 55, FIG. 56 and FIG. 59, the fluid machinery further includes a flange 50 arranged at an end of the axial direction of the cylinder sleeve 20. The crankshaft 10 is concentrically arranged with the flange 50. The crossed groove structure 30 and the cylinder sleeve 20 are arranged coaxially. An assembly eccentric amount, between the crankshaft 10 and the crossed groove structure 30, is determined by a relative position relation between the flange 50 and the cylinder sleeve 20, where the flange 50 is fixed at the cylinder sleeve 20 by a fastener 90. A relative position between an axis of the flange 50 and an axis of an inner ring of the cylinder sleeve 20 is controlled by adjusting a center of the flange 50. The relative position, between the axis of the flange 50 and the axis of the inner ring of the cylinder sleeve 20, determines a relative position between an axis of the crankshaft 10 and an axis of the crossed groove structure 30. The essence of adjusting the center of the flange 50 is to make the eccentric amount of the eccentric part 11 is equal to an assembly eccentric amount of the crankshaft 10.

In some embodiments, there is a first assemble gap between the crankshaft 10 and the flange 50, and the first assemble gap ranges from 0.005 mm to 0.05 mm.

In some embodiments, the first assemble gap ranges from 0.01 mm to 0.03 mm.

It should be noted that, in the present invention, the eccentric part 11 has an arc surface, and a central angle of the arc surface is larger than or equal to 180 degrees. In this way, it is ensured that the arc surface of the eccentric part 11 may apply an effective driving force on the sliding block 40, and thereby the motion reliability of the sliding block 40 is ensured.

As shown in FIGS. 39 to 42 and FIGS. 55 to 59, the eccentric part 11 is cylindrical.

In some embodiments, a proximal end of the eccentric part 11 is flush with an outer circle of a shaft body portion 12 of the crankshaft 10.

In some embodiments, a proximal end of the eccentric part 11 is protruded from an outer circle of a shaft body portion 12 of the crankshaft 10.

In some embodiments, a proximal end of the eccentric part 11 is provided at an inner side of an outer circle of a shaft body portion 12 of the crankshaft 10.

It should be noted that, in an embodiment of the present invention not shown in the drawings, the sliding block 40 includes a plurality of sub-sliding blocks 40 which are spliced to form the through hole 41.

As shown in FIGS. 39 to 42 and FIGS. 55 to 59, the two eccentric parts 11 are arranged at intervals in the axial direction of the crankshaft 10. In this way, during a process of assembling the crankshaft 10, the cylinder sleeve 20 and the two sliding blocks 40, it is ensued that a space distance between the two eccentric parts 11 may provide an assembly space for the cylinder sleeve 20, so that convenience about assembly is ensured.

As shown in FIG. 56, the crossed groove structure 30 has a central hole 32. The two limiting channels 31 communicates with the central hole 32. An aperture of the central hole 32 is larger than a diameter of the shaft body portion 12 of the crankshaft 10. In this way, it is ensued that the crankshaft 10 may smoothly penetrate through the central hole 32.

In some embodiments, the aperture of the central hole 32 is larger than a diameter of the eccentric part 11. In this way, it is ensued that the eccentric part 11 of the crankshaft 10 may penetrate through the central hole 32 smoothly.

Figure 61:
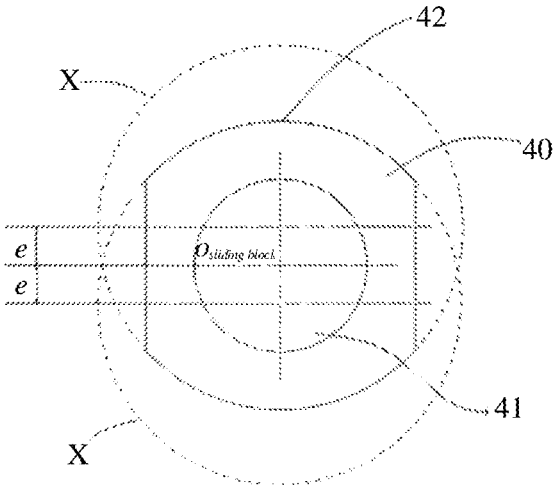
FIG. 61 shows a schematic structural diagram of a sliding block in FIG. 56 which is in the axial direction of a through hole.

As shown in FIG. 61, a projection of the sliding block 40 in the axial direction of the through hole 41 has two relatively parallel straight-line segments and arc segments connecting the ends of the two straight-line segments. The limiting channel 31 has a set of first sliding surfaces arranged opposite to each other and in a sliding contact with the sliding block 40. The sliding block 40 has a second sliding surface matched with the first sliding surface and a pressing surface towards an end of the limiting channel 31. The pressing surface 42 serves as a head of the sliding block 40, the two the second sliding surfaces are connected via the pressing surface, and the pressing surface faces to the volume-variable cavity 311. In this way, a projection of the second sliding surface of the sliding block 40 in the axial direction of the through hole 41 is a straight-line segment, and a projection of the pressing surface 42 of the sliding block 40 in the axial direction of the through hole 41 is an arc segment.

To be specific, the pressing surface 42 is an arc surface, and a distance, between an arc center of the arc surface and a center of the through hole 41, is equal to the eccentric amount of the eccentric part 11. As shown in FIG. 15, a center of the through hole 41 of the sliding block 40 is $O_{sliding\ block}$, and the distances, between the arc centers of the two arc surfaces and the center of the through hole 41 are both e, that is, the eccentric amount of the eccentric part 11, and X dotted lines in FIG. 15 represent circles on which the arc centers of the two arc surfaces are located.

In some embodiments, a curvature radius of the arc surface is equal to a radius of an inner circle of the cylinder sleeve 20; or, there is a difference value between a curvature radius of the arc surface and a radius of an inner circle of the cylinder sleeve 20, and the difference value ranges from −0.05 mm to 0.025 mm.

In some embodiments, the difference value ranges from −0.02 mm to 0.02 mm.

In some embodiments, a ratio, between a projection area $S_{sliding\ block}$, of the pressing surface, in the sliding direction of the sliding block 40 and, an area $S_{exhaus}$ of a compression exhaust port 22 of the cylinder sleeve 20, is $S_{sliding\ block}/S_{exhaust}$, which ranges from 8 to 25.

In some embodiments, the ratio $S_{sliding\ block}/S_{exhaust}$ ranges from 12 to 18.

Figure 54:
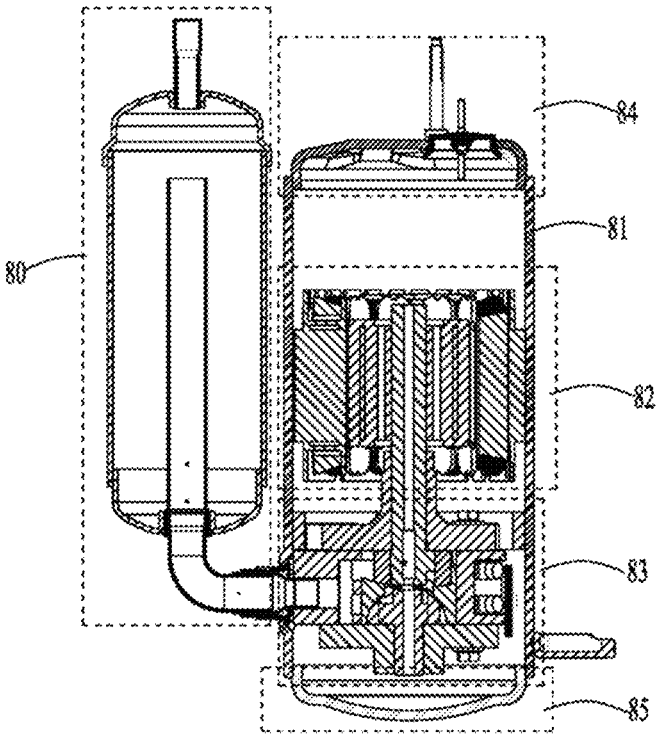
FIG. 54 shows a schematic diagram of an internal structure of a compressor according to a first embodiment of the present disclosure.

It should be noted that, the fluid machinery shown in the present invention is a compressor. As shown in FIG. 54, the compressor includes a liquid separator component 80, a housing assembly 81, a motor assembly 82, a pump body assembly 83, an upper cover assembly 84 and a lower cover assembly 85. The liquid separator component 80 is disposed outside the housing assembly 81, the upper cover assembly 84 is assembled at an upper end of the housing assembly 81, the lower cover assembly 85 is assembled at a lower end of the housing assembly 81, and the motor assembly 82 and the pump body assembly 83 are both located in the housing assembly 81. The motor assembly 82 is located above or below the pump body assembly 83. The motor assembly 82 of the compressor includes the crankshaft 10, the cylinder sleeve 20, the crossed groove structure 30, the sliding block 40, the upper flange 52 and the lower flange 53 above-mentioned.

In some embodiments, the above-mentioned components are all connected by means of welding, hot sleeve or cold pressing.

An assembly process of the entire pump body assembly 83 is as follows: the lower flange 53 is fixed on the cylinder sleeve 20; the two sliding blocks 40 are respectively disposed in the two corresponding limiting channels 31, and the first section 121, the second section 122 and the sliding connection member 13 are assembled into the crankshaft 10, then the two eccentric parts 11 of the crankshaft 10 extend respectively into the two through holes 41 of the two corresponding sliding blocks 40, then the assembled crankshaft 10, the crossed groove structure 30, and the two sliding blocks 40 are disposed in the cylinder sleeve 20, one end of the crankshaft 10 is mounted on the lower flange 53, and the other end of the crankshaft 10 penetrates through the upper flange 52. For details, referring to FIG. 55 and FIG. 56.

It should be noted that, in the present embodiment, an enclosed space surrounded by the sliding block 40, the limiting channel 31, the cylinder sleeve 20 and the upper flange 52 (or the lower flange 53) is the volume-variable cavity 311. The pump body assembly 83 has four volume-variable cavities. In the process of the crankshaft 10 is rotated, the crankshaft 10 is rotated two circles, and a single volume-variable cavity 311 completes one time of an air suction and exhaust process. For the compressor, the crankshaft 10 rotates two circles, the sum of four times of the air suction and exhaust process are completed.

As shown in FIGS. 23 to 28, during reciprocating motion of the sliding block 40 in the limiting channel 31, the sliding block 40 is also rotated relative to the cylinder sleeve 20. In FIGS. 23 to 25, the volume-variable cavity 311 is enlarged as the sliding block 40 is clockwise rotated from 0 degree to 180 degrees. During a process that the volume-variable cavity 311 is enlarged, the volume-variable cavity 311 communicates with the air-suction cavity 23 of the cylinder sleeve 20. When the sliding block 40 is rotated to 180 degrees, volume of the volume-variable cavity 311 reaches a maximum value. At this point, the volume-variable cavity 311 is detached from the air suction cavity 23, and thereby an air suction and exhaust operation is completed. In FIGS. 26 to 28, during a process that the sliding block 40 continues to rotate in the clockwise direction from 180 degrees to 360 degrees, the volume-variable cavity 311 is decreased, and gas in the volume-variable cavity 311 is compressed by the sliding block 40. When the sliding block 40 is rotated until the volume-variable cavity 311 communicates with the compression exhaust port 22, and a pressure of the gas in the volume-variable cavity 311 reaches an exhaust pressure, an exhaust valve sheet 61 of an exhaust valve assembly 60 is opened to start the exhaust operation until the compression process is finished, and then it enters a next cycle.

As shown in FIGS. 23 to 28, a point labeled by M serves as a reference point for a relative movement of the sliding block 40 and the crankshaft 10. FIG. 25 shows a process that the sliding block 40 is rotated clockwise from 0 degrees to 180 degrees. A rotation angle of the sliding block 40 is $\theta_1$, and correspondingly, a rotation angle of the crankshaft 10 is $2\theta_1$. FIG. 26 shows a process that the sliding block 40 continues to rotate from 180 degrees to 360 degrees along a clockwise direction. The rotation angle of the sliding block 40 is $180°+\theta_2$, and correspondingly, the rotation angle of the crankshaft 10 is $180°+2\theta_2$. FIG. 27 shows a process that the sliding block 40 continues to rotate from 180 degrees to 360 degrees along the clockwise direction, and the volume-variable cavity 311 is communicated to the compression exhaust port 22. The rotation angle of the sliding block 40 is $180°+\theta_3$, and correspondingly, the rotation angle of the crankshaft 10 is $360°+2\theta_3$, that is, the sliding block 40 is rotated one circle, and correspondingly, the crankshaft 10 is rotated two circles, where $\theta_1<\theta_2<\theta_3$.

To be specific, and as shown in FIGS. 22 to 28, FIG. 43, FIG. 50, FIG. 51 and FIGS. 62 to 65, the cylinder sleeve 20 has a compression intake port 21 and a compression exhaust port 22. In the case that any of the sliding blocks 40 is at an intake position, the compression intake port 21 communicates with the corresponding volume-variable cavity 311. In the case that any of the sliding blocks 40 is at an exhaust position, the corresponding volume-variable cavity 311 communicates with to the compression exhaust port 22.

As shown in FIGS. 22 to 28, FIG. 43, FIG. 50, FIG. 51 and FIGS. 62 to 65, an inner wall surface of the cylinder sleeve 20 has an air-suction cavity 23, and the air-suction cavity 23 communicates with the compression intake port 21. In this way, it is ensured that the air-suction cavity 23 may store a large amount of gas, so that the gas may be fully sucked into the volume-variable cavity 311, and thus, a sufficient amount of the gas may be sucked into the compressor. When the air suction amount is insufficient, the stored gas may be supplied to the volume-variable cavity 311 in time, and thus the compression efficiency of the compressor is ensured.

In some embodiments, the air suction cavity 23 is formed by hollowing out the inner wall surface of the cylinder sleeve 20 along a radial direction. There may be one air-suction cavity 23, or there may be two air-suction cavities disposed at an upper portion and a lower portion of the inner wall surface of the cylinder sleeve 20, respectively.

To be specific, the air-suction cavity 23 extends a first preset distance around a circumference of the inner wall surface of the cylinder sleeve 20, to form an arc-shaped air-suction cavity 23. In this way, it is ensured that volume of the is large enough, to store a large amount of gas.

Figure 62:
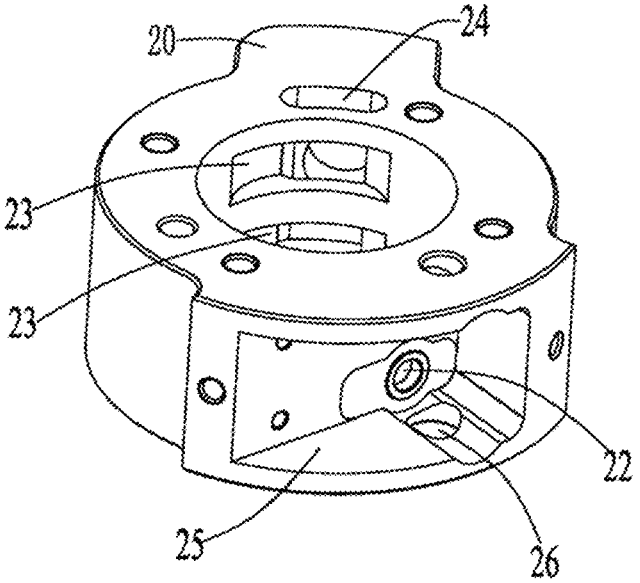
FIG. 62 shows a schematic structural diagram of the cylinder sleeve in FIG. 43.
Figure 63:
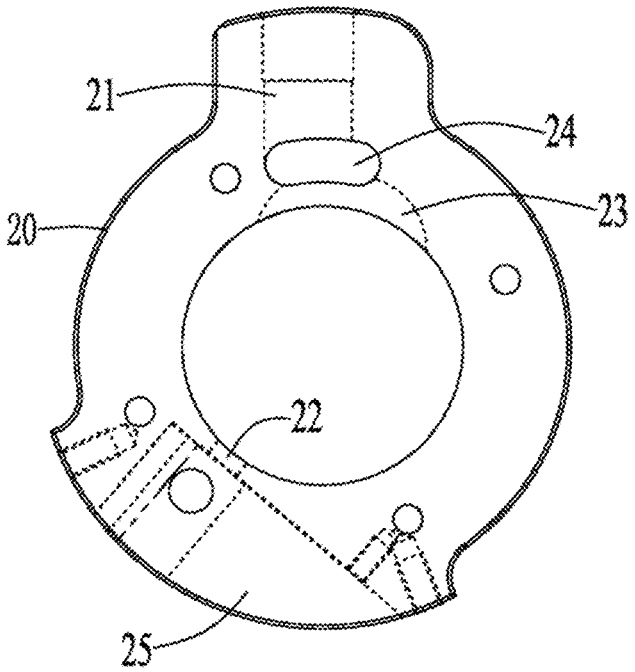
FIG. 63 shows a schematic structural diagram of a first view angle of the cylinder sleeve in FIG. 62.
Figure 64:
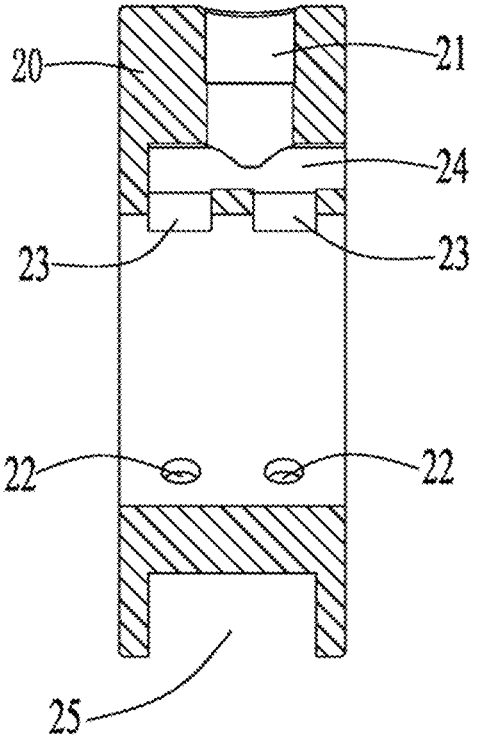
FIG. 64 shows a schematic sectional view of the cylinder sleeve in FIG. 62.
Figure 65:
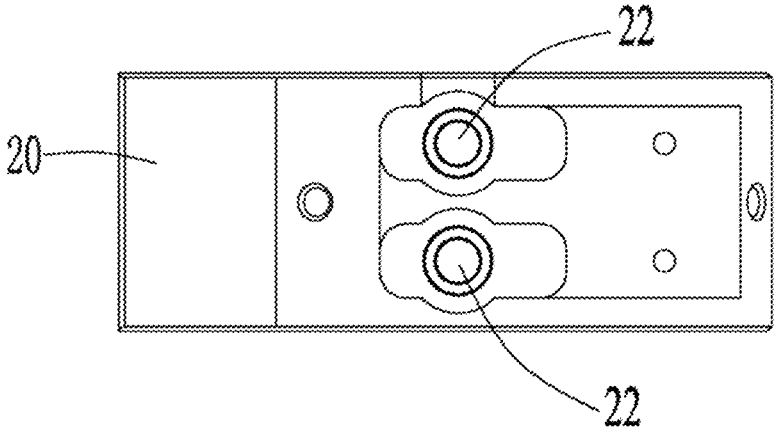
FIG. 65 shows a schematic structural diagram of a Y-direction perspective in FIG. 50.

As shown in FIG. 43, FIG. 62 and FIG. 64, there are two air-suction cavities 23, and the two air-suction cavities are arranged at intervals along the axial direction of the cylinder sleeve 20. The cylinder sleeve 20 further has an air-suction communicating cavity 24. The two air-suction cavities 23 both communicates with the air-suction communicating cavity 24, and the compression intake port 21 communicates with the air-suction cavity 23 via the air-suction communicating cavity 24. In this way, it is beneficial to increase volume of the air-suction cavity 23, and thus fluctuation of a suction pressure is reduced.

In some embodiments, the air-suction communicating cavity 24 extends a second preset distance along the axial direction of the cylinder sleeve 20. At least one end of the air-suction communicating cavity 24 penetrates through an axial end surface of the cylinder sleeve 20. In this way, the air-suction communicating cavity 24 is conveniently formed at an end surface of the cylinder sleeve 20, and thereby processing convenience of the air-suction communicating cavity 24 is ensured.

As shown in FIG. 43, FIG. 62 and FIG. 64, the outer wall of the cylinder sleeve 20 is provided with an exhaust cavity 25. The compression exhaust port 22 communicates with the exhaust cavity 25 via the inner wall of the cylinder sleeve 20. As shown in FIG. 19, the fluid machinery further includes an exhaust valve assembly 60 arranged in the exhaust cavity 25 and corresponding to the compression exhaust port 22. In this way, the exhaust cavity 25 is applied to accommodate the exhaust valve assembly, and thereby an occupied space of the exhaust valve assembly 60 is effectively reduced, to make the components to be reasonably arranged, and thus, a space utilization rate of the cylinder sleeve 20 is improved.

As shown in FIG. 50, FIG. 51, FIG. 64 and FIG. 65, there are two compression exhaust ports 22, and the two compression exhaust ports 22 are arranged at intervals along the axial direction of the cylinder sleeve 20. There are two exhaust valve assemblies 60, and the two exhaust valve assemblies 60 are arranged corresponding to the two compression exhaust ports 22, respectively. In this way, since the two compression exhaust ports 22 are respectively provided with the exhaust valve assembly 60, gas in the volume-variable cavity 311 is effectively prevented from being leaked with a large quantity, so that the compression efficiency of the volume-variable cavity 311 is ensured.

As shown in FIG. 50, the exhaust valve assembly 60 is connected to the cylinder sleeve 20 by a fastener 90. The exhaust valve assembly 60 includes an exhaust valve sheet 61 and a valve plate baffle 62. The exhaust valve sheet 61 is arranged in the exhaust cavity 25 and shields the corresponding compression exhaust port 22. The valve plate baffle 62 is superimposed on the exhaust valve sheet 61. In this way, arrangement of the valve plate baffle 62 effectively prevents the exhaust valve sheet 61 from being excessively opened, thereby exhaust performance of the cylinder sleeve 20 is ensured.

In some embodiments, the fastener 90 is a screw.

As shown in FIG. 43, FIG. 51 and FIG. 62, an axial end surface of the cylinder sleeve 20 is further provided with a communicating hole 26. The communicating hole 26 communicates with the exhaust cavity 25. The fluid machinery further includes a flange 50 provided with an exhaust channel. The communicating hole 26 communicates with the exhaust channel. In this way, exhaust reliability of the cylinder sleeve 20 is ensured.

Figure 22:
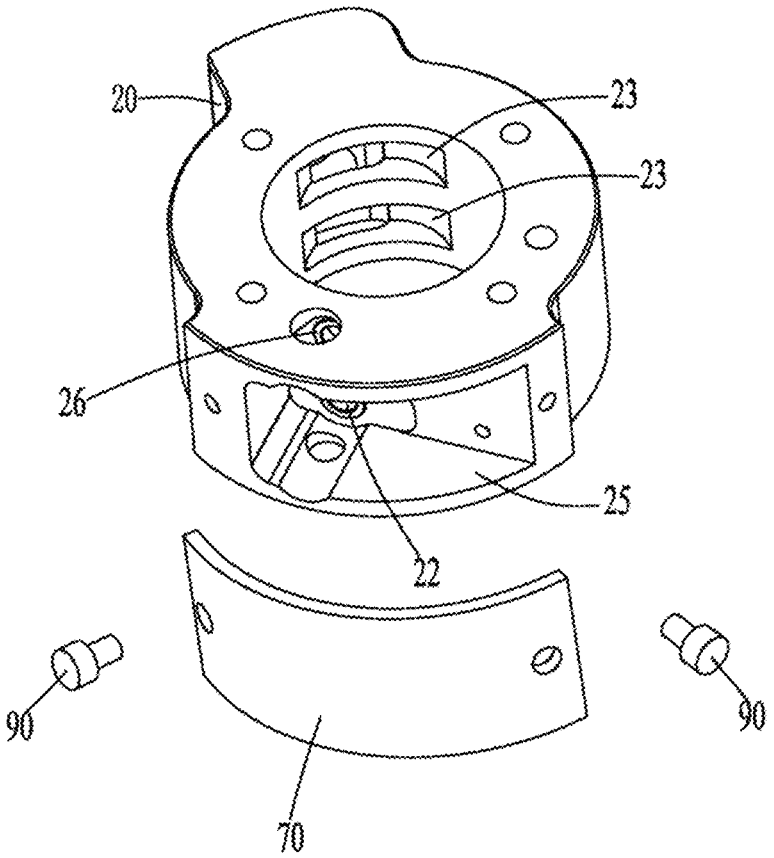
FIG. 22 shows a schematic exploded structural diagram of a cylinder sleeve and an exhaust cover plate in FIG. 5.

As shown in FIG. 22, the exhaust cavity 25 penetrates through an outer wall surface of the cylinder sleeve 20. The fluid machinery further includes an exhaust cover plate 70 connected to the cylinder sleeve 20 and sealing the exhaust cavity 25. In this way, the exhaust cover plate 70 functions to separate the volume-variable cavity 311 from an external space of the pump body assembly 83.

It should be noted that, in the present invention, when the volume-variable cavity 311 communicates with the compression exhaust port 22 and the pressure of the volume-variable cavity 311 reaches the exhaust pressure, the exhaust valve sheet 61 is opened. Compressed gas enters into the exhaust cavity 25 via the compression exhaust port 22 and passes through the communicating hole 26 at the cylinder sleeve 20. Then the compressed gas is discharged through the exhaust channel 51 and enters the external space (that is, a cavity of the compressor) of the pump body assembly 83, and thereby the exhaust process is finished.

In some embodiments, the exhaust cover plate 70 is fixed on the cylinder sleeve 20 by a fastener 90.

In some embodiments, the fastener 90 is a screw.

In some embodiments, an outer contour of the exhaust cover plate 70 is matched with an outer contour of the exhaust cavity 25.

An operation of the compressor is specifically described below.

As shown in FIG. 54, the motor assembly 82 drives the crankshaft 10 to rotate, so that the two eccentric parts 11 of the crankshaft 10 respectively drive the two corresponding sliding blocks 40 to move. The sliding block 40 performs revolution around the axis of the crankshaft 10, at the same time, the sliding block 40 performs rotation relative to the eccentric part 11, and the sliding block 40 reciprocates along the limiting channel 31 and drives the crossed groove structure 30 to rotate in the cylinder sleeve 20. When the sliding block 40 performs revolution, the sliding block 40 reciprocates along the limiting channel 31 simultaneously, to form a cross-shaped sliding block mechanism.

In other usage scenarios: exchanging positions of the intake port and the exhaust port of this compressor, and the machine serves as an expansion machine. That is, the exhaust port of the compressor serves as an intake port of the expansion machine to inlet high-pressure gas, the high-pressure gas pushes the mechanism to rotate, and after the gas being expanded, the gas is discharged through the compressor suction port (which is an exhaust port of the expansion machine).

When the fluid machinery is an expansion machine, the cylinder sleeve 20 has an expansion intake port and an expansion exhaust port. In the case that any of the sliding blocks 40 is at an intake position, the expansion exhaust port communicates with the corresponding volume-variable cavity 311. In the case that any of the sliding blocks 40 is at an exhaust position, the corresponding volume-variable cavity 311 communicates with the expansion intake port.

In some embodiments, an inner wall surface of the cylinder sleeve 20 has an expansion exhaust cavity 25 communicating with the expansion exhaust port.

In some embodiments, the expansion exhaust cavity 25 extends a first preset distance around a circumference direction of an inner wall surface of the cylinder sleeve 20, to form an arc-shaped expansion exhaust cavity 25, and the expansion exhaust cavity 25 extends from the expansion exhaust port to a side where the expansion intake port is located. An extension direction of the expansion exhaust cavity 25 is the same as a rotation direction of the crossed groove structure 30.

In some embodiments, there are two expansion exhaust cavities 25, and the two expansion exhaust cavities 25 are arranged at intervals along the axial direction of the cylinder sleeve 20. The cylinder sleeve 20 further has an expansion exhaust communicating cavity. The two expansion exhaust cavities 25 both communicates with the expansion exhaust communicating cavity, and the expansion exhaust port communicates with the expansion exhaust cavity 25 via the expansion exhaust communicating cavity.

In some embodiments, the expansion exhaust communicating cavity extends a second preset distance along the axial direction of the cylinder sleeve 20. At least one end of the expansion exhaust communicating cavity penetrates through the axial end surface of the cylinder sleeve 20.

Fourth Embodiment

Figure 66:
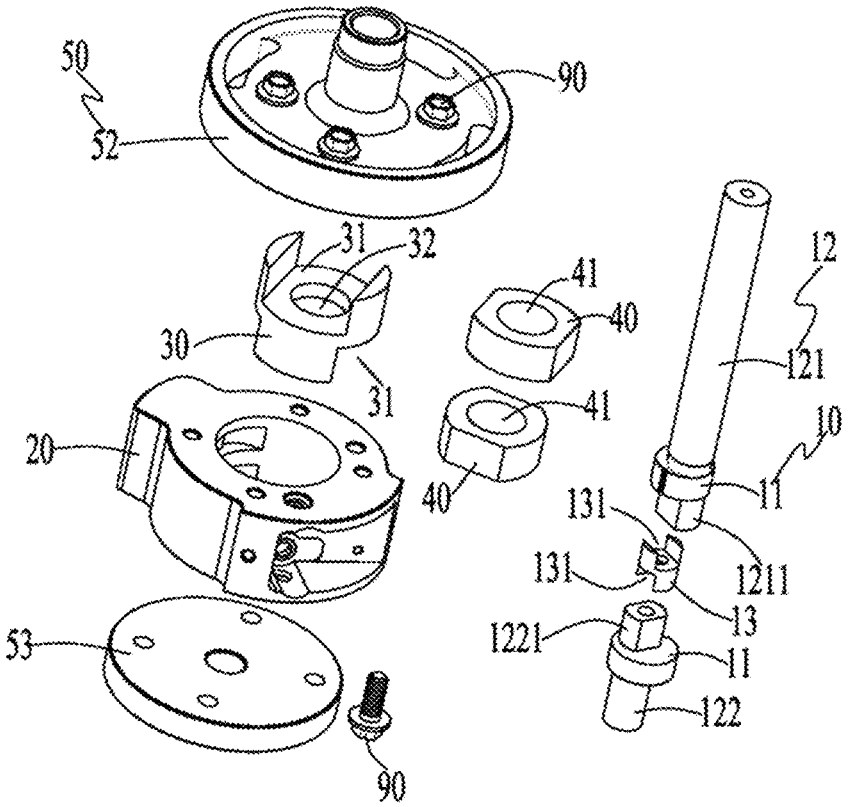
FIG. 66 shows a schematic exploded structural diagram of a pump body assembly of a compressor according to a second Embodiment of the present disclosure.
Figure 67:
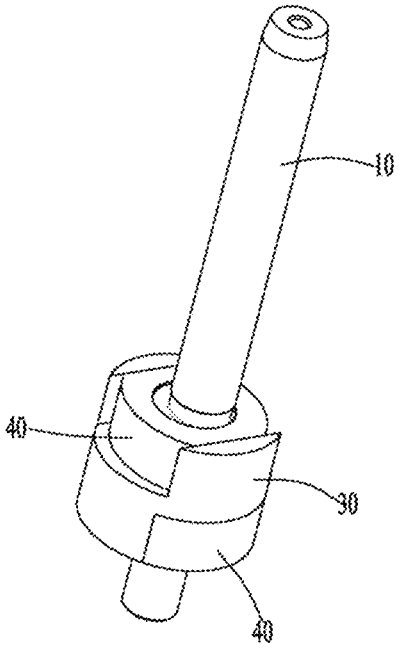
FIG. 67 shows a schematic diagram of an assembly structure of a crankshaft, a crossed groove structure and sliding blocks in FIG. 66.
Figure 68:
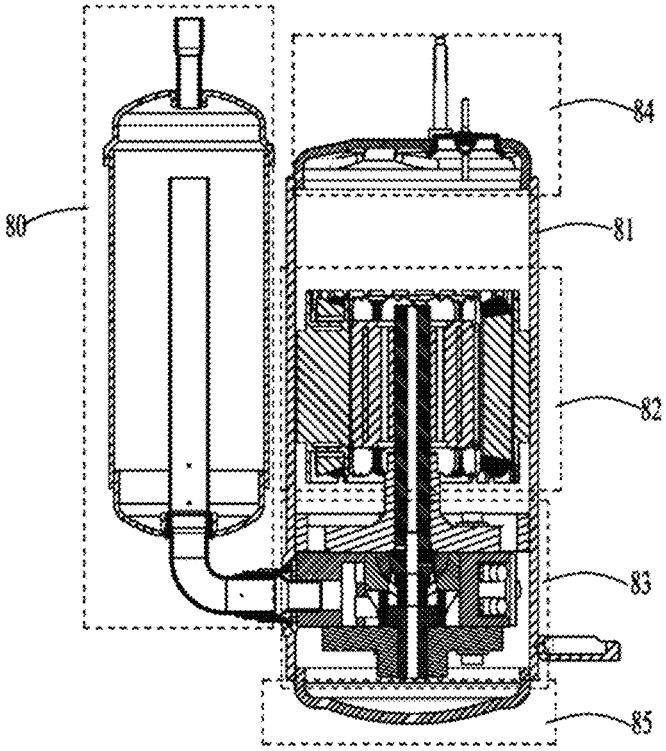
FIG. 68 shows a schematic diagram of an internal structure of a compressor according to a third embodiment of the present disclosure.
Figure 69:
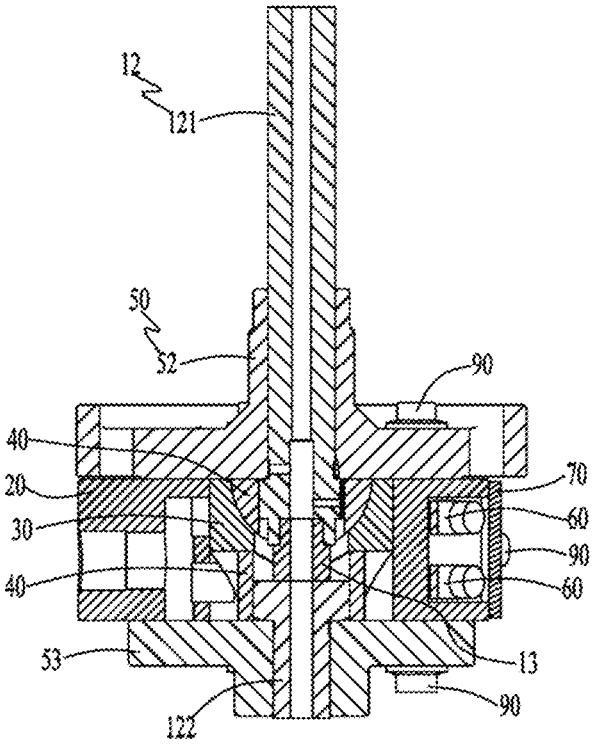
FIG. 69 shows a schematic structural diagram of a pump body assembly of the compressor in FIG. 68.
Figure 70:
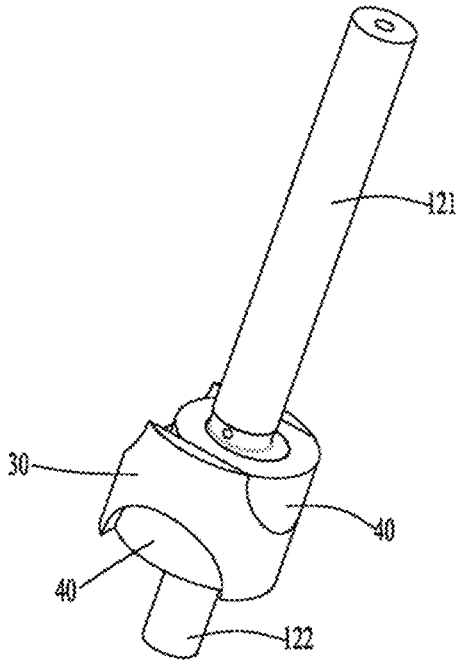
FIG. 70 shows a schematic diagram of an assembly structure of a crankshaft, a crossed groove structure and sliding blocks in FIG. 69.
Figure 71:
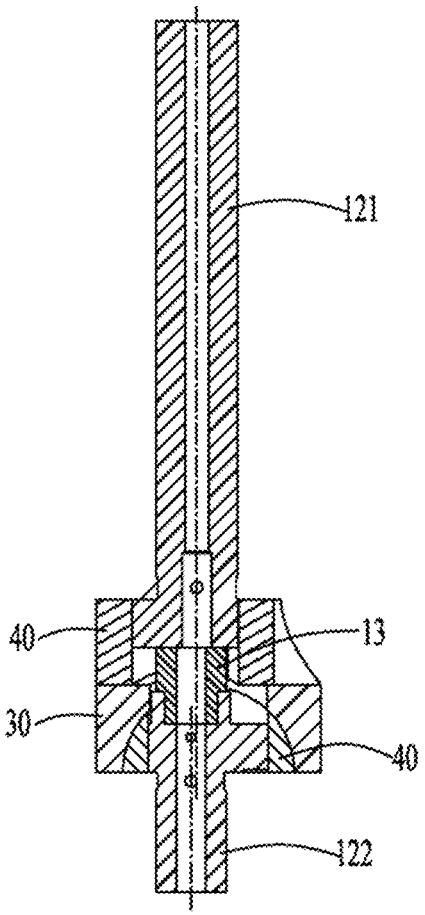
FIG. 71 shows a schematic sectional view of the crankshaft, the crossed groove structure and the sliding blocks in FIG. 70.
Figure 72:
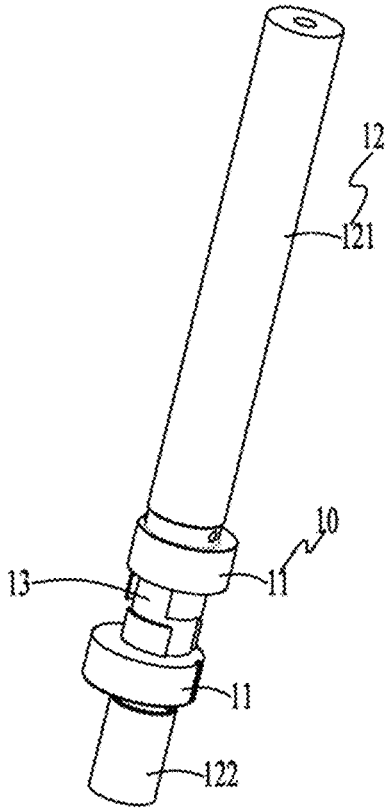
FIG. 72 shows a schematic structural diagram of the crankshaft in FIG. 70.
Figure 73:
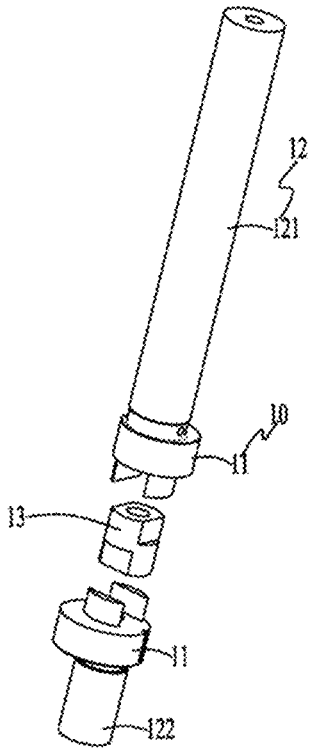
FIG. 73 shows a schematic exploded structural diagram of the crankshaft in FIG. 72.
Figure 74:
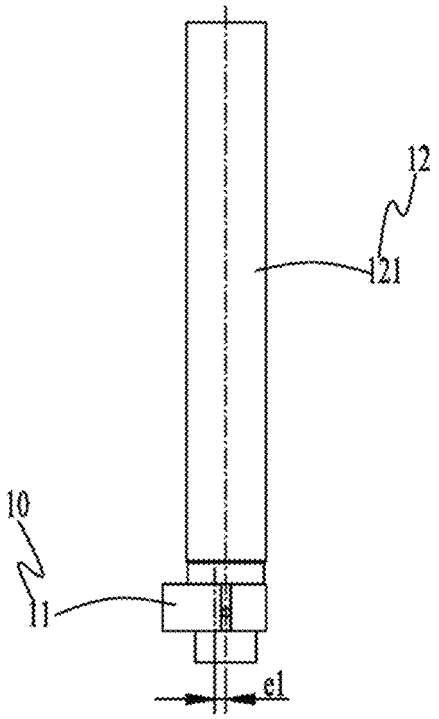
FIG. 74 shows a schematic structural diagram of a first section and an eccentric amount of an eccentric part at the first section in FIG. 73.

As shown in FIG. 66 and FIG. 67, a different between the present embodiment and the third embodiment is that a section of the limiting channel 31 of the crossed groove structure 30 is a quadrate, and correspondingly, a section in the sliding direction of the sliding block 40 is a quadrate matched with the limiting channel 31.

It should be noted that, the air suction and exhaust mode of the third embodiment is also applicable to the present embodiment, and details are not described herein again.

Fifth Embodiment

As shown in FIGS. 68 to 75, a different between the present embodiment and the third embodiment is that, the sliding connection member 13 has two limiting protrusions extending towards the first section 121 and the second section 122, respectively. The first section 121 has a first sliding slot structure at an end part of a side towards the sliding connection member 13, and the second section 122 has a second sliding slot structure at an end part of a side towards the sliding connection member 13. The two limiting protrusions are respectively arranged in the first sliding slot structure and the second sliding slot structure slidably, and an extension direction of the first sliding slot structure is perpendicular to an extension direction of the second sliding slot structure. The first section 121 is rotated, to make the corresponding limiting protrusion slide back and forth in the first sliding slot structure and the first sliding slot structure simultaneously interact with the sliding connection member 13, so that the sliding connection member 13 is rotated, and drives the limiting protrusion to slide back and forth in the second sliding slot structure while driving the second section 122 to rotate. Or, the second section 122 is rotated, to make the corresponding limiting protrusion slide back and forth in the second sliding slot structure and the second sliding slot structure simultaneously interact with the sliding connection member 13, so that the sliding connection member 13 is rotated, and drives the limiting protrusion to slide back and forth in the first sliding slot structure while driving the first section 121 to rotate. In this way, connection reliability between the first section 121 and the second section 122 may be ensured, and rotation stability between them may also be ensured meanwhile.

It should be noted that, the air suction and exhaust mode of the third embodiment is also applicable to the present embodiment, and details are not described herein again.

The fluid machinery in the embodiments of the present disclosure includes a compressor and an expansion machine and the like.

The heat exchange apparatus in the embodiments of the present disclosure includes an air conditioner and the like.

In the description of the present disclosure, it should be understood that, terms such as "first", "second", "third" and the like are used to define components, which are merely for the convenience of distinguishing the above-mentioned components. Unless otherwise stated, the above-mentioned terms do not have a special meaning, and therefore cannot be understood as a limitation to the scope of protection of the present disclosure.

In addition, in the absence of an explicit negative, technical features of one embodiment may be beneficially combined with one or other more embodiments.

Finally, it should be noted that, the above-mentioned embodiments are merely used to illustrate technical solutions of the present disclosure, and are not intended to limit them. Although the present disclosure has been described in details with reference to preferred embodiments, it should be understood by a person having ordinary skill in the art that specific embodiments of the present disclosure may still be modified or equivalent substituted a portion of the technical features without departing from the spirit of the technical solutions of the present disclosure, which shall fall within the scope of the technical solutions set forth in the present disclosure.

What is claimed is:

1. Fluid machinery, comprising:

a crankshaft, along an axial direction thereof provided with two eccentric parts, wherein there is a phase difference of a first included angle A between the two eccentric parts;

a cylinder sleeve, the crankshaft and the cylinder sleeve being eccentrically arranged and having a fixed eccentric distance therebetween;

a crossed groove structure, rotatably arranged in the cylinder sleeve, the crossed groove structure having two limiting channels, the two limiting channels sequentially being arranged along the axial direction of the crankshaft, and extension directions of the two limiting channels being perpendicular to the axial direction of the crankshaft, wherein there is a phase difference of a second included angle B between the extension directions of the two limiting channels, and the first included angle A is twice of the second included angle B; and two sliding blocks, provided with through holes, the two eccentric parts correspondingly extending into the two through holes on the two sliding blocks, the two sliding blocks being correspondingly arranged in the two limiting channels slidably, to form a volume-variable cavity, the volume-variable cavity being located at a sliding direction of the sliding block, and the crankshaft being rotated, to drive the sliding blocks to slide back and forth in the limiting channels while interacting with the crossed groove structure, so that the crossed groove structure and the sliding block are rotated in the cylinder sleeve, wherein in the case that one of the two sliding blocks is at a dead point position, driving torque of the other of the two sliding blocks is the maximum, and the crossed groove structure is driven to rotate by the sliding block with the maximum driving torque, and then the sliding block at the dead point position is driven to rotate by the crossed groove structure.

2. The fluid machinery according to claim 1, wherein the crossed groove structure comprises a first crossed groove section and a second crossed groove section which are connected along an axial direction thereof, the first crossed groove section and the second crossed groove section are non-coaxially arranged and are movably connected, and the first crossed groove section and the second crossed groove section are provided with the two limiting channels, respectively.

3. The fluid machinery according to claim 2, wherein a distance, between an inner ring axis of the cylinder sleeve located at the first crossed groove section and an inner ring axis of the cylinder sleeve located at the second crossed groove section, is equal to an eccentric distance between the first crossed groove section and the second crossed groove section.

4. The fluid machinery according to claim 2, wherein the crossed groove structure further comprises a first sliding connection member, the first crossed groove section is movably connected to the second crossed groove section via the first sliding connection member, the first crossed groove section is rotated while the first sliding connection member slides relative to the first crossed groove section, and the second crossed groove section is rotated while the first sliding connection member slides relative to the second crossed groove section.

5. The fluid machinery according to claim 4, wherein the first sliding connection member has two first limiting sliding slots, and extension directions of the two first limiting sliding slots are perpendicular to each other and are both perpendicular to the axial direction of the crankshaft;

the first crossed groove section has a third protrusion structure at an end part of a side towards the first sliding connection member, the second crossed groove section has a fourth protrusion structure at an end part of a side towards the first sliding connection member, and the third protrusion structure and the fourth protrusion structure are respectively arranged in the two first limiting sliding slots in a sliding manner;

the first crossed groove section is rotated, to make the third protrusion structure slide back and forth in the corresponding first sliding connection member while interacting with the first sliding connection member simultaneously, so that the first crossed groove section is rotated, and drives the fourth protrusion structure to slide back and forth in the corresponding first sliding connection member while driving the second crossed groove section to rotate; or, the second crossed groove section is rotated, to make the fourth protrusion structure slide back and forth in the corresponding first sliding connection member while interacting with the first sliding connection member simultaneously, so that the first crossed groove section is rotated, and drives the third protrusion structure to slide back and forth in the corresponding first sliding connection member while driving the first crossed groove section to rotate.

6. The fluid machinery according to claim 4, wherein the first sliding connection member has two first limiting protrusions extending towards the first crossed groove section and the second crossed groove section, respectively;

the first crossed groove section has a third sliding slot structure at an end part of a side towards the first sliding connection member, the second crossed groove section has a fourth sliding slot structure at an end part of a side towards the first sliding connection member, wherein the two first limiting protrusions are respectively arranged in the third sliding slot structure and the fourth sliding slot structure slidably, and an extension direction of the third sliding slot structure is perpendicular to an extension direction of the fourth sliding slot structure;

the first crossed groove section is rotated, to make the corresponding first limiting protrusion slide back and forth in the third sliding slot structure and the third sliding slot structure interact with the first sliding connection member, so that the first sliding connection member is rotated, and drives the first limiting protrusion to slide back and forth in the fourth sliding slot structure while driving the second crossed groove section to rotate; or, the second crossed groove section is rotated, to make the corresponding first limiting protrusion slide back and forth in the fourth sliding slot structure and the fourth sliding slot structure interact with the first sliding connection member simultaneously, so that the first sliding connection member is rotated, and drives the first limiting protrusion to slide back and forth in the third sliding slot structure while driving the first crossed groove section to rotate.

7. The fluid machinery according to claim 2, wherein a shaft body portion of the crankshaft is integrally formed and has only one axis.

8. The fluid machinery according to claim 2, wherein a shaft body portion of the crankshaft comprises a first section and a second section which are connected along the axial direction thereof, the first section and the second section are coaxially arranged, and the two eccentric parts are respectively arranged at the first section and the second section; and the first section is detachably connected to the second section.

9. The fluid machinery according to claim 8, wherein eccentric amounts of the two eccentric parts are unequal, wherein the eccentric amount of the first eccentric part is equal to an assembly eccentric amount between the crankshaft and the corresponding first crossed groove section; and the eccentric amount of the second eccentric part is equal to an assembly eccentric amount between the crankshaft and the corresponding second crossed groove section.

10. The fluid machinery according to claim 2, wherein a shaft body portion of the crankshaft comprises a first section and a second section which are connected along the axial direction thereof, the first section and the second section are non-coaxially arranged and are movably connected, and the two eccentric parts are respectively arranged at the first section and the second section.

11. The fluid machinery according to claim 10, wherein the crankshaft further comprises a sliding connection member, the first section is movably connected to the second section through the sliding connection member, the first section is rotated while the sliding connection member slides relative to the first section, and the second section is rotated while the sliding connection member slides relative to the second section.

12. The fluid machinery according to claim 11, wherein the sliding connection member has two limiting sliding slots, and extension directions of the two limiting sliding slots are perpendicular to each other and are both perpendicular to the axial direction of the crankshaft;

the first section has a first protrusion structure at an end part of a side towards the sliding connection member, and the second section has a second protrusion structure at an end part of a side towards the sliding connection member, wherein the first protrusion structure and the second protrusion structure are arranged in the two limiting sliding slots in a sliding manner, respectively;

the first section is rotated, to make the first protrusion structure slide back and forth in the corresponding limiting sliding slot and interact with the sliding connection member simultaneously, so that the sliding connection member is rotated, and drives the second protrusion structure to slide back and forth in the corresponding limiting sliding slot while driving the second section to rotate; or, the second section is rotated, to make the second protrusion structure slide back and forth in the corresponding limiting sliding slot and interact with the sliding connection member simultaneously, so that the sliding connection member is rotated, and drives the first protrusion structure to slide back and forth in the corresponding limiting sliding slot while driving the first section to rotate.

13. The fluid machinery according to claim 11, wherein the sliding connection member has two limiting protrusions extending towards the first section and the second section, respectively;

the first section has a first sliding slot structure at an end part of a side towards the sliding connection member, and the second section has a second sliding slot structure at an end part of a side towards the sliding connection member, wherein the two limiting protrusions are respectively arranged in the first sliding slot structure and the second sliding slot structure slidably, and an extension direction of the first sliding slot structure is perpendicular to an extension direction of the second sliding slot structure;

the first section is rotated, to make the corresponding limiting protrusion slide back and forth in the first sliding slot structure and the first sliding slot structure simultaneously interact with the sliding connection member, so that the sliding connection member is rotated, and drives the limiting protrusion to slide back and in the second sliding slot structure while driving the second section to rotate; or, the second section is rotated, to make the corresponding limiting protrusion slide back and forth in the second sliding slot structure and the second sliding slot structure simultaneously interact with the sliding connection member, so that the sliding connection member is rotated, and drives the limiting protrusion to slide back and forth in the first sliding slot structure while driving the first section to rotate.

14. The fluid machinery according to claim 10, wherein eccentric amounts of the two eccentric parts are equal, wherein an assembly eccentric amount, between the first section and the corresponding first crossed groove section, is equal to the eccentric amount of the eccentric part which is arranged at the first section, and an assembly eccentric amount, between the second section and the corresponding second crossed groove section, is equal to the eccentric amount of the eccentric part which is arranged at the second section.

15. The fluid machinery according to claim 10, wherein eccentric amounts of the two the eccentric parts are unequal, wherein an assembly eccentric amount, between the first section and the corresponding first crossed groove section, is equal to the eccentric amount of the eccentric part which is arranged at the first section, and an assembly eccentric amount, between the second section and the corresponding second crossed groove section, is equal to the eccentric amount of the eccentric part which is arranged at the second section.

16. The fluid machinery according to claim 1, wherein eccentric amounts of the two eccentric parts are unequal.

17. The fluid machinery according to claim 1, wherein the first included angle A ranges from 160 degrees to 200 degrees, and the second included angle B ranges from 80 degrees to 100 degrees.

18. The fluid machinery according to claim 1, wherein the eccentric part is provided with an arc surface, and a central angle of the arc surface is larger than or equal to 180 degrees.

19. A heat exchange apparatus, comprising the fluid machinery according to claim 1.

* * * * *